US008164009B2

(12) United States Patent
Kagami et al.

(10) Patent No.: US 8,164,009 B2
(45) Date of Patent: Apr. 24, 2012

(54) CONTROL KNOB WHICH OPERATES MULTIPLE SYSTEMS

(75) Inventors: Akinori Kagami, Yokkaichi (JP); Osamu Yoneji, Yokkaichi (JP); Masatoshi Koike, Yokkaichi (JP)

(73) Assignees: AutoNetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 319 days.

(21) Appl. No.: 12/449,370

(22) PCT Filed: Apr. 14, 2008

(86) PCT No.: PCT/JP2008/057291

§ 371 (c)(1),
(2), (4) Date: Aug. 5, 2009

(87) PCT Pub. No.: WO2008/129974

PCT Pub. Date: Oct. 30, 2008

(65) Prior Publication Data

US 2010/0140059 A1 Jun. 10, 2010

(30) Foreign Application Priority Data

| | | |
|---|---|---|
| Apr. 13, 2007 | (JP) | 2007-105944 |
| Jun. 25, 2007 | (JP) | 2007-166744 |
| Oct. 30, 2007 | (JP) | 2007-282025 |
| Feb. 18, 2008 | (JP) | 2008-036474 |

(51) Int. Cl.
*H01H 19/00* (2006.01)

(52) U.S. Cl. ..... 200/14

(58) Field of Classification Search ..... 200/14, 200/11 R, 17 R
See application file for complete search history.

(56) References Cited

U.S. PATENT DOCUMENTS

| | | | | |
|---|---|---|---|---|
| 3,621,158 | A * | 11/1971 | Nicholas Darryl Swinstead | 200/308 |
| 4,166,200 | A * | 8/1979 | Reichen et al. | 200/11 R |
| 4,891,476 | A * | 1/1990 | Nation et al. | 200/11 R |
| 5,012,056 | A | 4/1991 | Abel et al. | |
| 5,159,706 | A * | 10/1992 | Hodsdon | 455/90.3 |

(Continued)

FOREIGN PATENT DOCUMENTS

DE 38 34 390 C1 10/1988

(Continued)

OTHER PUBLICATIONS

Office Action issued in German Patent Appln. No. 11 2008 000 911.2; mailed Dec. 13, 2011.

*Primary Examiner* — Vanessa Girardi
(74) *Attorney, Agent, or Firm* — Oliff & Berridge, PLC

(57) ABSTRACT

A control knob capable of operating multiple systems has a first rotational body and a second rotational body coaxially arranged, and a shaft connected to the second rotational body. Opposite the shaft, a movable body is moved axially in response to rotation of the first rotational body. Engaging units have concaves or convexes, for example, similar to teeth. The engaging units are provided on the shaft or the movable body. An engaged unit is elastically biased toward one of the engaging units, and engages the concaves or convexes. In use, the control knob may be configured to permit selection of a function by rotation of the first rotational body, and to permit adjustment of the function by rotation of the second rotational body.

31 Claims, 41 Drawing Sheets

U.S. PATENT DOCUMENTS

| | | | | |
|---|---|---|---|---|
| 7,342,186 | B2 * | 3/2008 | Montalvo et al. | 200/11 R |
| 2006/0213753 | A1 | 9/2006 | Corduan et al. | |

FOREIGN PATENT DOCUMENTS

| | | | |
|---|---|---|---|
| DE | 10 2004 035 960 | A1 | 3/2006 |
| EP | 1 217 496 | A2 | 6/2002 |
| JP | A-55-131792 | | 10/1980 |
| JP | U-4-47722 | | 4/1992 |
| JP | A-2002-82729 | | 3/2002 |
| JP | A-2002-189556 | | 7/2002 |
| JP | A-2002-100-266 | | 4/2005 |
| JP | A-2006-222003 | | 8/2006 |
| JP | A-2006-260949 | | 9/2006 |
| JP | A-2007-59382 | | 3/2007 |

* cited by examiner

FIG. 17B
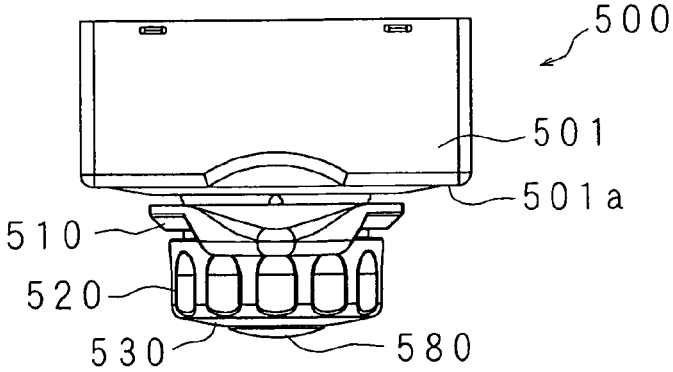
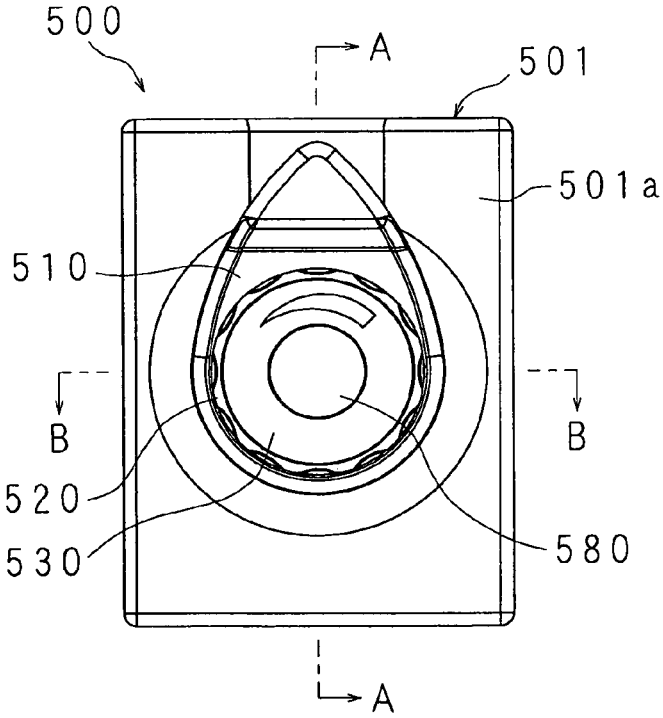
FIG. 17A
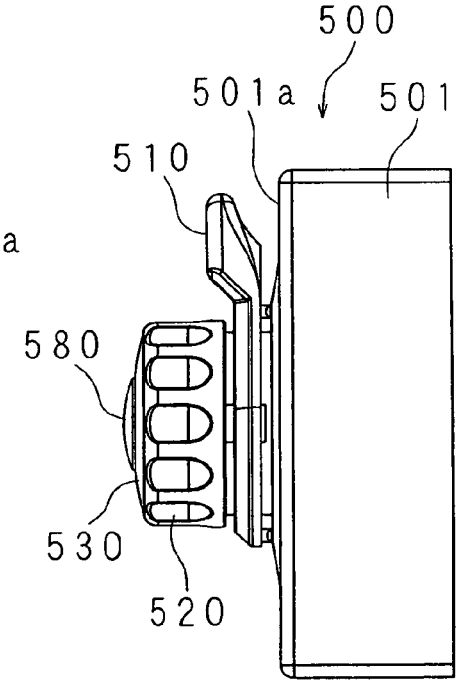
FIG. 17C

FIG. 18B
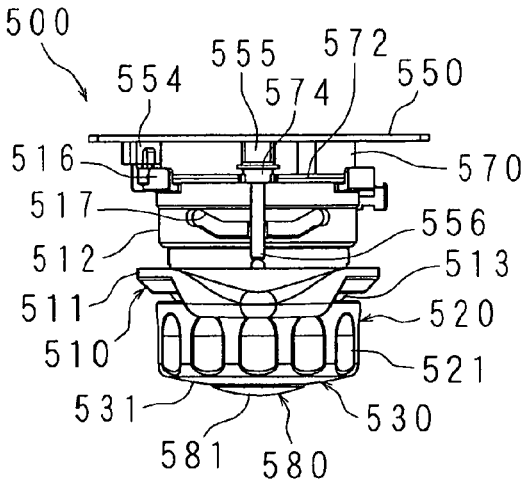
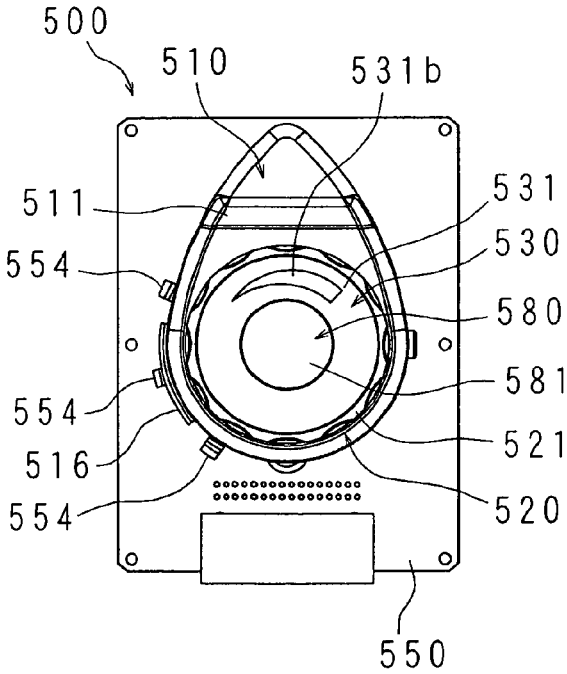
FIG. 18A
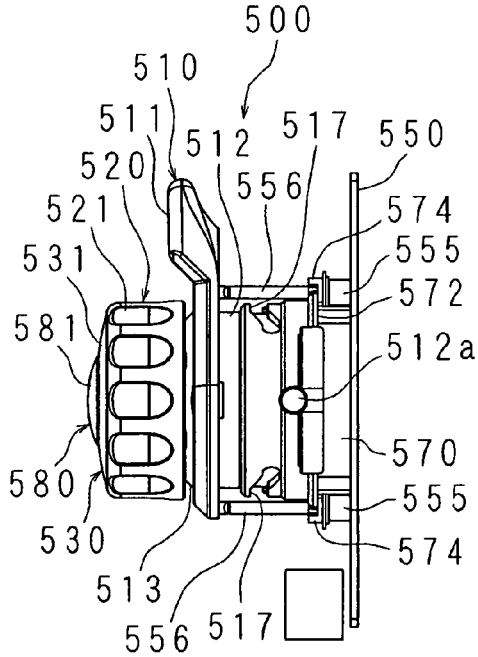
FIG. 18C

FIG. 19C
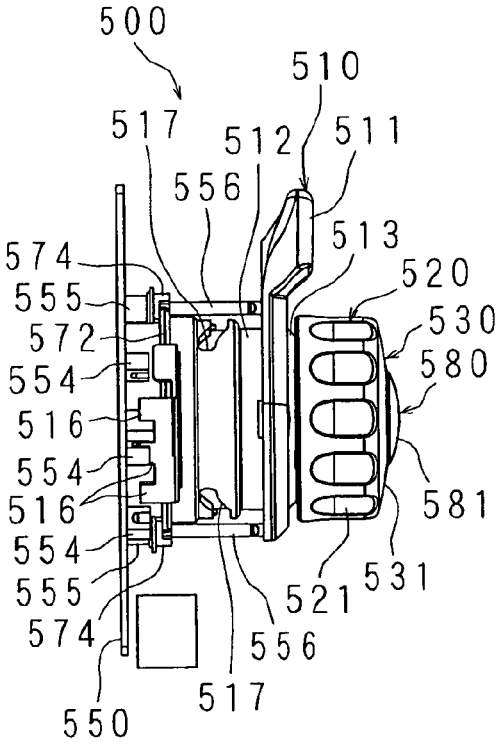
FIG. 19A
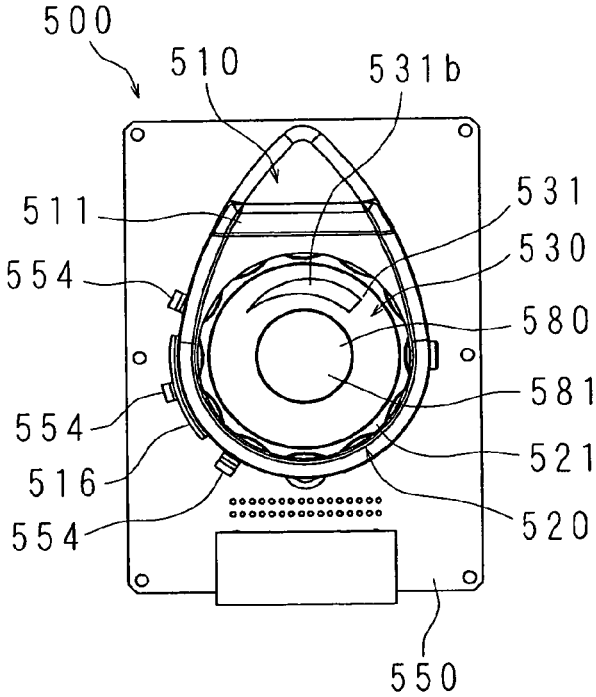
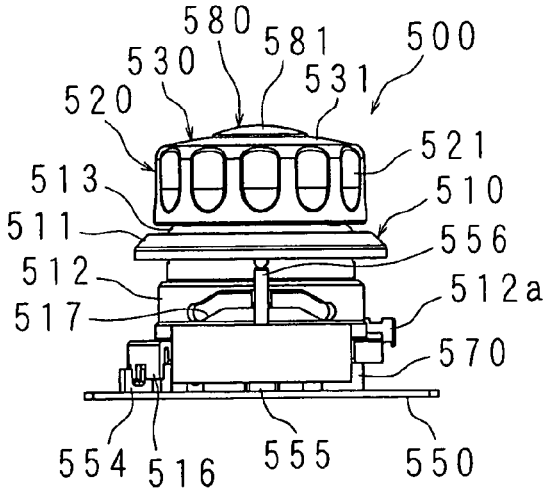
FIG. 19B

FIG. 25

| ROTATION POSITION OF MODE SWITCHING SWITCH | OUTPUT OF PHOTO INTERRUPTER | | |
|---|---|---|---|
| | 554a | 554b | 554c |
| (a) | L | L | H |
| (b) | L | H | H |
| (c) | L | H | L |
| (d) | H | H | L |
| (e) | H | L | L |

CONTROL KNOB WHICH OPERATES MULTIPLE SYSTEMS

This application is the national phase under 35 U.S.C. §371 of PCT International Application No. PCT/JP2008/57291 which has an International filing date of Apr. 14, 2008 and designated the United States of America.

BACKGROUND

1. Technical Field

The present invention relates to an operating device and an operating system, which can be used to operate various apparatuses (a vehicle navigation apparatus, an audio apparatus, an air conditioner, a television apparatus or a back camera or the like) that are installed in, for example, a vehicle, and do not require a large space for a placement.

2. Description of Related Art

In recent years, various apparatuses are installed in a vehicle. An operating device that has switches or buttons or the like for operating those apparatuses is placed in the vicinity of a driver seat, for example, in an instrument panel and the like. However, in association with the increase in the apparatuses installed in the vehicle and the increase in the functions of the apparatus, the larger number of the switches and the buttons and the like are required to operate the many functions. Thus, there is a problem of a lack of placement space. Hence, the operating device is requested in which the many functions can be operated by using the small number of the switches.

On the other hand, the operating device, namely, a so-called dial switch is widely used in which the function can be operated when a user rotationally operates, for example, a rotating body of a disc type. The dial switch can be used, for example, to adjust the sound volume of the audio apparatus or adjust the temperature of the air conditioner. Also, the dial switch is designed such that, when the user carries out the rotational operation, click feeling is generated in association with the rotation of the rotating body, in many cases. This design leads to a merit that the user can intuitively know the rotation amount of the rotating body.

In Japanese Patent Application Laid-Open No. 2006-260949, a rotating type switch is proposed which can generate the click feeling and can be easily assembled. This rotating type switch comprises a moving member that is rotatably attached to a fixing member and rotated by an external operation, and an annular receiver in which a plurality of clicking concaves are formed opposite to the fixing member at a predetermined pitch is provided in this moving member. Also, in the fixing member, a holding member having a ball engaged with the clicking concave is provided in the portion opposite to the annular receiver of the moving member so that it is pushed against the clicking concave by a spring. Thus, the click feeling can be generated by the engagement between the clicking concave and the ball ball.

In order to solve the problem of the lack of the placement space as mentioned above, the operating device with which the user can use one dial switch and operate a plurality of functions begins to be considered and actually used. For example, the operating device for operating the air conditioner can be configured such that this comprises a switching switch for switching the respective modes of "a temperature adjustment", "a wind quantity adjustment" or "a wind direction adjustment" or the like together with the dial switch, and the user, when operating the switching switch and switching to any of the modes and then rotationally operating the dial switch, can adjust the function corresponding to each of the modes.

However, in such an operating device, conventionally, the click feeling associated with the rotational operation of the dial switch was constant, and even if the switching switch was used to switch the mode, the click feeling could not be changed. Thus, there was a problem that the good operability could not be obtained, because the click feeling generated when the user carried out the rotational operation was equal between the case when the adjustment such as the temperature adjustment and the wind amount adjustment was carried out at the many stages of 10 or more stages and the case when the adjustment such as the wind direction was carried out at several stages.

In Japanese Patent Application Laid-Open No. 2006-222003, an operating unit is provided which can select and operate a desirable equipment from a plurality of electronic equipments and also change the click feeling correspondingly to the selected equipment. This operating unit is configured such that, when a push button is pressed and operated, one end side of a spring body rotatably supported on a center is pushed down to push up the other end side, and an upper spherical portion of a ball arranged on the other end side of the spring body is brought into contact with the bottom surface of a disc member on which click grooves are formed. The disc member is arranged coaxially with an operational knob for the rotational operation. Then, when the ball of the spring body and the click groove of the disc member are brought into contact, the click feeling is generated in association with the rotational operation of the operational knob. Moreover, this comprises: a plurality of push buttons correlated to the selections of the respective equipments; a plurality of spring bodies that are pushed down to the push buttons, respectively; and a plurality of disc members to which the balls provided on the respective spring bodies are brought into contact, respective, and this is configured such that the numbers or shapes of the click grooves on the respective disc members are different. Thus, the click feeling generated when the operational knob is rotationally operated can be changed for each equipment targeted for the operation.

SUMMARY

In the operating unit noted in Japanese Patent Application Laid-Open No. 2006-222003, the click feeling can be changed for each equipment targeted for the operation. However, the plurality of push buttons to select the equipment targeted for the operation are required to be placed around the operational knob. Thus, the size of the operating unit becomes large, which requires the large place space. Thus, the placement in the limited space such as the instrument panel and the like of the vehicle is not easy. Hence, it is impossible to solve the problem of the lack of the placement space as mentioned above.

The present invention is proposed in view of the above-mentioned circumstances. It is therefore an object of the present invention to provide an operating device which has a small size and many functions and in which by the operation for a first rotation operation body, click feeling generated when a second rotation operation body is operated can be changed, and for example, by the operation for a first rotating operation, a plurality of functions can be switched, and by the operation for a second rotating operation, the adjustment operation of the function in the different click feeling can be carried out, while enabling an easy placement in a small space.

An operating device according to the present invention is an operating device characterized by comprising: a first rotation operation body that is rotated and moved to a plurality of positions; a second rotation operation body that is provided coaxially with the first rotation operation body; a shaft that is coaxially connected with the second rotation operation body; a moving body that is provided opposite to the shaft, and is moved in an axial direction in response to rotation of said first rotation operation body; an engaging unit that is provided on one of said shaft and said moving body, and has a plurality of concaves or convexes which are aligned at a predetermined interval in a rotation direction of said shaft; and an engaged unit that is provided on the other of said shaft and said moving body, elastically biased towards said engaging unit, and engaged with said concaves or convexes, wherein on said one, a plurality of the engaging units that have the different number of the concaves or convexes respectively are aligned in said axial direction, and in response to the movement of said moving body, the engaging unit by which said engaged unit is elastically biased is changed.

The present invention is configured such that a first rotation operation body, which is rotated and moved to a plurality of positions, is used to select a plurality of functions in response to the moved position, and a second rotation operation body which is placed coaxially with the first rotation operation body is used to adjust or set the selected function by means of the rotational operation.

Also, by the rotational operation for the first rotating body, the click feeling generated when the second rotation operation body is operated is changed. For this reason, a shaft is coaxially connected with the second rotation operation body, and a moving body that is moved in the axial direction in response to the rotation of the first rotation operation body is placed opposite to the shaft. On one of the shaft and the moving body, a plurality of engaging units that have a plurality of concaves or convexes which are aligned at a predetermined interval in the rotation direction are aligned in the axial direction. On the other of the shaft or the moving body, an engaged unit that is elastically biased towards the engaging unit is provided.

Thus, by the engagement between the engaged unit and the engaging unit, the click feeling can be generated in association with the rotation of the second rotation operation body. Also, when the first rotation operation body is rotated, the moving body is moved in the axial direction, and the engaged unit is engaged with one of the plurality of engaging units that are aligned in the axial direction. Since the different numbers of the concaves or convexes are provided on the plurality of engaging units, respectively, the click feeling can be changed.

An operating device according to the present invention is characterized in that said moving body is cylindrical and said shaft is inserted through the moving body; said plurality of engaging units are aligned on an inner circumferential surface of said moving body, in the axial direction of said moving body; and said engaged unit is provided on an outer circumferential surface of said shaft.

In the present invention, the moving body that is moved in the axial direction in response to the rotation of the first rotation operation body is cylindrical, and the shaft connected to the second rotation operation body is inserted through the cylindrical moving body. On the inner circumferential surface of the cylindrical moving body, the plurality of engaging units are aligned in the axial direction, and the engaged unit that is elastically biased towards the outer circumferential surface of the opposite shaft is provided. Consequently, the engaged unit provided on the shaft can be surely engaged with the concaves or convexes of the engaging unit provided in the moving body, and the click feeling can be generated. Also, the cylindrical moving body can be moved in the axial direction, and the engaging unit with which the engaged unit is engaged can be changed. Thus, since the click feeling can be changed surely and easily, it is possible to surely improve the operability of the rotational operation for the second rotation operation body.

An operating device according to the present invention is characterized in that said plurality of engaging units are aligned on an outer circumferential surface of said shaft, in an axial direction of said shaft; and said engaged unit is provided on said moving body.

In the present invention, on the outer circumferential surface of the shaft connected to the second rotation operation body, the plurality of engaging units are aligned in the axial direction, and the engaged unit is provided on the opposite moving body. Thus, the engaged unit provided on the moving body can be surely engaged with the concaves or convexes of the engaging unit provided on the shaft, and the click feeling can be generated. Also, the engaging unit with which the engaged unit is engaged when the moving body is moved in the axial direction can be changed. Hence, since the click feeling can be changed surely and easily, the operability of the rotational operation for the second rotation operation body can be surely improved.

An operating device according to the present invention is characterized in that said moving body is cylindrical and said shaft is inserted through the moving body; and said engaged unit is provided on an inner circumferential surface of said moving body.

In the present invention, the moving body is cylindrical, and the engaged unit is provided on the inner circumferential surface of the moving body. Since the moving body is cylindrical, the shaft can be moved in the axial direction stably and smoothly. Thus, the click feeling can be surely changed, and the operability of the rotational operation for the second rotation operation body can be surely improved.

An operating device according to the present invention is characterized by comprising: a cylinder that is coaxially connected with said first rotation operation body; a guide groove that is provided on the cylinder, has a long shape in a circumferential direction of said cylinder, and is gradually displaced in an axial direction of said cylinder; and a bar-shaped inserted unit that is protrusively provided on said moving body, and is inserted into said guide groove, wherein in accordance with the rotation of said cylinder, an insertion position into said guide groove of said inserted unit is changed, and said moving body is moved in the axial direction.

In the present invention, a cylinder is coaxially connected with the first rotation operation body, and a groove which has a long shape in the circumferential direction of the cylinder and is gradually displaced in the axial direction of the cylinder is formed on the cylinder. A bar-shaped inserted portion that is inserted into the groove of the cylinder is provided on the moving body. In association with the rotation of the first rotation operation body, the cylinder is moved. At this time, the moving body in which the inserted portion is inserted into the groove is moved in the axial direction along the groove. Thus, in response to the rotation of the first rotation operation body, the moving body can be moved in the axial direction surely and easily. Hence, the operability of the rotational operation for the second rotation operation body can be surely improved.

An operating device according to the present invention is characterized by comprising protrusions which are provided on boundaries between said plurality of engaging units, respectively.

In the present invention, a protrusion is provided on the boundary between the plurality of engaging units. When the first rotation operation body is rotationally operated, the moving body is moved in the axial direction. However, at this time, the engaged unit elastically biased towards the engaging unit is engaged with the protrusion on the boundary between the engaging units. Thus, the click feeling can be generated. Thus, not only for the second rotation operation body but also for the first rotation operation body, the click feeling can be generated in association with the rotational operation. Hence, the operability of the operating device can be improved.

An operating device according to the present invention is characterized by comprising rotation detecting means that is provided coaxially with said shaft and detects rotation of said second rotation operation body.

In the present invention, rotation detecting means for detecting the rotation of the second rotation operation body, for example, a rotary encoder or the like is placed coaxially with the shaft connected to the second rotation operation body. In the operating device, such rotation detecting means is required to be provided. However, in a case of a configuration for transmitting the rotation of the second rotation operation body to the rotation detecting means by using a screw mechanism and the like, the rotation detecting means is required to be placed around the second rotation operation body or the shaft. Thus, there is a fear that the size of the operating device is increased, thereby requiring the wide placement space. So, this problem can be avoided by placing the rotation detecting means coaxially with the second rotation operation body. Thus, since the operating device can be miniaturized, the operating device can be surely placed even in the small space.

An operating device according to the present invention is characterized by comprising: a plurality of light shielding detection means which are aligned in said rotation direction at a predetermined interval, have a light emitting unit and a light receiving unit respectively, and detect light shielding in accordance with the presence or absence of the light, which is emitted by the light emitting unit and received by said light receiving unit; and a plurality of light shielding units which are provided on said shaft at an interval different from said predetermined interval, and optically shield light emitted by said light emitting units in turn in association with the rotation of said shaft, wherein said rotation detecting means detects rotation of said second rotation operation body, in response to a timing of light shielding detected by said plurality of light shielding detection means.

In the present invention, in order to detect the rotation of the second rotation operation body, on the substrate that rotatably holds the shaft or the like, a plurality of light shielding detection means each having a light emitting unit and a light receiving unit are provided at a predetermined interval in the rotation direction. Also, on the shaft, a plurality of light shielding units for optically shielding in turn the lights emitted by the light emitting units in association with the rotation are provided at a predetermined interval different from the interval between the plurality of light shielding detection means. Thus, by the plurality of light shielding units on the shaft, the plurality of light shielding detection means are optically shielded at the different timings. Thus, whether the rotation direction of the shaft is clockwise or counterclockwise can be judged in accordance with the order of detecting the light shielding. Also, in accordance with the timing when the light shielding detection means detects the light shielding, the number or time of the light shielding actions can be examined, thereby judging the rotation amount or rotation speed or the like. The light shielding detection means can be attained by using, for example, a photo interrupter and the like. However, this element is cheaper and smaller than the element for detecting the rotation of the rotary encoder and the like. Thus, the reduction in the size and the drop in the cost of the operating device can be easily attained. Also, the detection can be optically executed without any contact. Hence, the abrasion of the contact and the like are not generated, which can improve the reliability of the mechanism for detecting.

An operating device according to the present invention is characterized by comprising: a cylinder that is coaxially connected with said first rotation operation body; and rotation position detecting means for detecting a position of rotation of said cylinder.

In the present invention, the cylinder is coaxially connected with the first rotation operation body, and rotation position detecting means for detecting the rotation position of the cylinder is provided. The first rotation operation body is rotated to the plurality of positions, and the click feeling of the second rotation operation body is changed in response to this position. However, in the case of the configuration in which the operating device receives, for example, the selection of the function set by the first rotation operation body and then the setting of the received function is received by the second rotation operation body, the operating device can switch the function for receiving the setting, in accordance with the detection result of the rotation position detecting means. Thus, it is possible to detect the rotation position of the first rotation operation body, and it is possible to surely attain the reception of the operation in which the two rotation operation bodies are used.

An operating device according to the present invention is characterized by comprising a switching detection element that has an operated unit which is swingingly operated on said cylinder in association with rotation of said cylinder, and detects switching between contacts which is caused by swinging of the operated unit, wherein said rotation position detecting means detects a rotation position of said first rotation operation body in accordance with the detection result of said switching detection element.

The present invention is configured such that a switching detection element having an operated unit which is swingingly operated is provided and the cylinder swings the operated unit in association with the rotation. Thus, the operating device can judge the rotation position of the cylinder from the detection result of the switching detection element. If there are about two or three rotation positions, the rotation position can be easily judged by using one switching detection element that has about two or three contacts. Hence, when the number of the rotation positions of the first rotation operation body is relatively small, the rotation position can be easily detected, which can attain the miniaturization of the operating device, the drop in the cost and the like.

An operating device according to the present invention is characterized by comprising: a plurality of light shielding detection means which are aligned in said rotation direction at a predetermined interval, have a light emitting unit and a light receiving unit respectively, and detect light shielding in accordance with the presence or absence of light, which is emitted by the light emitting unit and received by said light receiving unit; and a plurality of light shielding units which are provided on said cylinder, and optically shield light emitted by said light emitting unit, wherein said rotation position detecting means detects a rotation position of said first rotation operation body, in response to a combination of light shielding detected by said plurality of light shielding detection means.

In the present invention, the plurality of light shielding detection means each having the light emitting unit and the light receiving unit are provided at the predetermined interval in the rotation direction, and on the cylinder, the plurality of light shielding units are provided at the predetermined interval. The interval between the plurality of light shielding detection means and the interval between the plurality of light shielding units may be equal or different. Thus, in response to the rotation position of the cylinder, the several light shielding units optically shield the several light shielding detection means. Thus, the rotation position of the cylinder can be judged in accordance with the combination of the light shielding detectors among the plurality of light shielding detectors by which the light shielding are detected. In the case of this configuration, increasing the number of the light shielding detection means can easily increase the number of the detectable rotation positions. Thus, even if there are the many rotation positions of the first rotation operation body, it is possible to detect the rotation position without increasing the size of the operating device, and it is possible to easily attain the increase in the number of the functions of the operating device. Also, since the rotation position can be optically detected without any contact, the reliability of the mechanism for detecting can be improved.

An operating device according to the present invention is characterized in that said shaft is cylindrical and said operating device comprising: pressing detection means for detecting pressing; a press operation body that is moved in said axial direction in accordance with a pressing operation; and a pressing member that is linked to the press operation body, and presses said pressing detection means through said shaft in association with said pressing operation.

In the present invention, a press operation body for receiving a pressing operation is provided. Consequently, since the operating device can further receive the pressing operation, the user can carry out the more operations or more complex operations by using this operating device. Also, the shaft connected to the second rotation operation body is cylindrical, and a pressing member inserted through the shaft is linked to the press operation body, and pressing detection means that is provided on the substrate for rotatably holding the shaft is pressed by the pressing member. Thus, the pressing operation against the press operation body provided in the second rotation operation body can be detected by the pressing detection means provided on the substrate. Hence, without increasing the size of the operating device, the operating device can receive the pressing operation. Hence, the increase in the number of the functions of the operating device can be attained, which can improve the operability.

An operating device according to the present invention is characterized in that said second rotation operation body and said shaft are cylindrical and said operating device comprising: a light emitting body; a light guide member that is provided so as to be inserted through said shaft, and guides light emitted by said light emitting body into said second rotation operation body; and a light-transmitting unit for transmitting light guided by the light guide member to outside.

In the present invention, a light emitting body is provided inside the operating device, and the light of the light emitting body is emitted from a light-transmitting unit to the outside. Consequently, the visual effect optically emitted by a part of the operating device can be given to the user. Also, the second rotation operation body and the shaft are cylindrical, and the light emitting body is provided on the substrate for rotatably holding the shaft, and a light guide member inserted through the shaft is used to guide the light from the light emitting body into the second rotation operation body. Consequently, even if the second rotation operation body and the light emitting body are separated, the light of the light emitting body can be surely guided into the second rotation operation body. Since the light-transmitting unit is provided in the second rotation operation body or in the vicinity thereof, the light obtained through the light guide member can be emitted to the outside. Moreover, the light-transmitting unit is provided in the first rotation operation body, and the light is guided from the light-transmitting unit of the second rotation operation body to the first rotation operation body. Thus, the light can be emitted from the light-transmitting unit of the first rotation operation body to the outside. Hence, since the visual effect optically emitted by the operating device can be given to the user, the appearance of the operating device can be improved, and the operability of the operating device at night can be improved.

An operating device according to the present invention is characterized in that said first rotation operation body is swingably supported, and said operating device comprising swinging detection means for detecting swinging of said first rotation operation body.

In the present invention, the first rotation operation body is swingably supported. Means for detecting the swinging of the first rotation operation body is provided in the operating device, and the swinging operation for the first rotation operation body is received. Thus, the user can execute not only the rotational operation of the first rotation operation body but also the swinging operation. Thus, the plurality of kinds of operations can be received by one operation body. Hence, it is possible to increase the number of the functions of the operating device and improve the operability, convenience and the like of the operating device.

An operating device according to the present invention is characterized in that said second rotation operation body or said shaft is hollow, the operating device comprising: a fixed shaft which is interiorly provided coaxially with hollow said second rotation operation body or said shaft, and fixed in a manner that the fixed shaft cannot be rotated; and a wave-shaped annular body which is sandwiched between said second rotation operation body or said shaft and said fixed shaft, wherein an operational load is applied to said second rotation operation body by said annular body.

In the present invention, the second rotation operation body or the shaft is hollow, and the fixed shaft that is fixed in the manner that it cannot be rotated is placed therein. Also, a wave-shaped annular body is sandwiched between the second rotation operation body or the shaft and the fixed shaft. Since the wave-shaped annular body is sandwiched, the second rotation operation body or the shaft is biased in the direction separated from the fixed shaft. Thus, the operational load can be given. When the height of the wave of the annular body is suitably set, the moderate operational load can be given to the user who operates the second rotation operation body. Hence, the operational feeling of the operating device can be improved.

An operating device according to the present invention is an operating device characterized by comprising: a first rotation operation body that is rotated and moved to a plurality of positions; a second rotation operation body that is provided coaxially with the first rotation operation body; two opposite units that are provided in said second rotation operation body, so as to be opposite in an axial direction of a rotation shaft of the second rotation operation body; an annular moving body, which is inserted through the rotation shaft of said second rotation operation body, and is moved in the axial direction of said rotation shaft between said two opposite units so that the moving body comes close to one of said two opposite units and moves away from the other in response to rotation of said first rotation operation body; engaging units, which are provided on said two opposite units, respectively, and have a plurality of concaves or convexes aligned at a predetermined interval in a rotation direction of said second rotation operation body; and engaged units, which are provided on one side and the other side in said axial direction of said moving body, respectively, and when said moving body approaches said opposite unit, said engaged units being elastically biased towards the approached engaging unit in said opposite unit and being engaged with said concaves or convexes, wherein in the engaging units provided in said two opposite units, respectively, the numbers of aligned said concaves or convexes differ from each other.

The present invention is configured such that the function targeted for the operation is selected in accordance with the rotation position of the first rotation operation body, and by the second rotation operation body that is coaxially provided, the selected function is adjusted or set through the rotational operation. Since the two rotation operation bodies are comprised, the number of the functions of the operating device can be increased. Since the two rotation operation bodies are coaxially provided, the operating device is miniaturized.

Also, by the rotational operation for the first rotation operation body, the click feeling is changed which is generated when the second rotation operation body is operated. For this reason, two opposite units opposite to each other in the axial direction of the rotation shaft are provided in the second rotation operation body. An annular moving body inserted through the rotation shaft is provided between the two opposite units. Then, the moving body is moved in response to the rotation of the first rotation operation body so that the moving body comes close to one of the two opposite units and moves away from the other. Also, the engaging units that have the plurality of concaves or convexes are provided on the two opposite units, respectively, and the engaged units that are elastically biased are provided on one side and the other side in the axial direction of the moving body, respectively. Then, in association with the movement of the moving body, one engaged unit is engaged with the engaging unit provided on one opposite unit. By the engagement between the plurality of concaves or convexes of the engaging unit and the engaged unit that is elastically biased, the click feeling can be generated in association with the rotation of the second rotation operation body. In this case, in association with the rotation of the first rotation operation body, the engaging unit and the engaged unit that are engaged with each other is changed. Thus, by providing the engaging units having the different number of the concaves or convexes are provided on the two opposite units, respectively, the click feeling can be changed.

Thus, the operating device having the many functions can be placed in the small space such as the instrument panel and the like in the vehicle, and the operability of the rotational operation for the second rotation operation body can be improved, and the convenience of the operating device can be improved.

An operating device according to the present invention is an operating device characterized by comprising: a first rotation operation body that is rotated and moved to a plurality of positions; a second rotation operation body that is provided coaxially with the first rotation operation body; two opposite units that are provided in said second rotation operation body, so as to be opposite in an axial direction of a rotation shaft of the second rotation operation body; an annular moving body that is inserted through the rotation shaft of said second rotation operation body, and is moved in the axial direction of said rotation shaft between said two opposite units so that the moving body comes close to one of said two opposite units and moves away from the other in response to rotation of said first rotation operation body; engaging units that are provided on one side and the other side in said axial direction of said moving body, respectively, and have a plurality of concaves or convexes aligned at a predetermined interval in a rotation direction of said second rotation operation body; and engaged units, which are provided on said two opposite units, respectively, and when said moving body approaches said opposite units, said engaged units being elastically biased towards the approached engaging unit in said moving body and being engaged with said concaves or convexes, wherein in the engaging units provided on one side and the other side of said moving body, respectively, the numbers of aligned said concaves or convexes differ from each other.

The present invention is configured similarly to the above-mentioned configuration, in which the first rotation operation body and the second rotation operation body are coaxially placed and by the rotational operation for the first rotation operation body, the click feeling generated when the second rotation operation body is operated is changed. For this reason, in the second rotation operation body, the shaft is coaxially provided, and the two opposite units opposite in the axial direction are provided. Between the two opposite units, the annular moving body inserted through the shaft is provided. Then, in such a way that the moving body comes close to one of the two opposite units and moves away from the other, the moving body is moved in response to the rotation of the first rotation operation body. Also, the engaging units having the plurality of concaves or convexes are provided on one side and the other side in the axial direction of the moving body, respectively, and the engaged units that are elastically biased are provided on the two opposite units, respectively. Then, in association with the movement of the moving body, one engaging unit is engaged with the engaged unit provided on one of the opposite units. By the engagement between the plurality of concaves or convexes of the engaging unit and the engaged unit that is elastically biased, the click feeling can be generated in association with the rotation of the second rotation operation body. In this case, in association with the rotation of the first rotation operation body, the engaging unit and the engaged unit that are engaged with each other are changed. Thus, the engaging units having the different numbers of the concaves or convexes are provided on one side and the other side of the moving body, respectively. Hence, the click feeling can be changed.

Thus, the operating device having the many functions can be placed in the small space such as the instrument panel and the like of the vehicle, and the operability of the rotational operation for the second rotation operation body can be improved, and the convenience of the operating device can be improved.

An operating device according to the present invention is characterized by comprising: a cylinder that is coaxially connected with said first rotation operation body; a guide groove that is provided on the cylinder, has a long shape in a circumferential direction of said cylinder, and is gradually displaced in an axial direction of said cylinder; and an inserted unit that is provided in said moving body, and is inserted into said guide groove, wherein in response to rotation of said cylinder, an insertion position into said guide groove of said inserted unit is changed, and said moving body is moved in the axial direction.

In the present invention, the cylinder that is rotated together with the first rotation operation body is coaxially provided, and the guide groove that has the long shape in the circumferential direction of the cylinder and is gradually displaced in the axial direction of the cylinder is formed on the cylinder. The inserted unit inserted into the guide groove of the cylinder is provided in the moving body. In association with the rotation of the first rotation operation body, the cylinder is rotated, and the moving body in which the inserted unit is inserted into the guide groove is moved in the axial direction along the guide groove. Thus, in response to the rotation of the first rotation operation body, the moving body can be moved in the axial direction surely and easily.

Thus, it is possible to change the click feeling in association with the rotation of the second rotation operation body, surely and easily. Also, it is possible to improve the operability of the rotational operation for the second rotation operation body surely and easily.

An operating device according to the present invention is characterized in that said first rotation operation body is swingably supported by said cylinder, and comprising swinging detection means for detecting swinging of said first rotation operation body.

The present invention is configured such that the cylinder swingably supports the first rotation operation body. Thus, the user can perform not only the rotational operation but also the swinging operation on the first rotation operation body. The swinging of the first rotation operation body is detected by using a plurality of switches that are pushed down, for example, by the swinging, as the detecting means. Thus, since the operating device can receive the swinging operation of the user, the increase in the number of the functions of the operating device can be attained. Hence, the convenience of the operating device can be further improved.

An operating device according to the present invention is characterized by comprising rotation detecting means that is provided coaxially with the rotation shaft of said second rotation operation body, and detects rotation of said second rotation operation body.

In the present invention, the detecting means for detecting the rotation of the second rotation operation body, for example, the rotary encoder or the like is placed coaxially with the shaft provided in the second rotation operation body. In the operating device for receiving the rotational operation, such detecting means is required to be provided. However, in the case of the configuration for transmitting the rotation of the second rotation operation body to the detecting means by using a gear mechanism and the like, the detecting means is required to be placed around the second rotation operation body or the shaft. Thus, there is the fear that the size of the operating device is increased, thereby requiring the wide placement space. So, this problem can be avoided by placing the detecting means coaxially with the second rotation operation body. Hence, since the operating device can be miniaturized, the operating device which has many functions can be surely placed in the small space such as the instrument panel and the like of the vehicle.

An operating system according to the present invention is an operating system characterized by comprising a plurality of the above-mentioned operating devices, wherein different operation loads are given to said second rotation operation bodies in the respective operating devices.

In the present invention, the plurality of operating devices are comprised to carry out the more functions. Also, the different operational loads are given to the second rotation operation bodies in the respective operating devices. Thus, even when the plurality of second rotation operation bodies are aligned, the user can easily judge the second rotation operation body that is operated among the plurality of second rotation operation bodies, on the basis of the operational load. Thus, the user can operate the desirable second rotation operation body without visually checking the plurality of second rotation operation bodies. Hence, it is possible to increase the operability and convenience of the operating system comprising the plurality of operating devices.

An operating system according to the present invention is characterized in that said second rotation operation body or said shaft is hollow, each of said operating devices has: a fixed shaft, which is interiorly provided coaxially with hollow said second rotation operation body or said shaft, and is fixed in a manner that the fixed shaft cannot be rotated; and a wave-shaped annular body which is sandwiched between said second rotation operation body or said shaft and said fixed shaft, and gives said operation load, and said annular bodies in the respective operating devices have wave shapes whose heights differ from each other.

In the present invention, the second rotation operation body or the shaft is hollow, and the fixed shaft that is placed in the manner that it cannot be rotated is placed therein. Also, the wave-shaped annular body is sandwiched between the second rotation operation body or the shaft and the fixed shaft. Since the wave-shaped annular body is sandwiched, the second rotation operation body or the shaft is biased in the direction separated from the fixed shaft. Thus, the operational load can be given. Also, the respective annular bodies comprised in the respective operating devices are wave-shaped in which the heights are different. Hence, under the easy and cheap configuration, the different operational loads can be given to the second rotation operation bodies in the respective operating devices.

An operating system according to the present invention is an operating system characterized by comprising a plurality of the above-mentioned operating devices, wherein the engaged units in the respective operating devices are biased by biasing forces which differ from each other.

In the present invention, the plurality of operating devices are comprised to carry out more functions. The loads of the rotational operations for the second rotation operation bodies in the respective operating devices are changed on the basis of the magnitude of the biasing force of the engaged unit that is elastically biased towards the engaging unit. Thus, when the engaged units in the respective operating devices are biased by the different biasing forces, the different operation loads can be given to the second rotation operation bodies in the respective operating devices. Consequently, even if the plurality of second rotation operation bodies are aligned, the user can easily judge the second rotation operation body that is operated among the plurality of second rotation operation bodies, on the basis of the operational load. Thus, the user can operate the desirable second rotation operation body without visually checking the plurality of second rotation operation bodies. Hence, the operability and convenience of the operating system that comprises the plurality of operating devices can be improved.

According to the present invention, by comprising the first rotation operation body and the second rotation operation body that are coaxially provided, since the operating device can be miniaturized, the operating device can be placed in the small space such as the instrument panel and the like in the vehicle. Also, in association with the rotational operation for the first rotation operation body, the click feeling generated when the second rotation operation body is operated can be changed, thereby improving the operability of the rotational operation for the second rotation operation body. Hence, the convenience of the operating device can be improved.

The above and further objects and features will more fully be apparent from the following detailed description with accompanying drawings.

BRIEF DESCRIPTION OF THE DRAWINGS

FIGS. 17A to 17C are trihedral views showing the configuration of the operating device according to the fifth embodiment.

FIGS. 18A to 18C are trihedral views showing an inner configuration of the operating device according to the fifth embodiment.

FIGS. 19A to 19C are trihedral views showing the inner configuration of the operating device according to the fifth embodiment.

FIG. 25 is a diagrammatic view describing the method of detecting the rotation position of the mode switching switch.

DETAILED DESCRIPTION

First Embodiment

Figure 1C:
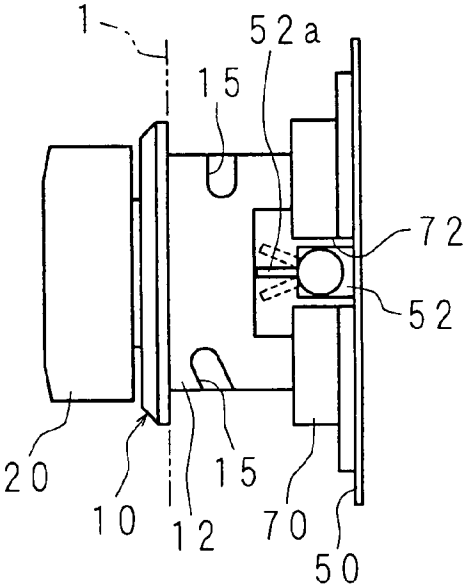
FIGS. 1A to 1C are trihedral views showing a configuration of an operating device according to a first embodiment of the present invention.
Figure 1A:
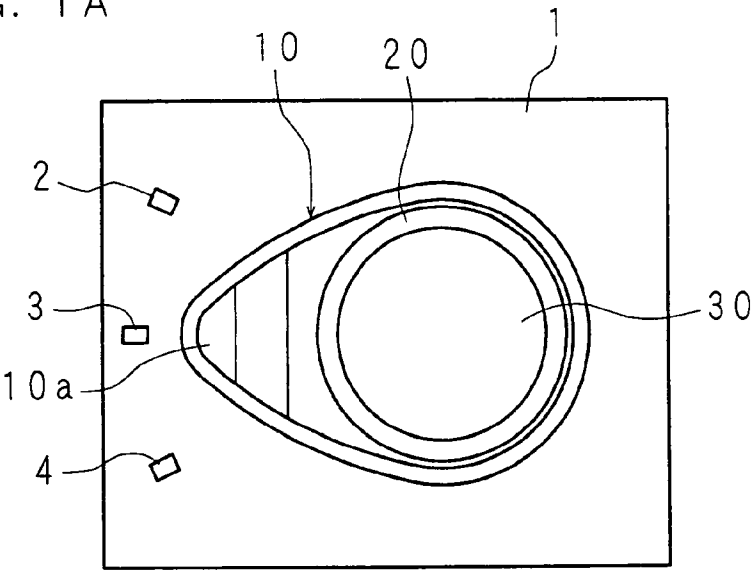
Figure 1B:
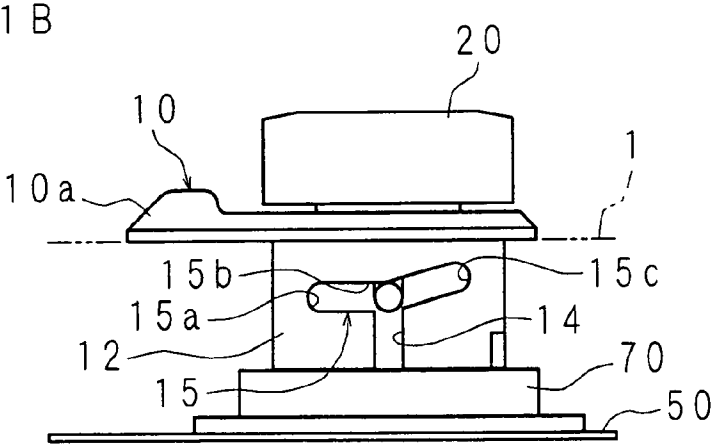
Figure 2:
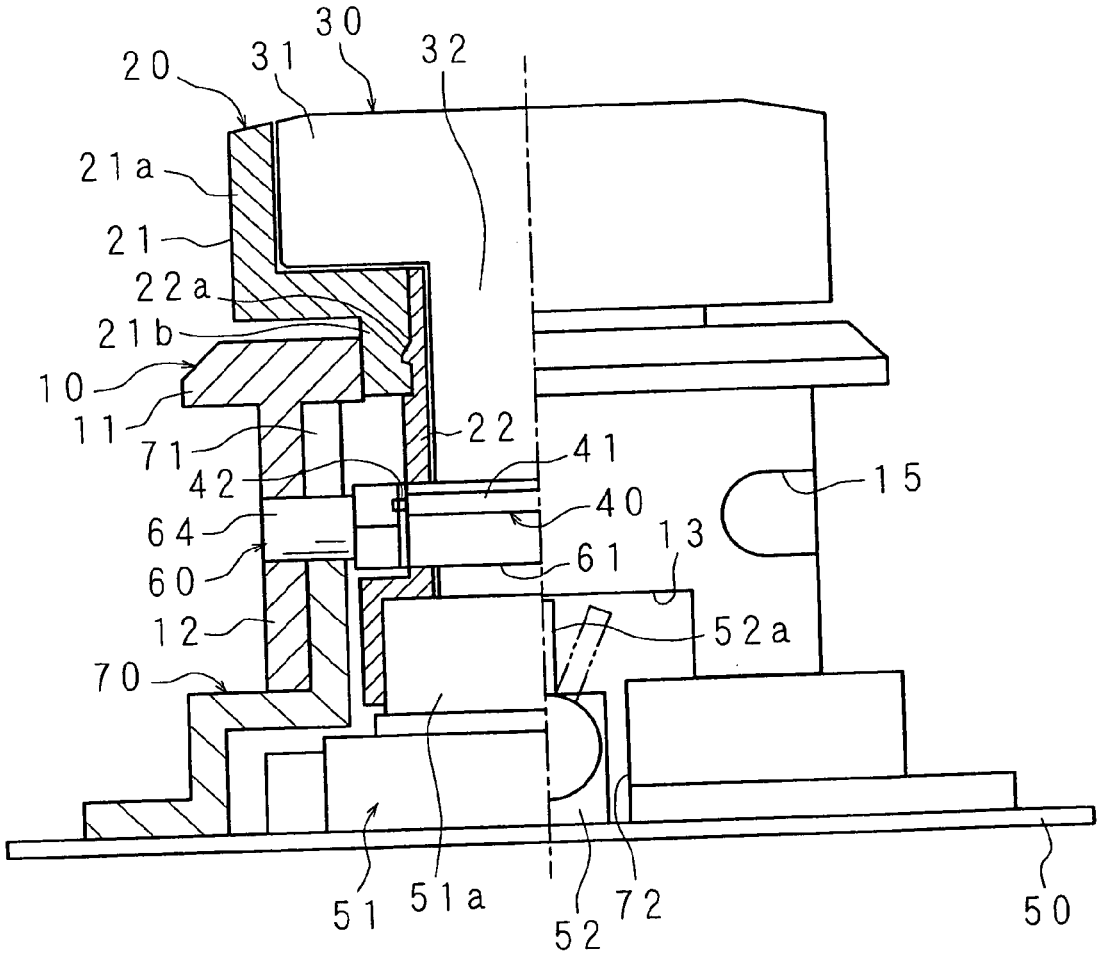
FIG. 2 is a sectional view showing an inner configuration of the operating device according to the first embodiment of the present invention.
Figure 3A:
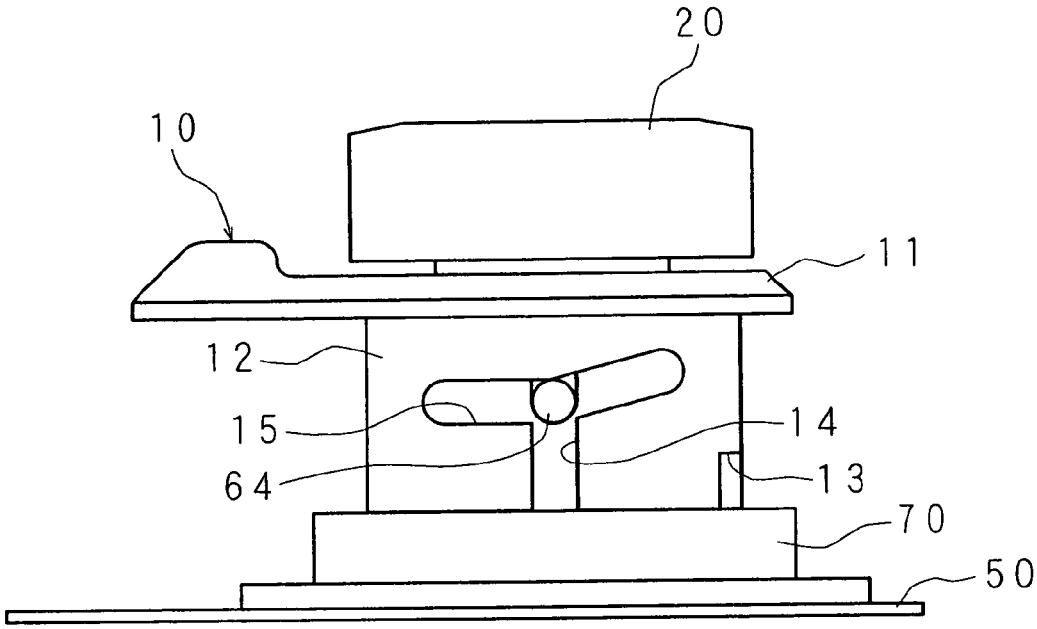
FIGS. 3A and 3B are side views showing the configuration of the operating device according to the first embodiment of the present invention.
Figure 3B:
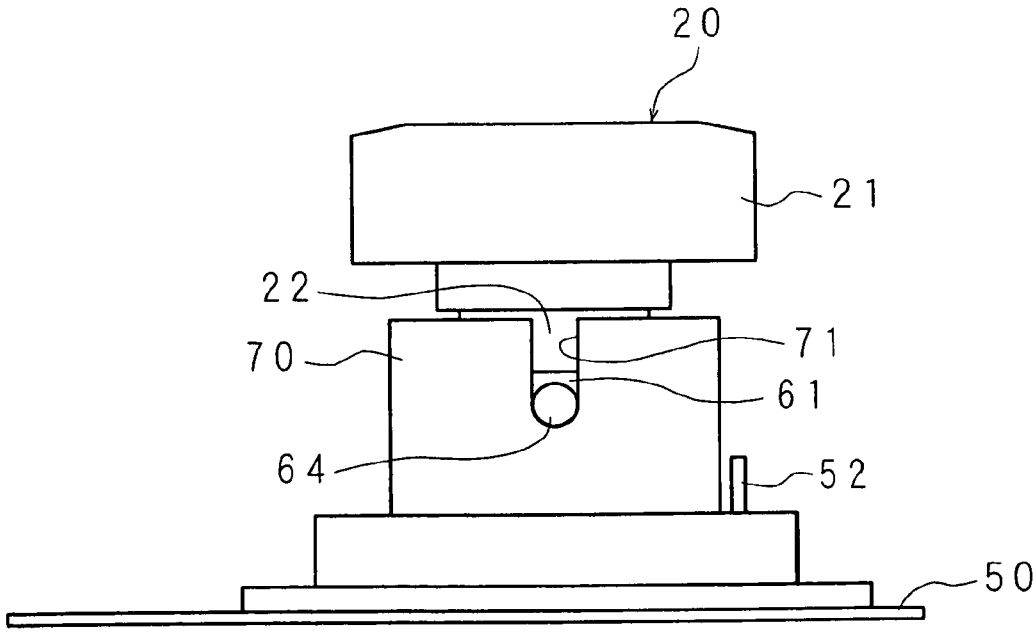
Figure 4A:
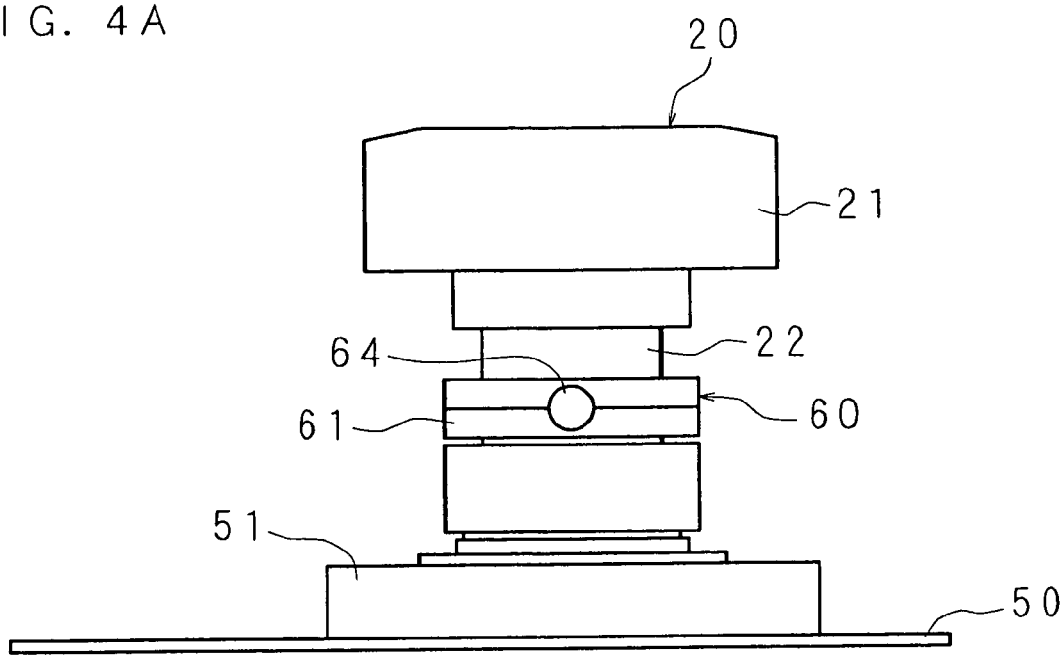
FIGS. 4A and 4B are side views showing the configuration of the operating device according to the first embodiment of the present invention.
Figure 4B:
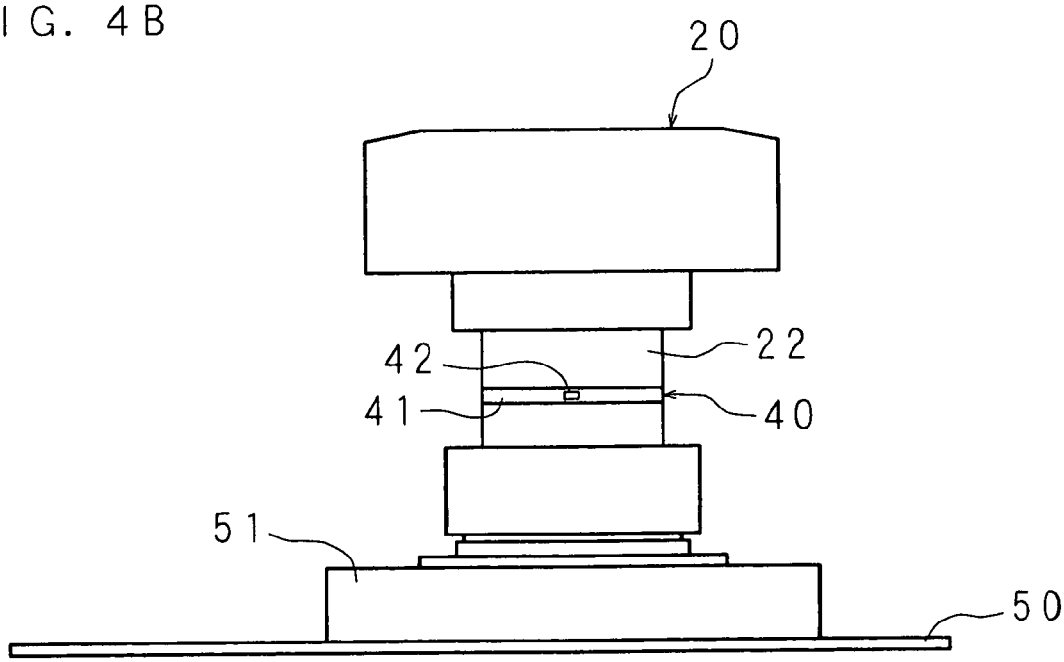

The present invention will be specifically described below on the basis of the drawings showing its embodiments. FIGS. 1A to 1C are the trihedral views showing the configuration of the operating device according to the first embodiment of the present invention. FIG. 1A shows the plan view, FIG. 1B shows the side view, and FIG. 1C shows the rear view. FIG. 2 is the sectional view showing the inner configuration of the operating device according to the first embodiment of the present invention and shows the inner configuration in which a part of the left half is broken on the rear view equal to FIG.

1C. FIGS. 3A and 3B and FIGS. 4A and 4B are the side views showing the configuration of the operating device according to the first embodiment of the present invention and shows the situation in which the parts configuring the operating device on the side view equal to FIG. 1B are removed in the order from FIG. 3A TO 4B. The operating device according to this embodiment is arranged on, for example, the instrument panel near the driver seat in the vehicle, and operates the air conditioner or the audio apparatus or the like.

On the drawings, 1 is the outer portion of the instrument panel in the vehicle, and the operating device according to this embodiment has the appearance in which a mode switching switch 10 and a dial switch 20 are stacked on the outer portion 1. The mode switching switch 10 has the shape of a substantially oval plate on the plan view, and this is placed on the outer portion 1 and can be rotationally operated within a range of about 60° by a user. The dial switch 20 is cylindrical and placed on the upper side of the mode switching switch 10. The user can rotationally operate it in a range of 360° or more, clockwise and counter-clockwise around the fixed shaft 30, which is fixed so as not to be rotated. By the way, the rotation axis of the dial switch 20 and the rotation axis of the mode switching switch 10 coincide with each other, and the rotation axis coincides with the central axis of the fixed shaft 30.

On the outer portion 1, the three mode marks 2 to 4 are drawn, and the mode can be switched by rotationally operating the mode switching switch 10 so that a tapered tip portion 10*a* of the mode switching switch 10 indicates one of the three mode marks 2 to 4. For example, when the operating device is the apparatus for operating the air conditioner, a character string "Wind Direction" is assigned as the mode mark 2, a character string "Wind Quantity" is assigned as the mode mark 3, and a character string "Temperature" is assigned as the mode mark 4. When the tip portion 10*a* of the mode switching switch 10 is rotated to indicate "Wind Direction", the operating device becomes in a wind direction adjustment mode. Then, the user, when rotationally operating the dial switch 20, can adjust the wind direction of the air conditioner. The other modes are similar.

The mode switching switch 10, the dial switch 20, the fixed shaft 30 and the other parts in the operating device according to this embodiment are assembled and placed on a substrate 50. A rotary encoder 51 (rotation detecting means) for detecting the rotation of the dial switch 20 and a switching detection element 52 (position detecting means) for detecting the switching between the modes, which results from the rotation of the mode switching switch 10, are placed together with the other electric parts (not shown) on the substrate 50. The substrate 50 is designed such that the rotary encoder 51, the switching detection element 52 and the other electric parts configure an electric circuit, the operation of the user given to the operating device is converted into an electric signal, and various processes can be carried out.

The rotary encoder 51 is cylindrical and fixedly connected to the substrate 50 through screws, soldering and the like, mechanically and electrically. The fixed shaft 30 is designed such that a disc unit 31 whose diameter is great and a cylinder unit 32 whose diameter is small are coaxially linked. One end on the side of the disc unit 31 is externally exposed, and the other end on the side of the cylinder unit 32 is fixed through the cylinder of the rotary encoder 51 to the substrate 50. However, although the rotary encoder 51 has a cylindrical rotator 51*a* for detecting the rotation, the cylinder unit 32 of the fixed shaft 30 is configured not to be brought into contact with the inner circumferential surface of the rotator 51*a*, and the cylinder unit 32 does not interfere the rotation of the rotator 51*a*.

The dial switch 20 comprises: an operating unit 21 (second rotation operating body) that is externally exposed in order for the user to touch and operate it; a linkage unit 22 (shaft) for linking the operating unit 21 to the rotator 51*a* of the rotary encoder 51. The operating unit 21 and the linkage unit 22 are manufactured as the different parts, and after assembled, they function as one dial switch 20. The operating unit 21 has a great diametric portion 21*a* and a small diametric portion 21*b*. The great diametric portion 21*a* is defined as an inner diameter that is slightly greater than the diameter of the disc unit 31 of the fixed shaft 30. The small diametric portion 21*b* is defined as an inner diameter that is slightly greater than the diameter of the cylinder unit 32 of the fixed shaft 30. Also, the length of the small diametric portion 21*b* of the operating unit 21 is shorter than the length of the cylinder unit 32 of the fixed shaft 30. Thus, in the situation that the disc unit 31 of the fixed shaft 30 is accommodated in the great diametric portion 21*a* of the operating unit 21, the cylinder unit 32 of the fixed shaft 30 can be inserted through the small diametric portion 21*b* of the operating unit 21.

The linkage unit 22 is the cylinder having an inner diameter that is slightly greater than the diameter of the cylinder unit 32 of the fixed shaft 30, and one end of the linkage unit 22 can be interiorly engaged with and fixed to the small diametric portion 21*b* of the operating unit 21. For this reason, an engaging nail 22*a* is provided on the outer circumferential surface on one end side of the linkage unit 22, and a concave engaged with the engaging nail 22*a* is formed on the inner circumferential surface of the small diametric portion 21*b* of the operating unit 21. Also, the other end of the linkage unit 22 is shaped to be able to be externally engaged with and fixed to the rotator 51*a* of the rotary encoder 51. Thus, in the situation that the operating unit 21 is fixed to one end of the linkage unit 22 and then the rotator 51*a* of the rotary encoder 51 is fixed to the other end thereof, the rotator 51*a* is rotated in association with the rotational operation of the operating unit 21 by the user, and the rotary encoder 51 can detect the rotation of the operating unit 21. Also, the fixed shaft 30 is inserted through the operating unit 21 and the linkage unit 22 in the dial switch 20 and inserted through the rotary encoder 51 and fixed to the substrate 50.

Also, an annular metallic spring member 40 is externally engaged with and fixed to the linkage unit 22 of the dial switch 20. With respect to the axial direction of the linkage unit 22, the length of the spring member 40 is sufficiently shorter than the length of the linkage unit 22. The fixed position of the spring member 40 in the linkage unit 22 is located between one end portion interiorly engaged with the operating unit 21 of the dial switch 20 and the other end portion externally engaged with the rotary encoder 51. The spring member 40 has: an annular unit 41 externally engaged with the linkage unit; and a plate spring 42 (engaged unit) formed to protrude from the outer circumference of the annular unit 41 to a radial direction. By the way, only one plate spring 42 is shown on the drawings. However, actually, the spring member 40 has the two plate springs 42. The two plate springs 42 are formed at the opposite positions with respect to the center of the annular unit 41, respectively. The plate spring 42 is designed such that a part of the metallic annular unit 41 is protruded to the exterior by a metallic process and this is biased to outside the annular unit 41.

Figure 5:
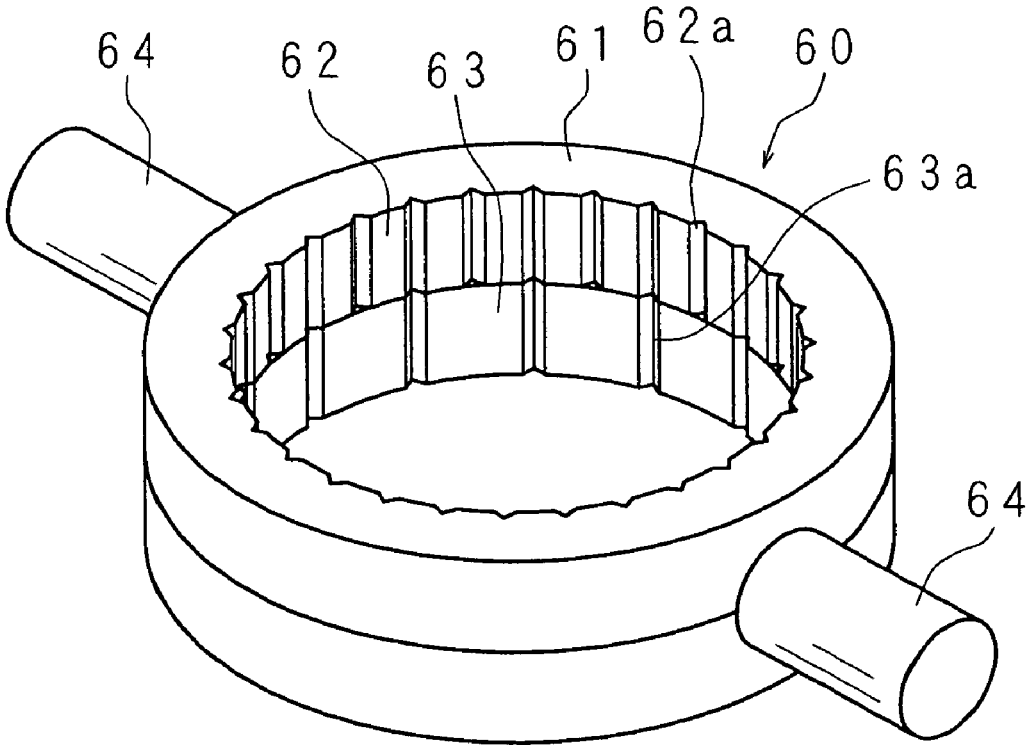
FIG. 5 is a diagrammatic perspective view showing a configuration of a click number change member of the operating device according to the first embodiment of the present invention.

Also, the operating device according to the first embodiment comprises a click number change member 60 (moving body) that is cylindrical, which enables the insertion of the linkage unit 22 of the dial switch 20. FIG. 5 is the diagrammatic perspective view showing the configuration of the click number change member 60 in the operating device according to the first embodiment of the present invention. The click number change member 60 has a cylinder unit 61 and two support shafts 64 (inserted unit), which are provided so as to protrude in the radial direction from the outer circumferential surface of the cylinder unit 61. On the inner circumferential surface of the cylinder unit 61, a first click surface 62 (engaging unit) is formed on one side with the substantial center of the axial direction as a boundary, and a second click surface 63 (engaging unit) is formed on the other side.

The first click surface 62 and the second click surface 63 are designed such that a plurality of concaves 62*a*, 63*a* or convexes are formed at predetermined intervals in the circumferential directions of the inner circumference of the cylinder unit 61, and these concaves or convexes are shaped to be engaged with the plate spring 42 formed on the spring member 40. For example, 36 concaves or convexes are formed on the first click surface 62, and 18 concaves or convexes are formed on the second click surface 63. Also, with regard to the axial direction of the cylinder unit 61, the lengths of the first click surface 62 and the second click surface 63 are set to be sufficiently longer than the length of the plate spring 42 of the spring member 40, and the plate spring 42 can be engaged with only one of the first click surface 62 and the second click surface 63.

Also, the inner diameter of the cylinder unit 61 in the click number change member 60 is set to be slightly thicker than the diameter of the linkage unit 22 in the dial switch 20. When the linkage unit 22 to which the spring member 40 is fixed is inserted into the cylinder unit 61, the two plate springs 42 formed on both sides of the spring member 40 are engaged with the first click surface 62 or second click surface 63 of the cylinder unit 61. In this state, the click number change member 60 is fixed so as not to be able to be rotated. Thus, when the dial switch 20 is rotationally operated to rotate the linkage unit 22, the plate springs 42 of the spring member 40 fixed to the linkage unit 22 are sequentially engaged with the plurality of concaves or convexes on the first click surface 62 or second click surface 63, which are arranged in the circumferential direction of the click number change member 60, in association with the rotation, and the click feeling can be generated. By the way, the click feeling includes the clicking noise [click-clack] generated in association with the engagement between the plate spring 42 and the concave or convex of the click surface, and the vibration generated at this time, and the like.

Moreover, the number of the concaves or convexes of the first click surface 62 and the number of the concaves or convexes of the second click surface 63 are configured to be different. Thus, by changing the click surface to engage the plate spring 42 of the spring member 40, it is possible to change the generation frequency of the click feelings when the dial switch 20 is rotationally operated. It is possible to change the click surface to engage the plate spring 42 of the spring member 40, by axially moving the click number change member 60 into which the linkage unit 22 of the dial switch 20 is inserted, because the first click surface 62 and the second click surface 63 are aligned in the axial direction on the inner circumferential surface of the cylinder unit 61.

Two support shafts 64, which are round-bar-shaped and protrude in the directions opposite to each other with the axis of the cylinder unit 61 as a center, are provided on the outer circumferential surface of the cylinder unit 61 in the click number change member 60. Also, the operating device according to this embodiment comprises a base cylinder 70 for supporting the click number change member 60, the mode switching switch 10 and the like. The base cylinder 70 is cylindrical and has the size and the shape, which enable the linkage unit 22 in the dial switch 20, the cylinder unit 61 in the click number change member 60, the rotary encoder 51 and the like to be accommodated therein which enable the linkage unit 22 in the dial switch 20, the cylinder unit 61 in the click number change member 60, the rotary encoder 51 and the like to be accommodated therein.

In the base cylinder 70, on one end side, two notches 71 (however, only one is shown on the drawing) that are long in the axial direction are formed and immovably fixed to the substrate 50 on the other end side. The two notches 71 on the one end side are formed on the sides opposite to each other, with the axial center of the base cylinder 70 therebetween. The width of each of the notches 71 is set to be approximately equal to or slightly wider than the diameter of the support shaft 64 of the click number change member 60, and the support shaft 64 can be inserted into the notch 71, and the support shaft 64 can be moved through the notch 71 in the axial direction of the base cylinder 70.

Also, the inner diameter on one end side of the base cylinder 70 is slightly thicker than the outer diameter of the click number change member 60, and the outer diameter is sufficiently smaller than the distance between the center of the click number change member 60 and the protrusion end of the support shaft 64. Since the two support shafts 64 of the click number change member 60 inserted into the linkage unit 22 of the dial switch 20 are inserted into the two notches 71 of the base cylinder 70, the click number change member 60 can be moved in the axial direction along the notch 71 and supported by the base cylinder 70 in the manner that it cannot be rotated. In this state, the two support shafts 64 of the click number change member 60 are in the state that they are inserted through the notch 71 and protruded to outside the base cylinder 70.

Also, one notch 72 is formed on the other end side fixed to the substrate 50 of the base cylinder 70. The switching detection element 52 fixed to the substrate 50 through the screws and the soldering and the like is placed so as to be accommodated in the notch 72 of the base cylinder 70 fixed to the substrate 50. The switching detection element 52 has a detection shaft 52*a* (operated unit) that is bar-shaped and swingably supported on the main body that has the shape of an approximately rectangular plate. The switching detection element 52 carries out the detection of the switching, by detecting the position where the detection shaft 52*a* is located, from the three positions of: the standard position to which the detection shaft 52*a* is biased by the member, such as the spring and the like, which is built in the main body; and the endmost positions on both sides when the detection shaft 52*a* is swung with this standard position as a center.

The mode switching switch 10 has: an operating unit 11 (first rotation operating body), which has the shape of an approximately oval plate and is configured in order for the user to touch it and carry out the operation; and a cylinder unit 12 (cylinder) that is connected on the lower surface of this operating unit 11. In the operating unit 11, an approximately circular penetration hole is formed, and the penetration hole has a size such that the small diametric portion 21*b* of the operating unit 21 in the dial switch 20 can be inserted and the center thereof substantially coincides with the rotation axis of the mode switching switch 10. Also, the cylinder unit 12 is connected to the operating unit 11 so that the axial center substantially coincides with the center of the penetration hole of the operating unit 11, and the inner diameter is approximately equal to the outer diameter of one end side of the base cylinder 70, and the cylinder unit 11 of the mode switching switch 10 is externally engaged with the base cylinder 70.

The approximately rectangular notch 13 is formed in the end of the cylinder unit 12 in the mode switching switch 10. When the cylinder unit 12 is externally engaged with the base cylinder 70 fixed to the substrate 50, the detection shaft 52*a* of the switching detection element 52 provided on the substrate 50 is accommodated inside the notch 13 of the cylinder unit 12. Consequently, when the operating unit 11 of the mode switching switch 10 is rotationally operated by the user, the cylinder unit 12 is rotated together with the operating unit 11, and the cylinder unit 12 is brought into contact with the detection shaft 52*a* of the switching detection element 52 and swung. Then, the switching detection element 52 detects the switching between the modes that is executed by the mode switching switch 10.

The notch 14 that is long in the axial direction of the cylinder unit 12 is formed at the end of the cylinder unit 12 in the mode switching switch 10, and a guide groove 15, which is connected to the notch 14 and long in the circumferential direction of the cylinder unit 12 and has the shape of a long hole, is formed on the substantial center in the axial direction of the cylinder unit 12. However, the guide groove 15 having the shape of the long hole is formed such that, although the portion between one end 15*a* and a center 15*b* is formed along the circumferential direction of the cylinder unit 12, the portion of the substantial center is slightly bent, and the portion between the center 15*b* and the other end 15*c* is gradually displaced in the axial direction to the side of the operating unit 11. Also, the notch 14 and the guide groove 15 are formed on both sides, respectively, with the axial center of the cylinder unit 12 therebetween, and the two guide grooves 15 are approximately equal in shape. The widths of the notch 14 and the guide grooves 15 are equal to or slightly greater than the diameter of the support shaft 64 provided in the click number change member 60.

As mentioned above, in the situation that the two support shafts 64 of the click number change member 60 are supported by the two notches 71 of the base cylinder 70, the two support shafts 64 are inserted through the notches 71 of the base cylinder 70 and externally protruded. When in this state, the cylinder unit 12 of the mode switching switch 10 is externally engaged with the base cylinder 70, the cylinder unit 12 can be externally engaged by guiding the two support shafts 64, which protrude from the base cylinder 70, to the guide groove 15 along the two notches 14 formed on the cylinder unit 12.

Also, as mentioned above, the click number change member 60 supported by the base cylinder 70 can be moved in the axial direction of the base cylinder 70, along the notch 71 of the base cylinder 70. When the user rotationally operates the mode switching switch 10 in which the cylinder unit 12 is externally engaged with the base cylinder 70, only the mode switching switch 10 is rotated because the base cylinder 70 and the click number change member 60 are fixed in the manner that they cannot be rotated. At this time, the support shaft 64 of the click number change member 60 is inserted inside the guide groove 15 formed on the cylinder unit 12 in the mode switching switch 10, and the insertion position into the guide groove 15 is changed in association with the rotation of the cylinder unit 12. Thus, the support shaft 64 is moved in the axial direction of the base cylinder 70 in association with the rotation of the cylinder unit 12. Hence, with the rotation of the mode switching switch 10, the click number change member 60 can be moved in the axial direction, and the click surface of the click number change member 60 with which the plate spring 42 of the spring member 40 fixed to the dial switch 20 is engaged can be changed, thereby changing the click feeling (click number) corresponding to the mode.

Figure 6A:
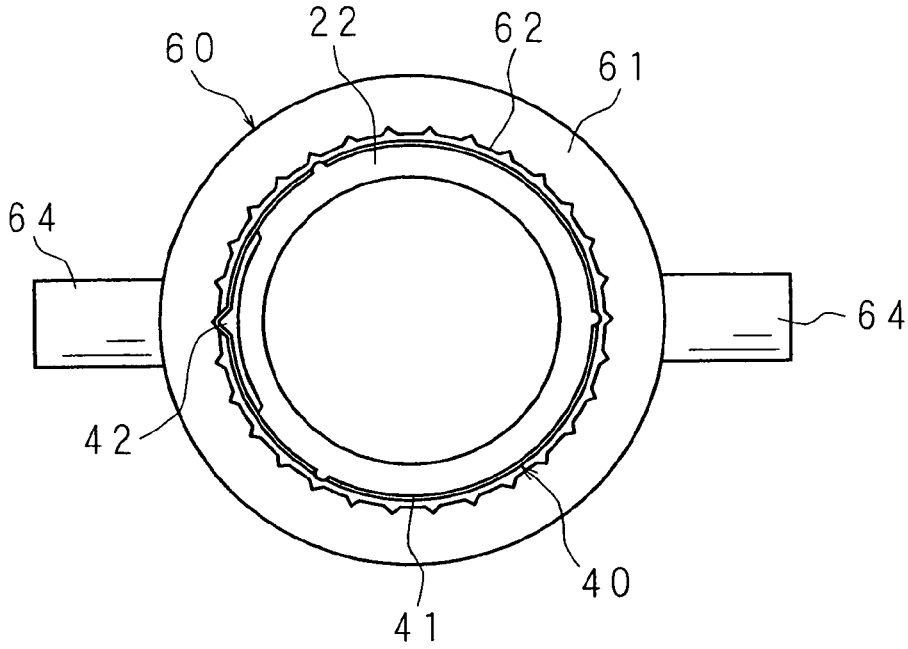
FIGS. 6A and 6B are diagrammatic views describing a change in a click number in the operating device according to the first embodiment of the present invention.
Figure 6B:
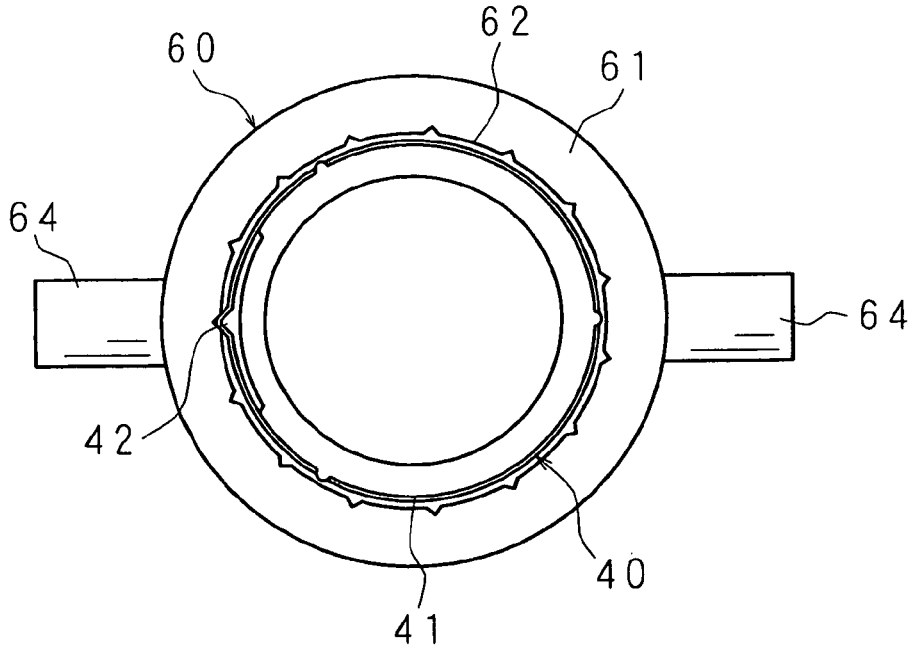

FIGS. 6A and 6B are the diagrammatic views describing the change in the click number of the operating device according to the first embodiment of the present invention. For example, in the configuration of the illustrated operating device, at first, when the mode switching switch 10 is positioned at the mode mark 3 (namely, the central position), the support shaft 64 of the click number change member 60 is located at the center 15*b* of the guide groove 15 provided in the cylinder unit 12 of the mode switching switch 10. At this time, the click number change member 60 is located on the lower side of the movement range in the axial direction (the side of the substrate 50 in the axial direction is defined as the lower side, and the side of the operating unit 21 of the dial switch 20 is defined as the upper side). Then, the plate spring 42 of the spring member 40 fixed to the linkage unit 22 of the dial switch 20 is engaged with the first click surface 62 on the lower side, among the two click surfaces formed on the inner circumferential surface of the cylinder unit 61 in the click number change member 60. On the first click surface 62, the 36 concaves or convexes are formed at the equal interval in the circumferential direction of the cylinder unit 61. Thus, when the user rotationally operates the dial switch 20, the 36 click feelings per circumference are generated (refer to FIG. 6A). Thus, when the user rotationally operates the dial switch 20, the 36 click feelings per circumference are generated (refer to FIG. 6(*a*)).

When the mode switching switch 10 is counterclockwise rotationally operated to the position of the mode mark 4, the cylinder unit 12 provided in the mode switching switch 10 is rotated to the position where the support shaft 64 of the click number change member 60 is inserted into one end 15*a* of the guide groove 15. The one end 15*a* and center 15*b* of the guide groove 15 are provided at the same position with regard to the axial direction of the cylinder unit 12. Thus, the click number change member 60 is not moved, and the plate spring 42 of the spring member 40 is engaged with the first click surface 62.

When the mode switching switch 10 is clockwise rotationally operated to the position of the mode mark 2, the cylinder unit 12 provided in the mode switching switch 10 is rotated to the position where the support shaft 64 of the click number change member 60 is inserted into the other end 15*c* of the guide groove 15. The guide groove 15 is shaped to be gradually displaced in the axial direction so that it is bent at the center 15*b*, and the other end 15*c* is located on the upper side. The other end 15*c* of the guide groove 15 is located on the upper side than the one end 15*a* and the center 15*b* with respect to the axial direction. In association with the rotation of the cylinder unit 12, the support shaft 64 is moved to the upper side until the other end 15*c* of the guide groove 15. Thus, the click number change member 60 is moved to the upper side along the notch 71 of the base cylinder 70, and the plate spring 42 of the spring member 40 is engaged with the second click surface 63 formed on the upper side of the inner circumferential surface of the click number change member 60. On the second click surface 63, the 18 concaves or convexes are formed at the equal interval in the circumferential direction of the cylinder unit 61. Hence, when the user rotationally operates the dial switch 20, the 18 click feelings per circumference are generated (refer to FIG. 6B).

The operating device having the foregoing configuration is configured such that the mode switching switch 10 and the dial switch 20 are coaxially stacked. Thus, since the operating device can be miniaturized, this can be easily placed in the limited space such as the instrument panel of the vehicle.

Also, this is configured such that the mode is switched by the mode switching switch 10, and the operation such as the setting or adjustment or the like of each mode is carried out in the dial switch 20. Thus, one operating device can operate the plurality of functions. Also, the engagement between the spring member 40 provided in the dial switch 20 and the click surface formed on the inner circumferential surface of the click number change member 60 generates the click feeling, and the plurality of click surfaces are formed on the inner circumferential surface of the click number change member 60, and in association with the rotation of the mode switching switch 10, the click number change member 60 is moved in the axial direction. Thus, since the click surface with which the spring member 40 is engaged can be changed by the rotation of the mode switching switch 10, the click feeling that is different for each mode can be generated easily and surely, in association with the rotation of the dial switch 20. Also, the rotary encoder 51 for detecting the rotation of the dial switch 20 is configured to be placed on the substrate 50 coaxially with the dial switch 20. Hence, the operating device can be miniaturized.

By the way, this embodiment is configured such that the change between the three modes can be carried out by the mode switching switch 10. However, this is not limited thereto. The change between the two modes or the four or more modes may be carried out. Also, this is configured such that at the two modes among the three modes, the 36 click feelings are generated for each rotation of the dial switch 20, and at the one mode, the 18 click feelings are generated for each rotation. However, this is not limited thereto. The generation number (click number) of the click feelings may be arbitrary for each rotation of the dial switch 20, and the click number can be easily set only by changing the shape (the number of the concaves or concaves) of the click surface provided on the inner circumference of the cylinder unit 61 in the click number change member 60. Also, when the click number is changed to the three stages or more, the three or more click surfaces may be aligned in the axial direction on the cylinder unit 61 in the click number change member 60, and the shape of the guide groove 15 in the mode switching switch 10 may be properly changed.

Second Embodiment

Figure 7:
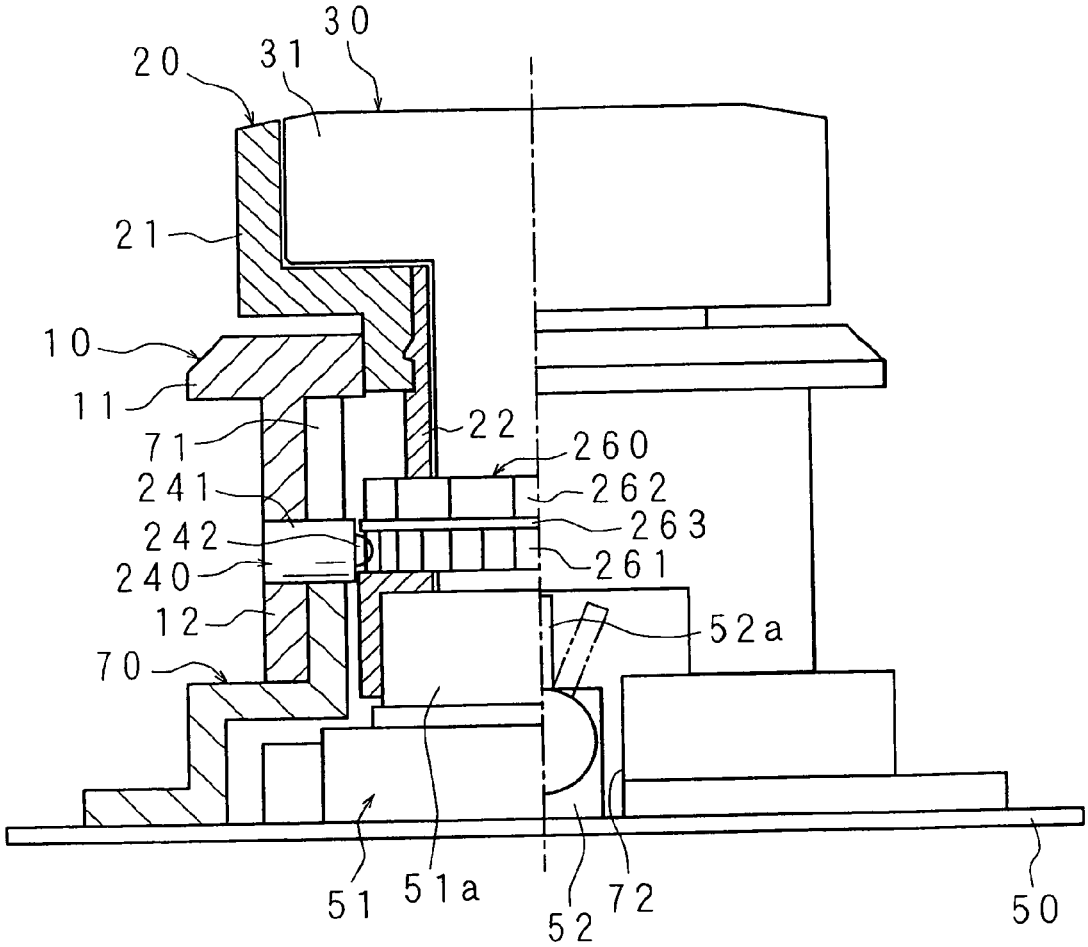
FIG. 7 is a sectional view showing an inner configuration of an operating device according to a second embodiment describing a change of a click number in the operating device according to the second embodiment of the present invention.
Figure 8A:
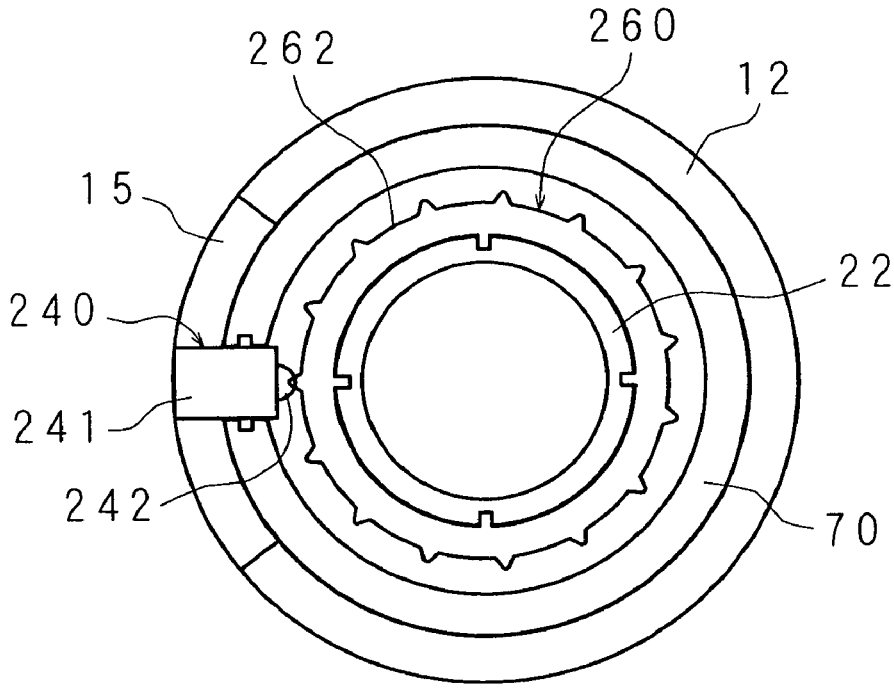
FIGS. 8A and 8B are diagrammatic views describing a change of a click number in the operating device according to the second embodiment of the present invention.
Figure 8B:
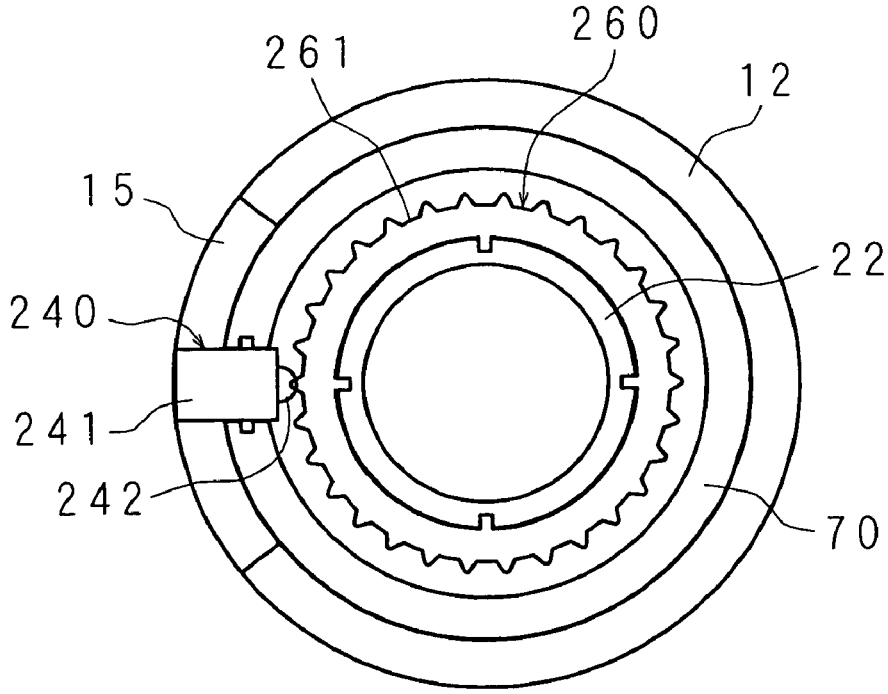

The operating device according to the first embodiment is configured such that a plurality of click surfaces are provided on the click number change member 60 which is moved in the axial direction in association with the rotation of the mode switching switch 10, and the spring member 40 which is engaged with this is provided in the dial switch 20. On the contrary, the operating device according to the second embodiment is configured such that a plurality of click surfaces are provided on the dial switch 20, and the elastic engaged unit engaged with this is moved in the axial direction in association with the rotation of the mode switching switch 10. FIG. 7 is the sectional view showing the inner configuration of the operating device according to the second embodiment of the present invention. Also, FIGS. 8A and 8B are the diagrammatic views describing the change in the click number of the operating device according to the second embodiment of the present invention.

The operating device according to the second embodiment comprises a cylindrical click number change member 260 that is externally engaged with the linkage unit 22 of the dial switch 20. The click number change member 260 is fixed to the linkage unit 22 and rotated in association with the rotation of the dial switch 20. Also, on the outer circumferential surface of the click number change member 260, with the substantial center in the axial direction as a boundary, a first click surface 261 (engaging unit) is formed on one side, and a second click surface 262 (engaging unit) is formed on the other side. The first click surface 261 and the second click surface 262 are configured such that a plurality of concaves and convexes are formed at a predetermined interval in the circumferential direction. On the boundary between the first click surface 261 and the second click surface 262, a protrusion 263 is formed over one circumference of the click number change member 260.

Also, on the base cylinder 70, a cylindrical engaged member 240 (moving body) is held so as to be able to move in the axial direction of the base cylinder 70 inside the notch 71. The engaged member 240 has: a cylinder unit 241 (inserted unit) constituting a main body portion; and a sphere 242 (engaged unit) that protrudes from one end surface of this cylinder unit 241 and is biased towards and engaged with the click surface of the click number change member 260 by the elastic member such as a spring and the like. The sphere 242 is accommodated in an accommodation hole (not shown) formed on one end surface of the cylinder unit 241 so as to move in and out and biased towards the outside of the accommodation hole by the elastic material provided inside the accommodation hole. Also, the other end of the cylinder unit 241 protrudes to the outside of the base cylinder 70 and is inserted into the guide groove 15 formed on the cylinder unit 12 in the mode switching switch 10. Consequently, as for the engaged member 240, the insertion position into the guide groove 15 is changed in association with the rotation of the mode switching switch 10, and this is moved in the axial direction of the base cylinder 70 along the notch 71 of the base cylinder 70.

For example, in the configuration of the illustrated operating device, at first, when the mode switching switch 10 is located at the position of the mode mark 3 (namely, the central position), the cylinder unit 241 of the engaged member 240 is located at the center 15*b* of the guide groove 15 provided on the cylinder unit 12 in the mode switching switch 10. At this time, the engaged member 240 is located on the lower side of the movement range in the axial direction and engaged with the first click surface 261 of the click number change member 260 fixed to the linkage unit 22 of the dial switch 20. The 36 concaves or convexes are formed in the first click surface 261, and when the user rotationally operates the dial switch 20, the 36 click feelings are generated for each rotation (refer to FIG. 8B).

Next, when the mode switching switch 10 is counterclockwise rotationally operated to the position of the mode mark 4, the cylinder unit 12 provided in the mode switching switch 10 is rotated to the position where the cylinder unit 241 of the engaged member 240 is inserted into the one end 15*a* of the guide groove 15. The one end 15*a* and the center 15*b* of the guide groove 15 are provided at the same position with respect to the axial direction of the cylinder unit 12. Thus, the engaged member 240 is not moved, and is engaged with the first click surface 261.

Moreover, when the mode switching switch 10 is clockwise rotationally operated to the position of the mode mark 2, the cylinder unit 12 provided in the mode switching switch 10 is rotated to the position where the cylinder unit 241 of the engaged member 240 is inserted into the other end 15*c* of the guide groove 15. The guide groove 15 is shaped to be gradually displaced in the axial direction so that it is bent at the center 15*b*, and the other end 15*c* is located on the upper side. Thus, in association with the rotation of the cylinder unit 12, the cylinder unit 241 of the engaged member 240 is moved along the guide groove 15 in the axial direction of the base cylinder 70. At this time, the sphere 242 of the engaged member 240 is brought into contact with and engaged with the protrusion 263 of the click number change member 260. Thus, the click feeling is generated. After that, the sphere 242 of the engaged member 240 is engaged with the second click surface 262. The 18 concaves or convexes are formed on the second click surface 262. Then, when the user rotationally operates the dial switch 20, the 18 click feelings per rotation are generated (refer to FIG. 8A).

The operating device according to the second embodiment having the foregoing configuration has the actions and effects similar to the operating device according to the first embodiment. When the mode switching switch 10 is rotationally operated to switch the mode, it is possible to change the click feeling generated by the rotational operation of the dial switch 20. Also, since the protrusion 263 is configured to be provided on the boundary portion between the first click surface 261 and the second click surface 262 in the click number change member 260, the click feeling can be generated even when the mode switching switch 10 is rotationally operated.

By the way, the second embodiment is configured such that the change between the three modes can be carried out by the mode switching switch 10. However, this is not limited thereto. The change between the two modes or the four or more modes may be carried out. Also, the generation number (click number) of the click feelings may be arbitrary for each rotation of the dial switch 20, and the click number can be easily set only by changing the shape (the number of the concaves or concaves) of the click surface provided on the outer circumference of the click number change member 260. Also, when the click number is changed to the three stages or more, the three or more click surfaces may be aligned in the axial direction, on the outer circumferential surface of the click number change member 260, and the shape of the guide groove 15 in the mode switching switch 10 may be properly changed. Also, the protrusion 263 is configured to be provided between the first click surface 261 and the second click surface 262. However, when there is no need of generating the click feeling in association with the rotational operation of the mode switching switch 10, the protrusion 263 may not be provided.

By the way, the other configurations of the operating device according to the second embodiment are similar to the configurations of the operating device according to the first embodiment. Thus, the same symbols are assigned to the similar portions, and their detailed explanations are omitted.

Third Embodiment

Figure 9:
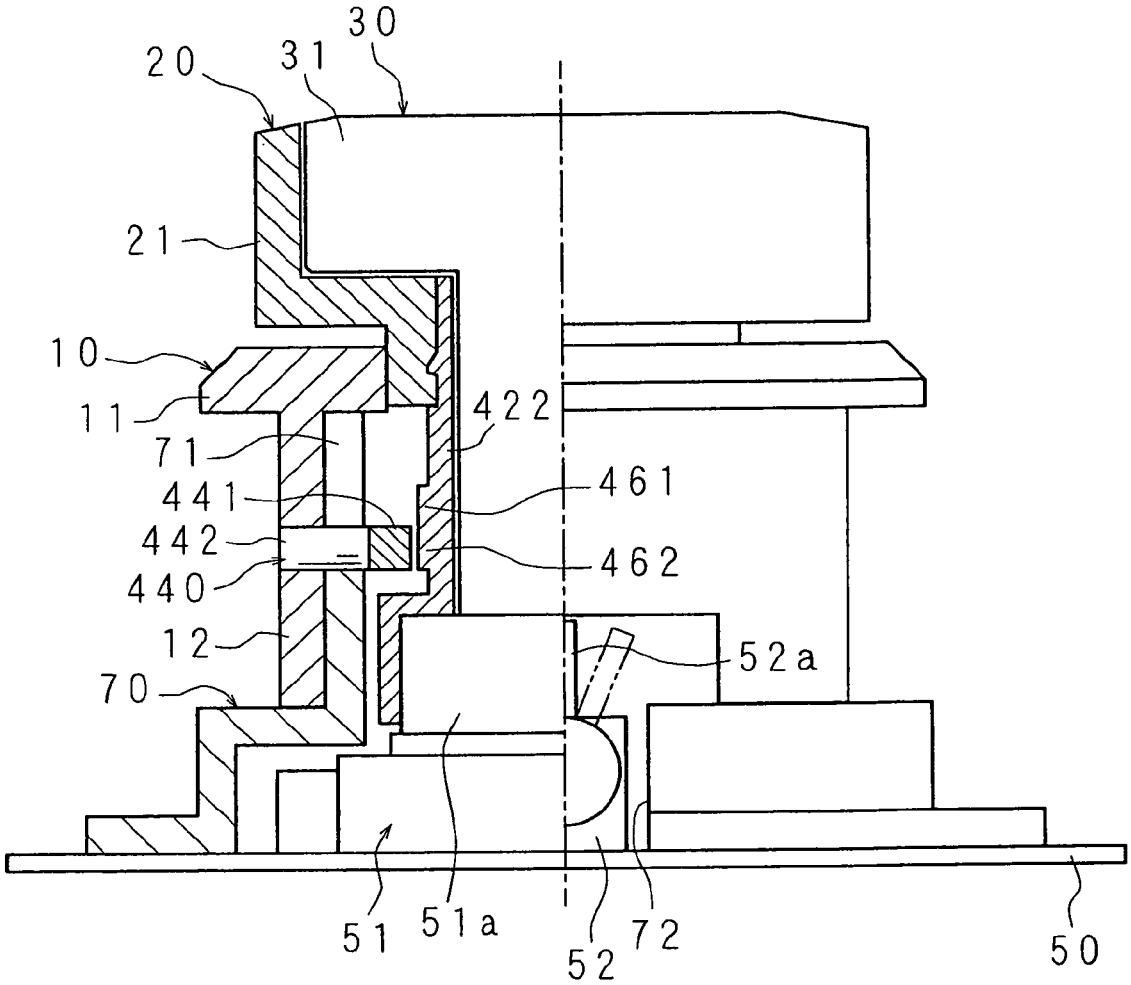
FIG. 9 is a sectional view showing an inner configuration of an operating device according to a third embodiment of the present invention.
Figure 10A:
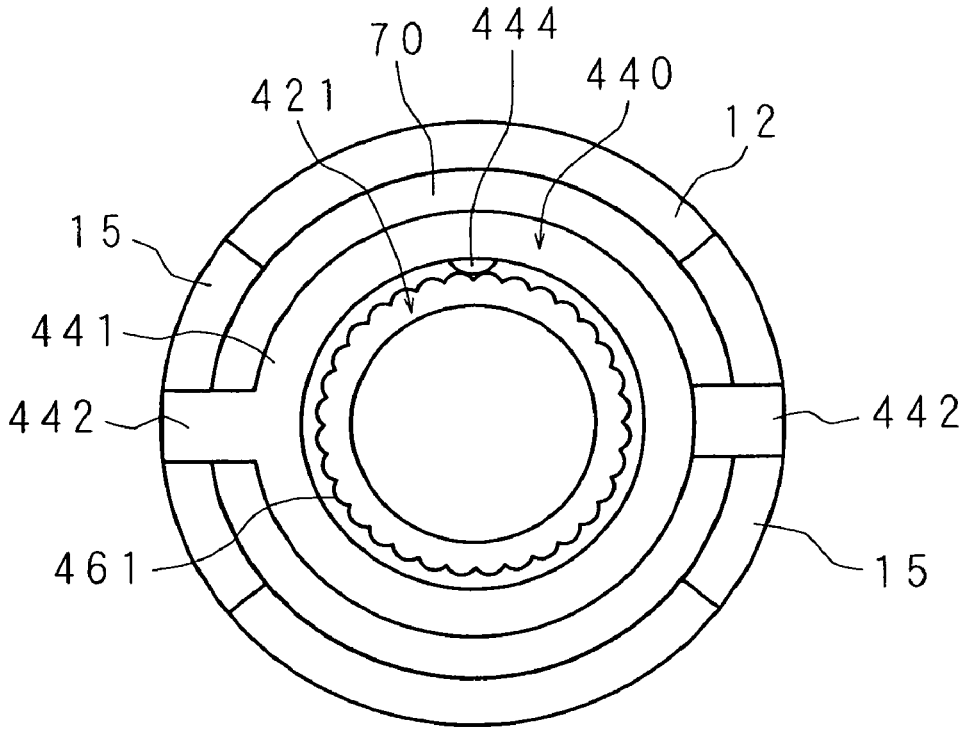
FIGS. 10A and 10B are diagrammatic views describing a change of a click number in the operating device according to the third embodiment of the present invention.
Figure 10B:
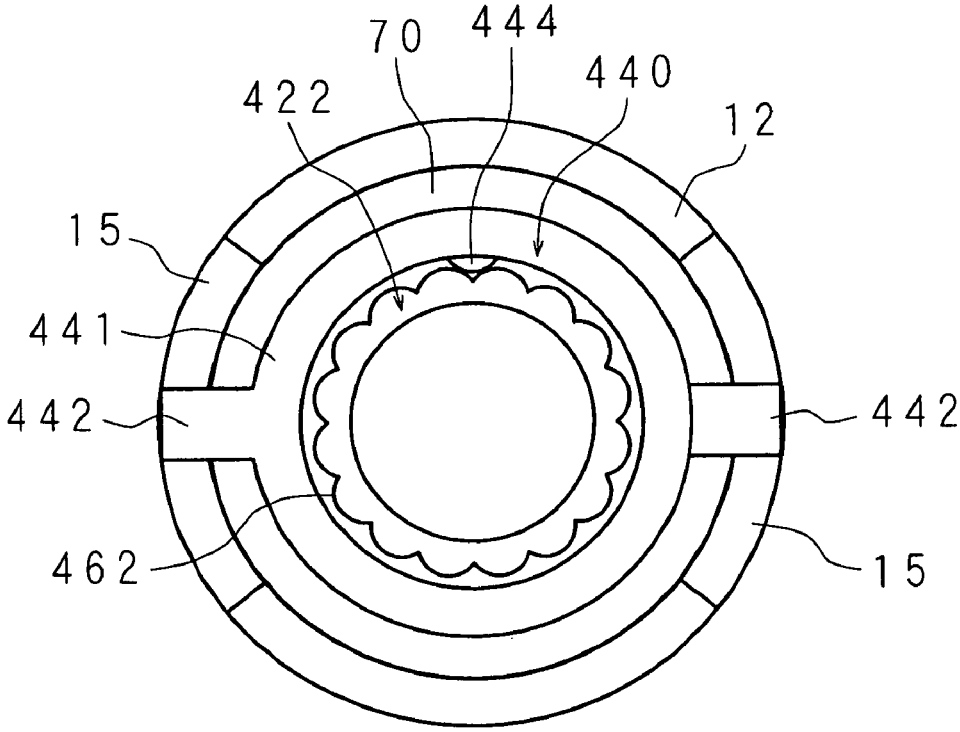
Figure 11:
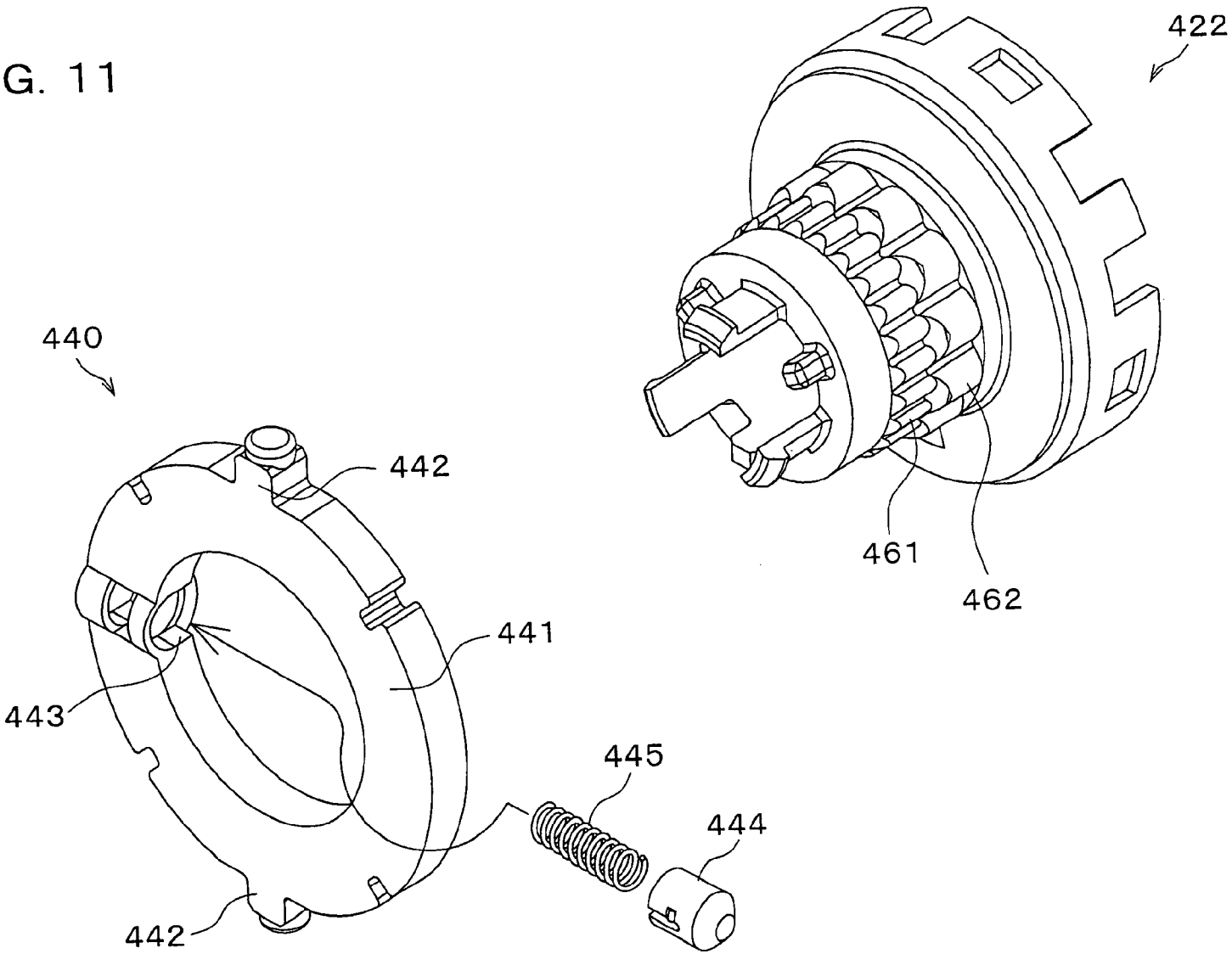
FIG. 11 is a perspective view showing a configuration of a linkage unit and an engaged member in the operating device according to the third embodiment of the present invention.
Figure 12:
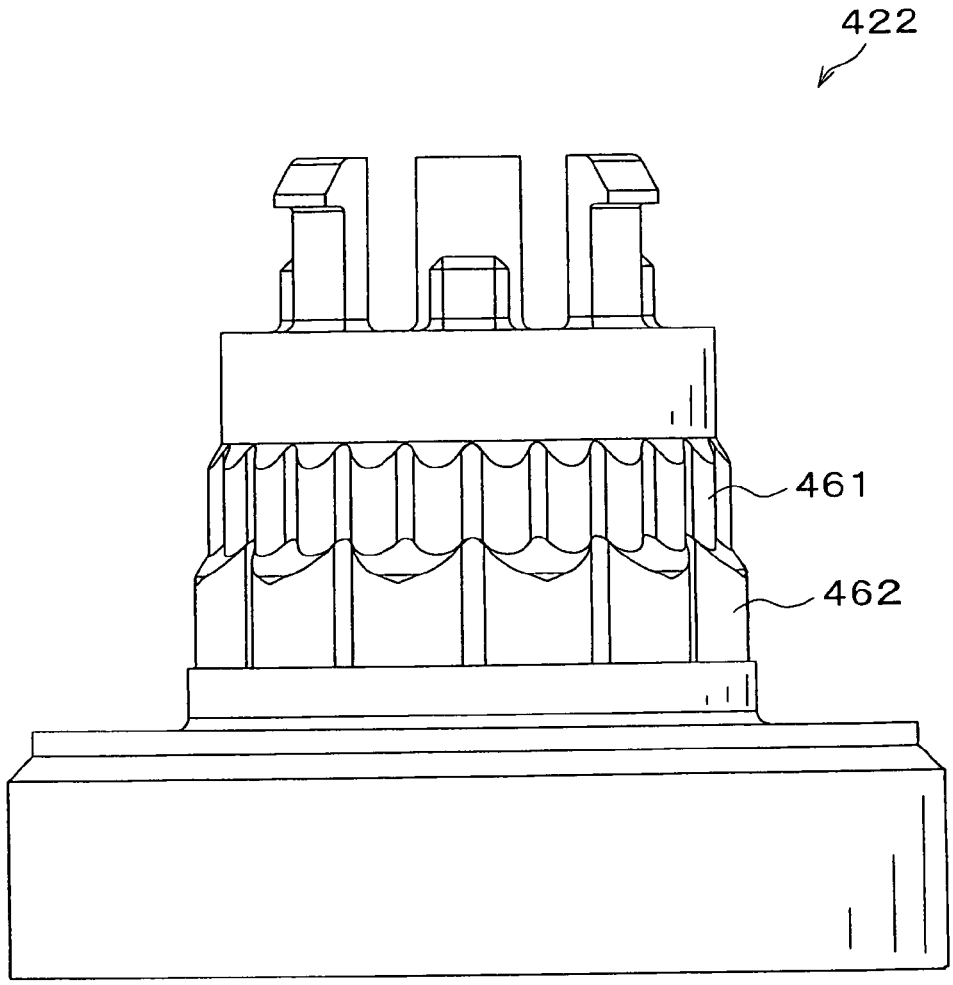
FIG. 12 is a side view showing the configuration of the linkage unit of the operating device according to the third embodiment of the present invention.

FIG. 9 is the sectional view showing the inner configuration of the operating device according to the third embodiment of the present invention. Also, FIGS. 10A and 10B are the diagrammatic views describing the change in the click number of the operating device according to the third embodiment of the present invention. Although the operating device according to the second embodiment is configured to fix the click number change member 260 of the different member to the linkage unit 22 in the dial switch 20, the operating device according to the third embodiment is configured such that a first click surface 461 (engaging unit) and a second click surface 462 (engaging unit) are formed on the outer circumferential surface of a linkage unit 422 (shaft) in the dial switch 20. Also, although the operating device according to the second embodiment is configured to comprise the cylindrical engaged member 240 that is engaged with the first click surface 261 or second click surface 262, the operating device according to the third embodiment is configured to comprise a cylindrical (or annular) engaged member 440 (moving body). FIG. 11 is the perspective view showing the configurations of the linkage unit 422 and the engaged member 440 in the operating device according to the third embodiment of the present invention. Also, FIG. 12 is the side view showing the configuration of the linkage unit 422 in the operating device according to the third embodiment of the present invention.

On the outer circumferential surface of the linkage unit 422 in the dial switch 20 that is comprised by the operating device according to the third embodiment, the first click surface 461 and the second click surface 462 are formed, in each of which a plurality of concaves or convexes are placed at a predetermined interval over one circumference. The number of the concaves or convexes of the first click surface 461 is greater than the number of the concaves or convexes of the second click surface 462. The first click surface 461 and the second click surface 462 are aligned in the axial direction of the linkage unit 422. The linkage unit 422, and the first click surface 461 and the second click surface 462 are integrally formed through the integrated molding using synthesis resin. FIG. 9 and FIG. 11 show the configuration in which the first click surface 461 is placed on the upper side, and the second click surface 462 is placed on the lower side.

Also, the engaged member 440 of the operating device according to the third embodiment has: a cylinder unit 441; and two support shafts 442 (inserted unit) provided so as to protrude from the outer circumferential surface of the cylinder unit 441 in the radial direction. The two support shafts 442 are provided at the positions opposite to each other, on the outer circumferential surface of the cylinder unit 441. The outer diameter of the cylinder unit 441 in the engaged member 440 is slightly thinner than the inner diameter of the base cylinder 70. The support shaft 442 of the engaged member 440 has the size and the shape, which enable the insertion into the notch 71 formed in the base cylinder 70. Thus, by inserting the cylinder unit 441 of the engaged member 440 into the base cylinder 70 and inserting the support shaft 442 into the notch 71, the engaged member 440 can be movably accommodated in the base cylinder 70 along the notch 71.

Also, the support shafts 442 of the engaged member 440 can be inserted into the notch 14 and the guide groove 15, which are formed on the cylinder unit 12 in the mode switching switch 10. As for the support shaft 442 inserted into the guide groove 15, the insertion position is displaced by the rotation of the mode switching switch 10, and this involves the displacement in the axial direction inside the notch 71 of the base cylinder 70. Thus, in association with the rotation of the mode switching switch 10, the engaged member 440 is moved in the axial direction.

Also, on the inner circumferential surface of the cylinder unit 441 in the engaged member 440, an accommodation hole 443 that has a bottom and can accommodate the cylindrical member is formed. The accommodation hole 443 accommodates: a cylindrical engaged unit 444 whose one end side is closed; and a coil spring 445 interposed between the bottom surface of the accommodation hole 443 and the engaged unit 444. As for the engaged unit 444, one end surface is conically protruded. Then, in such a way that this end surface approaches the center of the cylinder unit 441, the coil spring 445 accommodated in the accommodation hole 443 biases the engaged unit 444.

The inner diameter of the cylinder unit 441 in the engaged member 440 is slightly thicker than the outer diameter of the portion where the first click surface 461 and second click surface 462 in the linkage unit 422 are formed. When the linkage unit 422 is inserted into the cylinder unit 441, the engaged unit 444 biased by the coil spring 445 is engaged with the first click surface 461 or second click surface 462. As mentioned above, the engaged member 440 is moved in the axial direction in association with the rotation of the mode switching switch 10. In association with this movement, the engaged unit 444 is engaged with one of the first click surface 461 and the second click surface 462.

For example, when the mode switching switch 10 is located at the position of the mode mark 3 (namely, the central position), the support shaft 442 of the engaged member 440 is located at the center 15*b* of the guide groove 15. At this time, the engaged member 440 is located on the lower side of the movement range in the axial direction, and the engaged unit 444 of the engaged member 440 is engaged with the second click surface 462 formed on the linkage unit 422 in the dial switch 20. The 18 concaves or convexes are formed on the second click surface 462. When the user rotationally operates the dial switch 20, the 18 click feelings are generated for each rotation (refer to FIG. 10B).

When the mode switching switch 10 is clockwise rotationally operated to the position of the mode mark 2, the cylinder unit 12 in the mode switching switch 10 is rotated to the position where the support shaft 442 of the engaged member 440 is inserted into the other end 15*c* of the guide groove 15. The guide groove 15 is shaped to be gradually displaced in the axial direction so that it is bent at the center 15*b*, and the other end 15*c* is located on the upper side. Thus, in association with the rotation of the cylinder unit 12, along the guide groove 15, the support shaft 442 of the engaged member 440 is moved in the axial direction of the base cylinder 70. Consequently, the engaged member 440 is moved to the upper side in the axial direction, and the engaged unit 444 is engaged with the first click surface 461. The 36 concaves or convexes are formed on the first click surface 461. Then, when the user rotationally operates the dial switch 20, the 36 click feelings per rotation are generated (refer to FIG. 10A).

The operating device according to the third embodiment having the foregoing configuration has the actions and effects similar to the operating device according to the second embodiment. When the mode switching switch 10 is rotationally operated to switch the mode, it is possible to change the click feeling generated by the rotational operation of the dial switch 20. Also, since the first click surface 461 and the second click surface 462 are formed integrally with the linkage unit 422 in the dial switch 20, the number of the parts in the operating device can be reduced, thereby reducing the manufacturing cost, the assembling cost and the like of the operating device. Also, the engaged member 440 is configured to be cylindrical, and the two support shafts 442 are configured to be inserted into the notches 71 of the base cylinder 70. Thus, the engaged member 440 can be stably supported, and the engaged member 440 can be smoothly moved.

By the way, the other configurations of the operating device according to the third embodiment are similar to the configurations of the operating device according to the second embodiment. Thus, the same symbols are assigned to the similar portions, and their detailed explanations are omitted.

Fourth Embodiment

Figure 13:
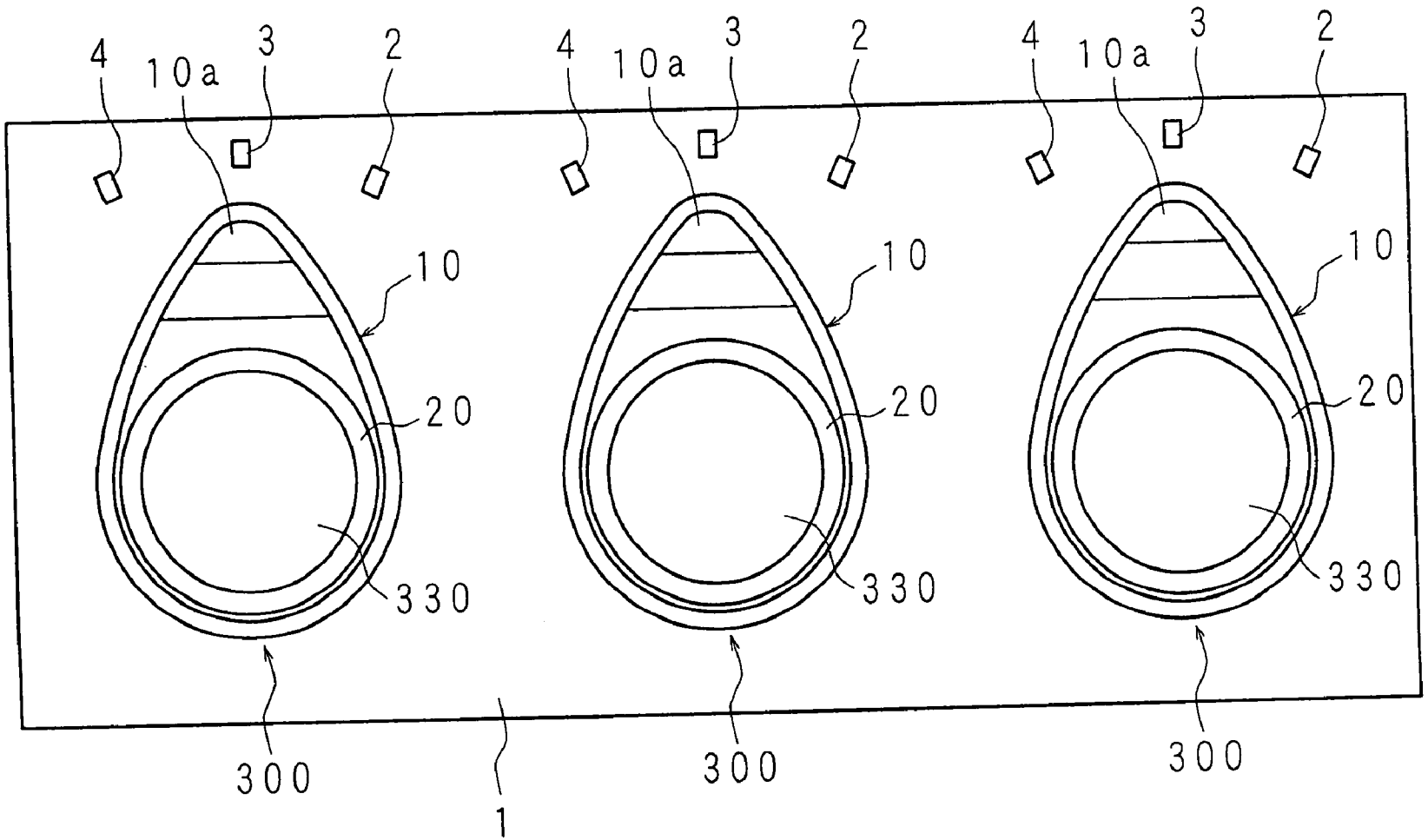
FIG. 13 is a plan view showing a configuration of an operating system according to a fourth embodiment of the present invention.
Figure 14:
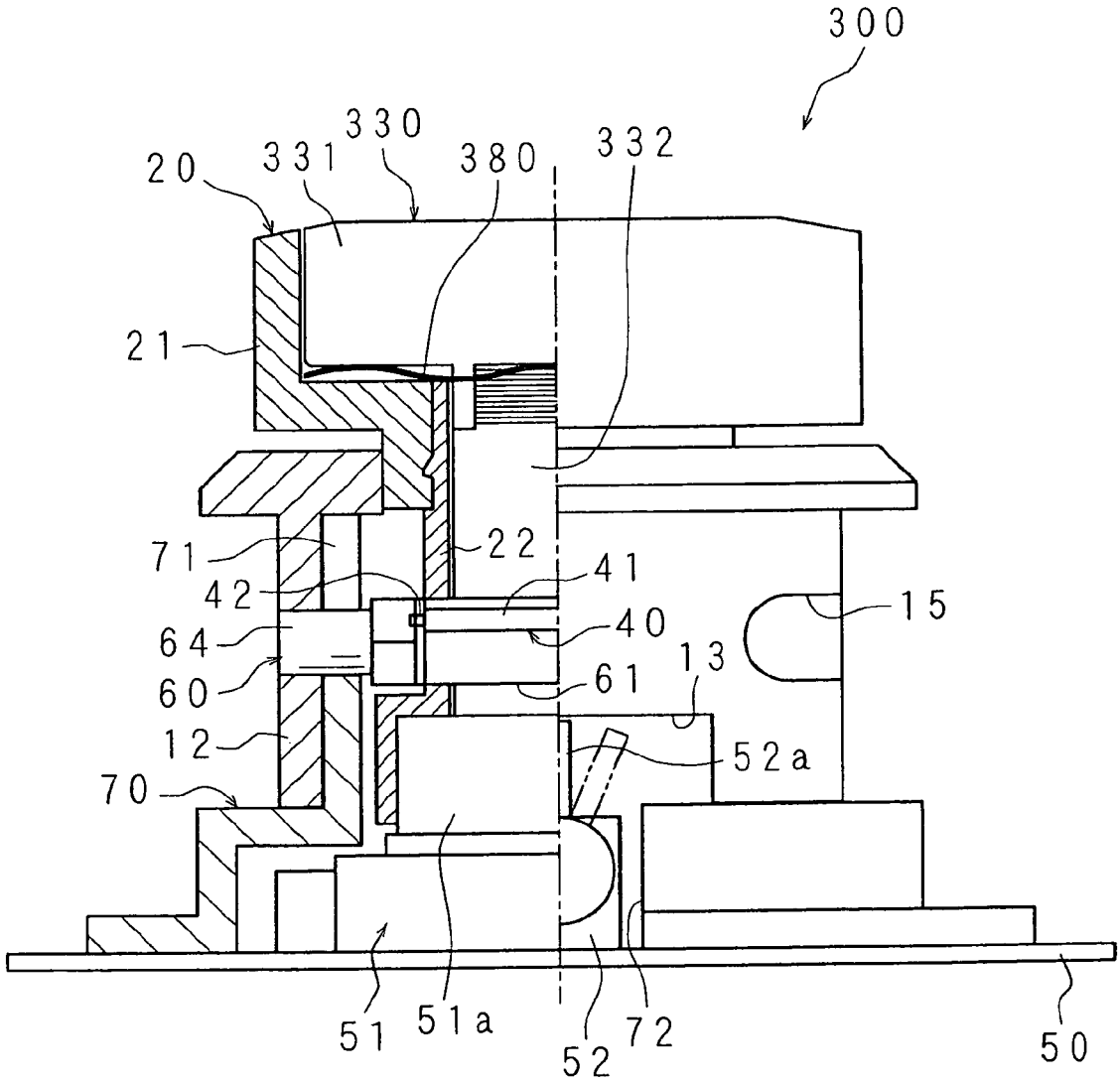
FIG. 14 is a sectional view showing an inner configuration of an operating device according to the fourth embodiment of the present invention.

FIG. 13 is the plan view showing the configuration of the operating system according to the fourth embodiment of the present invention. Also, the FIG. 14 is the sectional view showing the inner configuration of the operating device according to the fourth embodiment of the present invention. The operating system according to the fourth embodiment is configured to comprise three operating devices 300. The three operating devices 300 are configured similarly to the operating device according to the first embodiment. However, they differ from it in that there are the operational load for the rotational operation of the dial switch 20. Also, the operational loads whose values are different from each other are given to the three operating devices 300.

The operating device 300 according to the fourth embodiment is configured such that a fixed shaft 330 which is immovably fixed to the center of the rotations of the mode switching switch 10 and the dial switch 20 is fixed by screwing a disc unit 331 and a cylinder unit 332 which are manufactured as different parts. For this reason, a female screw unit is formed on the disc unit 331, and a male screw unit is formed on the cylinder unit 332.

Figure 15A:
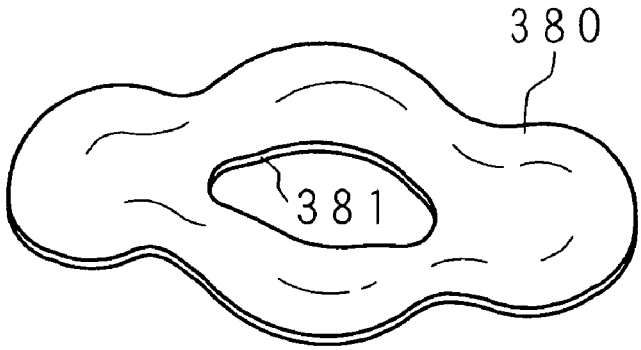
FIGS. 15A to 15C are diagrammatic views showing a configuration example of a wave washer of the operating device according to the fourth embodiment of the present invention.
Figure 15B:
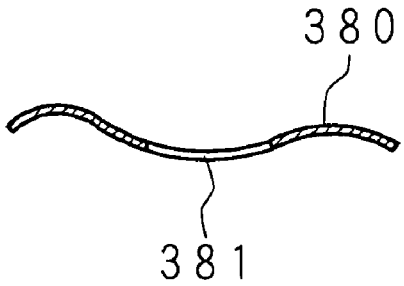
Figure 15C:
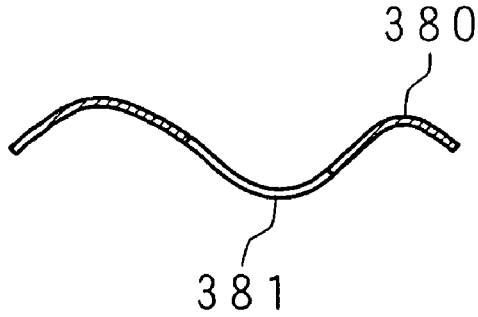

Also, the operating device 300 comprises a wave washer 380 (annular body) that is sandwiched between the fixed shaft 330 and the dial switch 20. FIGS. 15A to 15C are the diagrammatic views showing the configuration example of the wave washer 380 in the operating device 300 according to the fourth embodiment of the present invention. FIG. 15A shows the perspective view, and FIG. 15B and FIG. 15C show the side sectional views of the different configuration examples of the wave washer 380, respectively. The wave washer 380 is the annular metallic plate, and a penetration hole 381 through which the cylinder unit 332 of the fixed shaft 330 can be inserted is formed in the center. Also, the wave washer 380 is bent wavily. Also, the three operating devices 300 comprise the wave washers 380 in which the bending degrees differ from each other, namely, the heights of the waves differ from each other.

The wave washer 380 is sandwiched between the surface on which the female screw unit of the disc unit 331 in the fixed shaft 330 is provided and the surface opposite to the operating unit 21 in the dial switch 20. Consequently, the wave washer 380 is pressed and deformed to generate the restoring force. By the restoring force of the wave washer 380, the fixed shaft 330 and the dial switch 20 are biased in the direction in which they are separated, and this biasing action serves as the operational load given to the rotational operation of the user.

With the foregoing configurations, in each operating device 300, the operational load can be easily given for the rotational operation of the dial switch 20 by the wave washer 380. Also, the three operating devices 300 in the operating system are configured to comprise the wave washers 380 whose heights differ from each other. Thus, the operational loads whose magnitudes differ from each other can be easily given to the respective operating devices 300. Hence, a user can recognize one of the three operating devices 300 that are rotationally operated, on the basis of the operational load, without any visual observation of the operating system.

By the way, the operating system according to the fourth embodiment is configured to comprise the plurality of operating devices 300 that are configured similarly to the operating device according to the first embodiment. However, this is not limited thereto. It may be configured to comprise the plurality of operating devices that are configured similarly to the operating device according to the second embodiment. Also, the configure in which the operating device according to the first embodiment and the operating device according to the second embodiment are mixed may be adopted.

Also, the other configurations of the operating device according to the fourth embodiment are similar to the configuration of the operating device according to the first embodiment. Thus, the same symbols are assigned to the similar portions, and their detailed descriptions are omitted.

Fifth Embodiment

The operating device according to the fifth embodiment is an operating device such that the following changes or additions are performed on the configuration of the operating device according to the first to fourth embodiments.

(1) The detection of the rotation position of the mode switching switch (the switching between the modes) is changed from the method of using the switching detection element 52 to a method of using a photo interrupter. Also, the switching between the modes that is carried out by the mode switching switch is changed from the three stages to five stages.

(2) The detection of the rotation of the dial switch is changed from the method of using the rotary encoder 51 to the method of using the photo interrupter.

(3) A switch of a press (push) type is added.

(4) A mechanism for giving off a visible light from a switch is added.

(5) A mechanism that can swing the mode switching switch is added.

Figure 16:
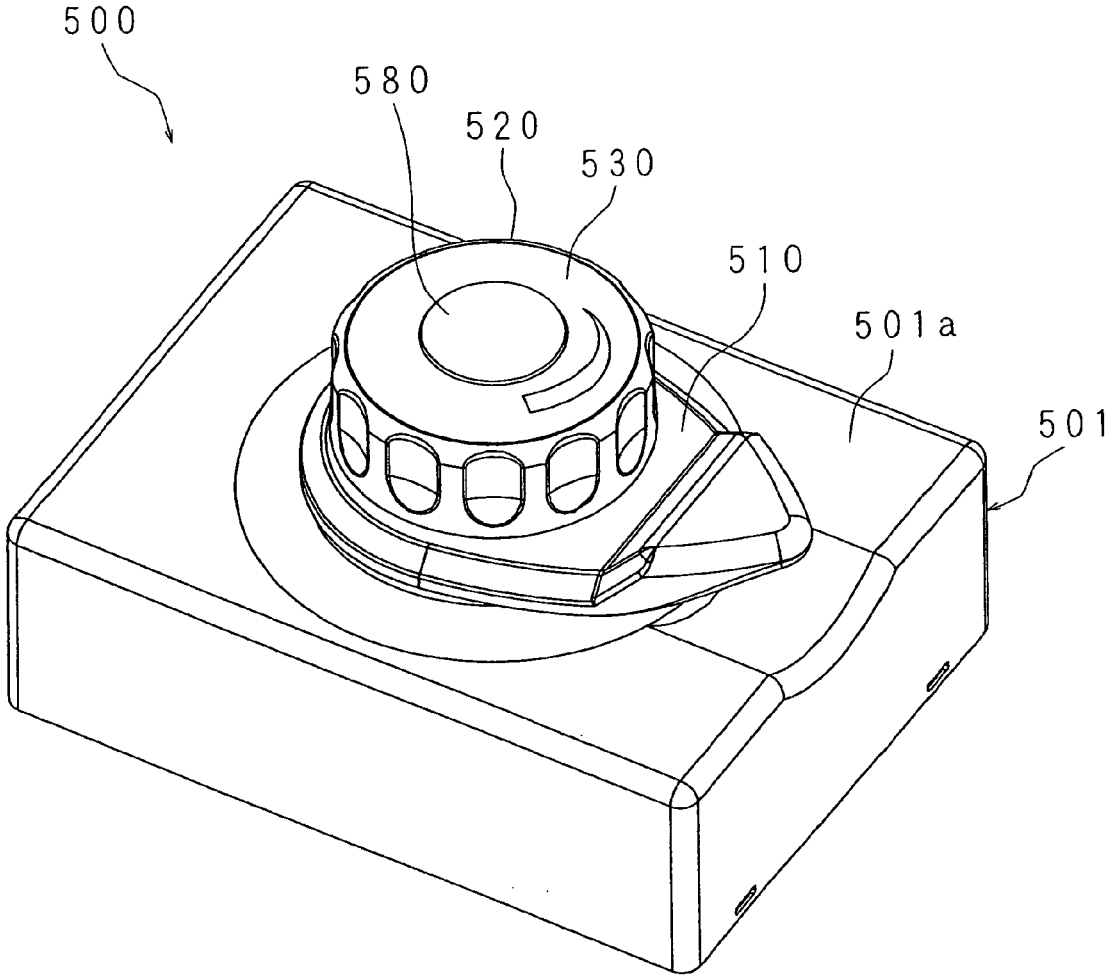
FIG. 16 is a perspective view showing a configuration of an operating device according to a fifth embodiment.
Figure 20:
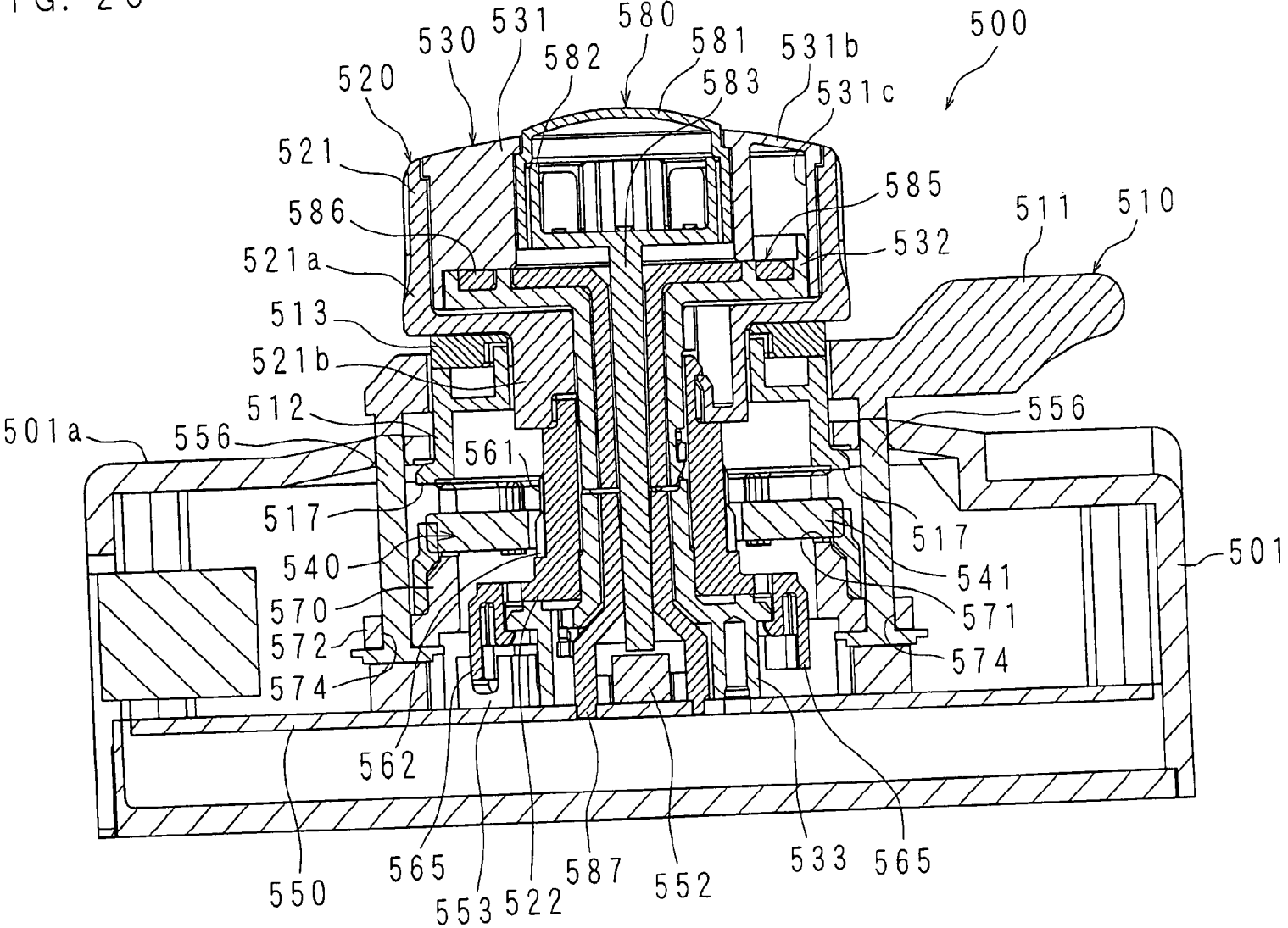
FIG. 20 is a sectional view along an A-A line in FIG. 17.
Figure 21:
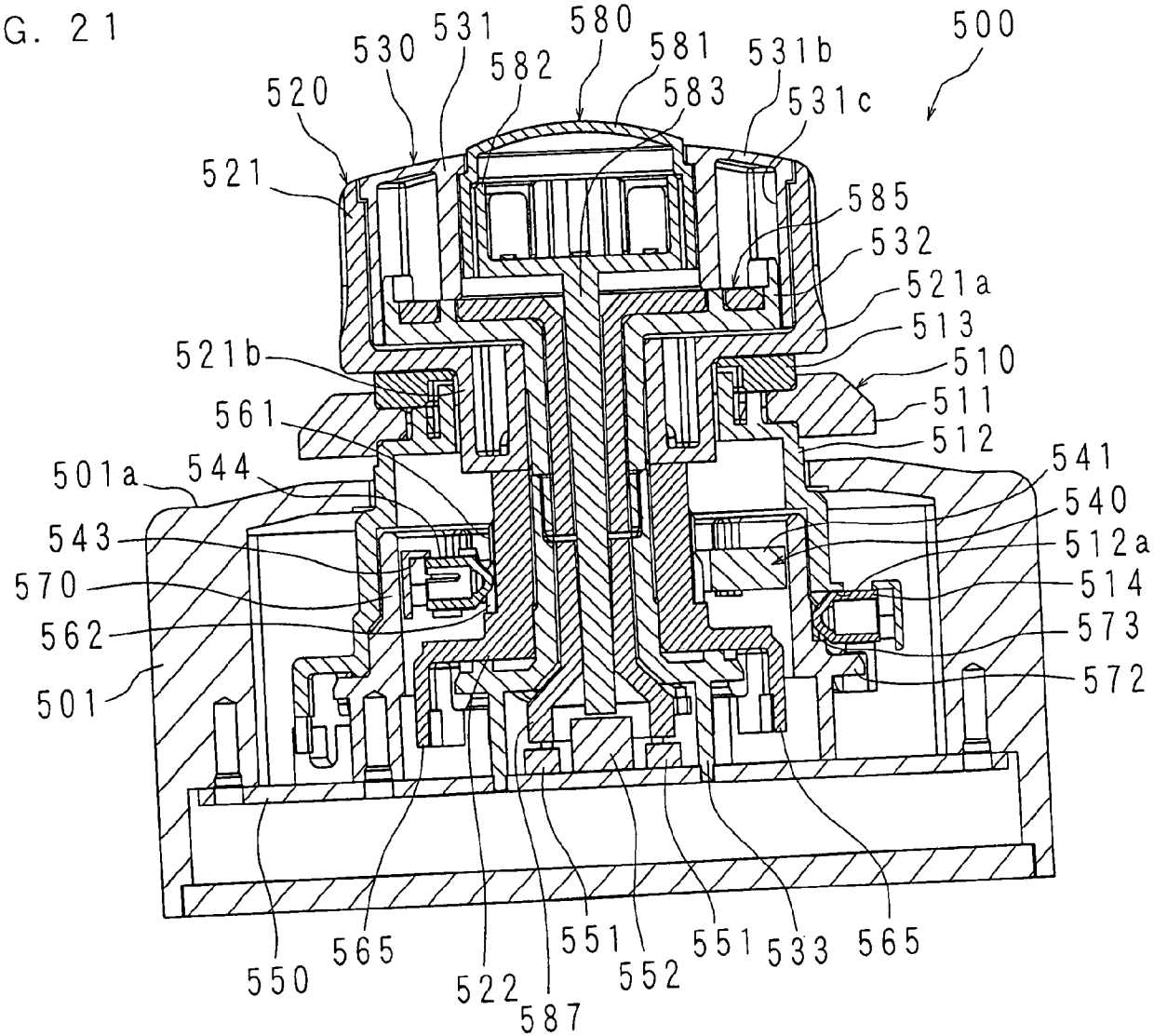
FIG. 21 is a sectional view along a B-B line in FIG. 17.
Figure 22:
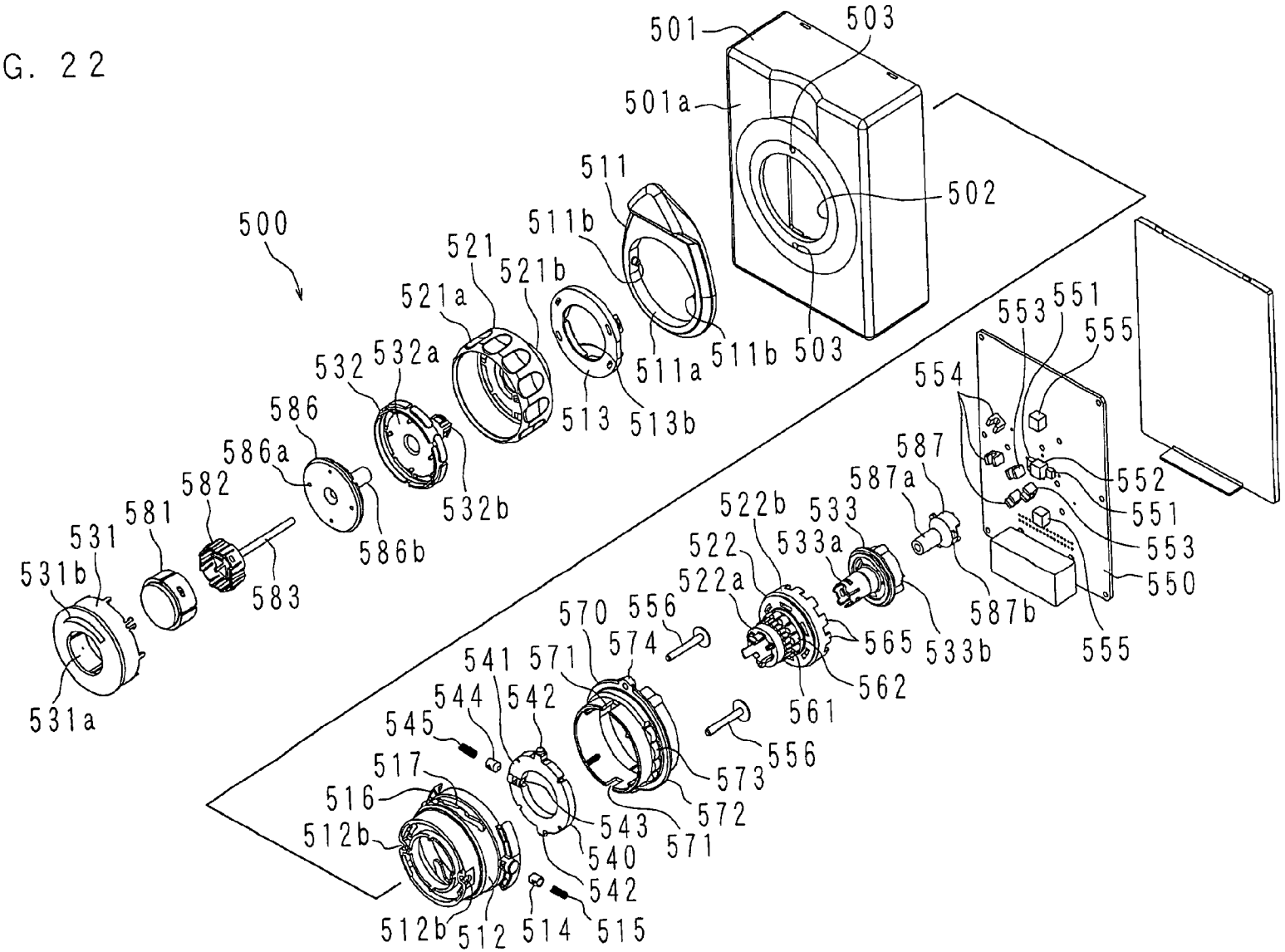
FIG. 22 is an exploded perspective view of the operating device according to the fifth embodiment.

FIG. 16 is the perspective view showing the configuration of an operating device 500 according to the fifth embodiment. FIGS. 17A to 17C are the trihedral views showing the configuration of the operating device 500 according to the fifth embodiment. FIG. 17A shows the top view, FIG. 17B shows the front view, and FIG. 17C shows the right side view. FIGS. 18A to 18C are the trihedral views showing the inner configuration of the operating device 500 according to the fifth embodiment. As for the operating device 500 in the state that en enclosure is removed, FIG. 18A shows the top view, FIG. 18B shows the front view, and FIG. 18C shows the right side view. FIGS. 19A to 19C are the trihedral views showing the inner configuration of the operating device 500 according to the fifth embodiment. As for the operating device 500 in the state that the enclosure is removed, FIG. 19A shows the top view, FIG. 19B shows the rear view, and FIG. 19C shows the left side view. FIG. 20 is the sectional view along the A-A line of FIG. 17A, and FIG. 21 is the sectional view along the B-B line of FIG. 17A. FIG. 22 is the exploded perspective view of the operating device 500 according to the fifth embodiment.

The operating device 500 according to the fifth embodiment has an approximately cuboidal enclosure 501, which accommodates a mechanism for generating the click feeling and a substrate 550 where an electric circuit is configured, and the like, and this has the outer appearance that a mode switching switch 510 and a dial switch 520 are stacked on a top surface 501*a* of the enclosure 501. The mode switching switch 510 has the shape of an approximately oval plate on a plan view, and this is arranged on the top surface 501*a* of the enclosure 501. Also, the mode switching switch 510 can be rotationally operated within the range of about 40° on the right and left sides, respectively (the total of about 80°), and the rotation can be stopped at a total of five positions (rotation positions) for each about 20°. However, the rotational operation range and rotation position of the mode switching switch 510 are indicated as one example, and they are not limited thereto.

The dial switch 520 is cylindrical, and a plurality of concaves and convexes for stopping the sliding are formed on the outer circumferential surface thereof, and the dial switch 520 is placed on the upper side of the mode switching switch 510 and can be rotationally operated within a range of 360° or more, clockwise and counterclockwise, around a fixed shaft 530 which is fixed to the substrate 550 so as not to be rotated. The top surface of the fixed shaft 530 is approximately circular, and an approximately circular push switch 580 (press operation body) for receiving the pressing (pushing) operation of the user is provided on the substantial center thereof. By the way, the central axis of the rotation of the mode switching switch 510 and the central axis of the rotation of the dial switch 520 coincide with each other, and the central axis of the rotation and the centers of the fixed shaft 530 and the push switch 580 coincide with each other.

The fixed shaft 530 is provided with: a substantially discal cover unit 531 in which a penetration hole 531*a* to provide the push switch 580 is formed on the center; an upper shaft 532 in which a disc portion 532*a* having the substantially same size as the top surface of the cover unit 531 and a cylindrical portion 532*b* having a diameter smaller than it are coaxially linked; and a lower shaft 533 in which a cylindrical portion 533*a* whose diameter is approximately equal to the cylindrical portion 532*b* of the upper shaft 532 and a cylindrical base portion 533*b* whose diameter is greater than it are coaxially linked.

The base portion 533*b* of the lower shaft 533 is immovably fixed to the substrate 550 by a screw and the like, and the cylindrical portion 532*b* of the upper shaft 532 is immovably fixed to the cylindrical portion 533*a* of the lower shaft 533 by the engagement through an engaging nail and the like, and the cover unit 531 is immovably fixed to the disc portion 532*a* of the upper shaft 532 by the engagement through the engaging nail and the like. Consequently, the fixed shaft 530 is assembled and immovably fixed to the substrate 550.

Also, in the assembled fixed shaft 530, the penetration hole 531*a* of the cover unit 531 and the inside of the cylindrical portion 532*b* of the upper shaft 532 and the inside of the lower shaft 533 are continuously linked. That is, the fixed shaft 530 is cylindrical, and the penetration hole is provided from the cover unit 531 located on the highest portion to the substrate 550 located on the lowest portion. However, the inner diameter of the penetration hole 531*a* of the cover unit 531 and the inner diameter of the base portion 533*b* of the lower shaft 533 are thicker than the inner diameters of the cylindrical portion 532*b* of the upper shaft 532 and the cylinder unit 533*a* of the lower shaft 533.

Also, a light-transmitting unit 531*b*, which is made of transparent synthesis resin and the like and can transmit light interiorly and exteriorly, is provided on the upper surface of the cover unit 531 of the fixed shaft 530. Also, a gap 531*c* for transmitting the light from the lower surface to the light-transmitting unit 531*b* is formed in the cover unit 531, and the light from the lower side of the cover unit 531 can be emitted through the gap 531*c* and the light-transmitting unit 531*b* to outside.

Two LEDs (Light Emitting Diodes) 551 (light emitting body) are installed on the substrate 550. The operating device 500 comprises a light guide member 585 for guiding the light emitted by the LED 551 of the substrate 550 through the fixed shaft 530 to the lower side of the cover unit 531. The light guide member 585 is made of transparent synthesis resin and the like.

The light guide member 585 is divided into the two units of an upper light guide unit 586 and a lower light guide unit 587. The upper light guide unit 586 is configured such that a disc portion 586*a* slightly smaller than the disc portion 532*a* of the upper shaft 532 of the fixed shaft 530 and a cylindrical portion 586*b* interiorly engaged with the cylindrical portion 532*b* of the upper shaft 532 are coaxially linked. The lower light guide unit 587 is configured such that a cylindrical portion 587*a* interiorly engaged with the cylindrical portion 533*a* of the lower shaft 533 in the fixed shaft 530 and a cylindrical base portion 587*b* having the size such that the base portion 587*b* can be accommodated in the base portion 533*b* of the lower shaft 533 are coaxially linked.

On the lower light guide unit 587 of the light guide member 585, two notches are formed on the lower end of the base portion 587*b*. In such a way that the notch portions cover the upper sides of the two LEDs 551 of the substrate 550, the lower light guide unit 587 is attached to the substrate 550. By the way, the lower light guide unit 587 is not required to be fixed to the substrate 550 by the screw and the like. Then, since the lower shaft 533 of the fixed shaft 530 externally engaged with the cylindrical portion 587*a* of the lower light guide unit 587 is fixed to the substrate 550, the lower light guide unit 587 is immovably fixed to the substrate 550. The upper light guide unit 586 of the light guide member 585 is fixed such that the disc portion 586*a* is sandwiched between the cover unit 531 of the fixed shaft 530 and the upper shaft 532.

When the upper shaft 532 and lower shaft 533 of the fixed shaft 530 are linked and fixed, the lower surface of the cylindrical portion 586*b* of the upper light guide unit 586 interiorly engaged with the cylindrical portion 532*b* of the upper shaft 532 and the upper surface of the cylindrical portion of the lower light guide unit 587 interiorly engaged with the cylindrical portion 533*a* of the lower shaft 533 are brought into contact with each other or are opposite to each other at the interval of a micro distance. Consequently, the light emitted by the LED 551 is guided from the lower light guide unit 587 of the light guide member 585 to the upper light guide unit 586, and further guided to the lower side of the cover unit 531 of the fixed shaft 530 and then emitted from the light-transmitting unit 531*b* through the gap 531*c* of the cover unit 531 to the outside.

The push switch 580 provided in the fixed shaft 530 is provided with: a cylindrical cover unit 581 having an upper surface; a cylindrical base unit 582 that has a lower surface and is interiorly engaged with the cover unit 581; and a pressing bar unit 583 fpressing member) that is fixed to the substantial center of the lower surface of the base unit 582. The cover unit 581 of the push switch 580 is immovably fixed to the base unit 582 in the state externally engaged with the base unit 582, by an engaging nail and the like.

The cover unit 581 of the push switch 580 has the size such that the cover unit 581 is interiorly engaged with the penetration hole 531*a* formed in the cover unit 531 of the fixed shaft 530. A plurality of slits that are long in the axial direction are formed on the outer circumferential surface of the cover unit 581 in the push switch 580. A plurality of protrusions accommodated in those slits are formed on the inner circumferential surface of the penetration hole 531*a* of the cover unit 531 in the fixed shaft 530. With the engagement between the slits and the protrusions, the push switch 580 interiorly engaged with the penetration hole 531*a* of the cover unit 531 in the fixed shaft 530 can be moved in the axial direction (the upper and lower direction) along the slits. By the way, this may be configured such that the plurality of protrusions are formed on the outer circumferential surface of the cover unit 581 in the push switch 580, and the plurality of slits which are long in the axial direction where the plurality of protrusions are accommodated are formed on the inner circumferential surface of the penetration hole 531*a* provided in the cover unit 531 in the fixed shaft 530, and the push switch 580 can be moved in the axial direction (the upper and lower direction) along the slits.

The pressing bar unit 583 in the push switch 580 is the round bar having the thickness that enables the insertion through the interiors of the cylinder unit 586*b* of the upper light guide unit 586 and the cylinder unit 587*a* of the lower light guide unit 587 in the light guide member 585. In the substrate 550, a press detecting switch 552 (pressing detection means) for detecting the pressing is provided between the two LEDs 551. When the upper surface of the cover unit 581 is pressed and the push switch 580 is downwardly moved, the lower end of the pressing bar unit 583 inserted into the light guide member 585 can press the upper portion of the press detecting switch 552. The press detecting switch 552 is the electronic part for detecting the pressing against the operating portion (not shown) provided on the upper portion. This operating portion is biased in the direction against the pressing. Thus, if there is no pressing operation, the push switch 580 is upwardly moved by the biasing force of the press detecting switch 552.

The dial switch 520 is provided with: an operating unit 521 (second rotation operation body) that is exposed to the outside in order for the user to touch it and carry out the operation; and a rotation shaft 522 (shaft) externally engaged with the upper shaft 532 and lower shaft 533 in the fixed shaft 530. The operating unit 521 is configured such that a large diameter cylindrical portion 521*a* having a large diameter in which a plurality of concaves and convexes for stopping the sliding are formed on the outer circumferential surface and a small diameter cylindrical portion 521*b* having a diameter smaller than this are coaxially linked. The cover unit 531 of the fixed shaft 530 is accommodated in the large diameter cylindrical portion 521*a* in the operating unit 521.

Also, the rotation shaft 522 in the dial switch 520 is configured such that a small diameter cylindrical portion 522*a*, which is externally engaged with the cylindrical portion 532*b* of the upper shaft 532 in the fixed shaft 530 and the cylindrical portion 533*a* of the lower shaft 533, and a large diameter cylindrical portion 522*b* having a size whose diameter is thicker than the small diameter cylindrical portion 522*a* and which enables the base unit 533*b* of the lower shaft 533 in the fixed shaft 530 to be accommodated therein are coaxially linked. The rotation shaft 522 is externally engaged with the lower shaft 533 of the fixed shaft 530 fixed to the substrate 550 and rotatably held. The lower end of the operating unit 521 and the upper end of the rotation shaft 522 are fixed by the engagement through an engaging nail and the like, and the operating unit 521 and the rotation shaft 522 are integrally rotated. That is, the cylindrical dial switch 520 is rotatably held in the manner that it is externally engaged with the fixed shaft 530 fixed to the substrate 550.

On the small diameter cylindrical portion 522*a* of the rotation shaft 522 in the dial switch 520, a first click surface 561 (engaging unit) and a second click surface 562 (engaging unit) are formed in each of which a plurality of concaves or convexes are placed at a predetermined interval over one circumference of the outer circumferential surface. The number of the concaves or convexes of the first click surface 561 is greater than the number of the concaves or convexes of the second click surface 562, and the first click surface 561 and the second click surface 562 are aligned in the axial direction of the rotation shaft 522. The rotation shaft 522 and the first click surface 561 and the second click surface 562 are integrally formed through the integral molding using synthesis resin.

On the large diameter cylindrical portion 522*b* of the rotation shaft 522 in the dial switch 520, a plurality of light shielding units 565 (first light shielding unit) are formed over one circumference of the lower end portion. Each light shielding unit 565 is approximately rectangular and provided extendedly from the lower end of the rotation shaft 522. Also, all of the plurality of light shielding units 565 are substantially equal in shape and aligned on the lower end of the rotation shaft 522 at substantially equal intervals in the circumferential direction. The plurality of light shielding units 565 are used while combined with two photo interrupters 553 (first light shielding detection means, rotation detecting means) provided on the substrate 550. Consequently, the rotation of the dial switch 520 is detected. The detail of the rotation detected by the light shielding unit 565 and the photo interrupter 553 will be described later.

Also, the operating device 500 comprises a cylindrical (or annular) engaged unit 540 (moving body) through which the small diameter cylindrical portion 522*a* of the rotation shaft 522 in the dial switch 520 can be inserted. The engaged unit 540 has a cylinder unit 541 and two support shafts 542 (inserted unity protruding in the radial direction from the outer circumferential surface of this cylinder unit 541. The two support shafts 542 are provided at the opposite positions on the outer circumferential surface of the cylinder unit 541, respectively.

Also, on the inner circumferential surface of the cylinder unit 541 of the engaged unit 540, an accommodation hole 543 is formed which can accommodate a cylindrical member. The accommodation hole 543 accommodates a cylindrical engaged unit 544 whose one end side is closed, and a coil spring 545 for biasing this engaged unit 544. As for the engaged unit 544, one end is conically protruded. Then, in such a way that this end approaches the center of the cylinder unit 541, the coil spring 545 accommodated in the accommodation hole 543 biases the engaged unit 544.

The inner diameter of the cylinder unit 541 in the engaged member 540 is slightly thicker than the outer diameter of the small diameter cylindrical portion 522*a* of the rotation shaft 522 in the dial switch 520. When the small diameter cylinder unit 522*a* is inserted into the cylinder unit 541, the engaged member 544 biased by the coil spring 545 is engaged with the first click surface 561 or second click surface 562. The engaged member 540 is moved in the axial direction in association with the rotation of the mode switching switch 510. In association with this movement, the end of the engaged unit 544 is engaged with one of the first click surface 561 and the second click surface 562.

Also, the operating device 500 comprises a base cylinder 570 for supporting the engaged member 540 and the mode switching switch 510 and the like. The base cylinder 570 is cylindrical and has the size and the shape that enable the rotation shaft 522 in the dial switch 520, the fixed shaft 530 and the engaged member 540 and the like to be accommodated therein.

On the base cylinder 570, two notches 571 that are long in the axial direction are formed on one end side, and on the other end side, the base cylinder 570 is immovably fixed to the substrate 550 by screwing and the like. The two notches 571 on the one end side are formed on the sides opposite to each other, with the axial center of the base cylinder 570 therebetween. The width of each of the notches 571 is set to be approximately equal to or slightly wider than the diameter of the support shaft 542 in the engaged member 540, and the support shaft 542 can be inserted into the notch 571, and the support shaft 542 can be moved through the notch 571 in the axial direction of the base cylinder 570.

Also, the inner diameter of the one end side of the base cylinder 570 is slightly thicker than the outer diameter of the cylinder unit 541 of the engaged member 540, and the outer diameter is sufficiently smaller than the distance between the center of the engaged member 540 and the protrusion end of the support shaft 542. Since the two support shafts 542 of the engaged member 540 inserted into the rotation shaft 522 in the dial switch 520 are inserted into the two notches 571 of the base cylinder 570, the engaged member 540 can be axially moved along the notch 571 and supported to the base cylinder 570 in the manner that it cannot be rotated. In this state, the two support shafts 542 of the engaged member 540 are in the state that it is inserted through the notch 571 and protruded to outside the base cylinder 570.

The mode switching switch 510 comprises: an operating unit 511 (first rotation operation body) which has a shape of a substantially oval plate and is configured in order for the user to touch it and carry out the operation; a cylinder unit 512 (cylinder) and a cover unit 513 which are rotated integrally with this operating unit 511 and swingably supports the operating unit 511. The cylinder unit 512 of the mode switching switch 510 is cylindrical, and has the size such that the cylinder unit 512 is externally engaged with the base cylinder 570. The cylinder unit 512 is rotatably supported over the outer circumferential surface of the base cylinder 570, on a flange 572 provided along one circumference on the outer circumferential surface of the base cylinder 570.

An accommodating unit 512*a* that can accommodate the cylindrical member is formed in the cylinder unit 512. The accommodating unit 512*a* accommodates: a cylindrical engaged unit 514 whose one end side is closed; and a coil spring 515 for biasing this engaged unit 514. One end side of the engaged unit 514 is conically protruded, and in such a way that this end approaches the center of the cylinder unit 512, the coil spring 515 accommodated in the accommodating unit 512*a* biases the engaged unit 514. On the outer circumferential surface of the base cylinder 570, a click surface 573 constituted by a plurality of concaves or convexes formed in the circumferential direction is provided, and the engaged unit 514 of the cylinder unit 512 in the mode switching switch 510 that is externally engaged with the base cylinder 570 is engaged with the click surface 573 biased by the coil spring 515. Thus, the click feeling can be generated in association with the rotation of the mode switching switch 510.

A circular penetration hole 511*a* slightly greater than the outer diameter of the cylinder unit 512 is formed in the operating unit 511 in the mode switching switch 510. On the inner circumference of the penetration hole 511*a*, two swinging shafts 511*b* are protruded towards the center, at the positions opposite to each other. At one end (top end) of the cylinder unit 512 in the mode switching switch 510, two holders 512*b* for accommodating the swinging shafts 511*b* of the operating unit 511 and swingably holding the operating unit 511 are formed at the positions opposite to each other. The mode switching switch 510 is configured by fixing the cover unit 513 to one end of the cylinder unit 512 in the state that the swinging shafts 511*b* of the operating unit 511 are held by the holder 512*b* in the cylinder unit 512. Then, the user can perform the rotating operation and the swinging operation on the operating unit 511 in the mode switching switch 510.

The cover unit 513 of the mode switching switch 510 has the shape of a circular plate whose outer diameter is approximately equal to the cylinder unit 512, and an approximately circular penetration hole 513*b* having a size, which enables the insertion of the smaller diameter cylindrical portion 521*b* of the operating unit 521 in the dial switch 520, is formed. The cover unit 513 is fixed to one end of the cylinder unit 512 by the engagement of an engaging nail and the like. Consequently, the operating unit 511 in the mode switching switch 510 is held without being removed from the holder 512*b* in the cylinder unit 512.

Also, at the other end (bottom end) of the cylinder unit 512 in the mode switching switch 510, three light shielding units 516 (second light shielding unit) are provided in a part of the circumferential direction. The three light shielding units 516 are approximately rectangular and provided extendedly from a part of the bottom end of the cylinder unit 512. Also, the three light shielding units 516 are aligned at substantially equal intervals, in the circumferential direction of the cylinder unit 512. The three light shielding units 516 are used while combined with three photo interrupters 554 (second light shielding detection means position detecting means) provided on the substrate 550. Consequently, the rotation position of the mode switching switch 510 is detected. The detail of the rotation position of the mode switching switch 510 detected by the light shielding unit 516 and the photo interrupter 554 will be described later.

Also, a guide groove 517 having a shape of a long hole that is long in the circumferential direction is formed on the cylinder unit 512 in the mode switching switch 510. The guide groove 517 has the shape that is long along the circumferential direction of the cylinder unit 512 between one end and the other end. Also, the guide groove 517 is slightly bent in the middle thereof, and has a portion that is gradually displaced from one end side to the other end side. Also, the guide grooves 517 are formed on both sides with the axial center of the cylinder unit 512 therebetween. The two guide grooves 517 are approximately equal in shape. The width of each of the guide grooves 517 has the size that enables the support shaft 542 provided on the engaged member 540 to be accommodated, and is equal to or slightly greater than the diameter of the support shaft 542.

In the state that the two support shafts 542 of the engaged member 540 are supported by the two notches 571 of the base cylinder 570, the two support shafts 542 are inserted through the notches 571 of the base cylinder 570 and protruded to the outside. The protrusion portion of this support shaft 542 is inserted into the guide groove 517 formed on the cylinder unit 512 in the mode switching switch 510.

As mentioned above, the engaged member 540 supported by the base cylinder 570 can be moved in the axial direction along the notch 571 of the base cylinder 570. When the mode switching switch 510 in which the cylinder unit 512 is externally engaged with the base cylinder 570 is rotationally operated, only the mode switching switch 510 is rotated because the base cylinder 570 and the engaged member 540 are fixed in the manner that they cannot be rotated. At this time, the support shaft 542 of the engaged member 540 is inserted into the guide groove 517 formed on the cylinder unit 512 in the mode switching switch 510. Then, since in association with the rotation of the cylinder unit 512, the insertion position into the guide groove 517 is changed, the support shaft 542 moves in the axial direction of the base cylinder 570 along the displacement portion of the guide groove 517. Thus, the rotation of the mode switching switch 510 enables the engaged member 540 to be moved in the axial direction. Hence, the click surface formed on the rotation shaft 522 of the dial switch 520 with which the engaged unit 544 of the engaged member 540 is engaged is changed, and it is possible to change the click feeling correspondingly to the rotation position of the mode switching switch 510.

When the operating device 500 is assembled, at first, the lower shaft 533 of the fixed shaft 530 that accommodates the lower light guide unit 587 of the light guide member 585 is fixed to the substrate 550, and the rotation shaft 522 of the dial switch 520 is externally engaged with the lower shaft 533 of the fixed shaft 530. Next, the base cylinder 570 is fixed to the substrate 550, and the support shaft 542 of the engaged member 540 is inserted into the notch 571 of the base cylinder 570. Consequently, the engaged member 540 is held outside the rotation shaft 522 of the dial switch 520 and inside the base cylinder 570. Moreover, after the cylinder unit 512 of the mode switching switch 510 is externally engaged with the base cylinder 570, they are accommodated inside the enclosure 501. In this state, a penetration hole 502 having the substantially same size as the penetration hole 511*a* formed in the operating unit 511 of the mode switching switch 510 is formed in the upper surface 501*a* of the enclosure 501, and one end of the cylinder unit 512 of the mode switching switch 510 protrudes from the penetration hole 502 of the enclosure 501.

Next, the swinging shaft 511*b* of the operating unit 511 is held by the holder 512*b* provided at one end of the cylinder unit 512 in the mode switching switch 510 protruding from the penetration hole 502 of the enclosure 501, and the cover unit 513 is fixed to the cylinder unit 512. Next, the operating unit 521 of the dial switch 520 is fixed to the rotation shaft 522, by inserting the small diameter cylindrical portion 521*b* through the mode switching switch 510. Also, the upper shaft 532 of the fixed shaft 530 is fixed to the lower shaft 533, by inserting the cylindrical portion 532 through the dial switch 520.

Next, the cylindrical portion 586*b* of the upper light guide unit 586 in the light guide member 585 is inserted through the fixed shaft 530, and the pressing bar unit 583 of the push switch 580 is inserted through the light guide member 585, and the cover unit 581 of the push switch 580 is fixed to the base unit 582. By the way, at this time, after the cover unit 581 of the push switch 580 is fixed to the base unit 582 in advance, the pressing bar unit 583 of the push switch 580 may be inserted through the light guide member 585. After that, the cover unit 531 of the fixed shaft 530 is fixed to the upper shaft 532, and the operating device 500 is configured.

Also, in the operating device 500, two press detecting switches 555 (swinging detection means) for detecting the swinging of the operating unit 511 in the mode switching switch 510 are provided on the substrate 550. The press detecting switch 555 is similar to the press detecting switch 552, and this is the electronic part for detecting the pressing against the operation portion (not shown) provided on the upper portion, and this operation portion is biased in the direction against the pressing. The operating device 500 comprises two pressing bars 556 for pressing the two press detecting switches 555, respectively. Two holders 574 for holding the pressing bars 556 are provided in the flange 572 of the base cylinder 570.

Each of the holders 574 is the penetration hole formed in the flange 572. When the pressing bar 556 is inserted through this penetration hole, the pressing bar 556 is held movably in the axial direction (the upper and lower direction). The two holders 574 are provided at the positions opposite to each other, with the axial center of the base cylinder 570 therebetween, and provided at the positions opposite to the press detecting switch 555 on the substrate 550, respectively, when the base cylinder 570 is fixed to the substrate 550. Thus, by the movement of the pressing bar 556 held in the holder 574, the press detecting switch 555 on the substrate 550 can be pressed, and the pressing bar 556 is biased in the direction that is separated from the substrate 550 by the biasing force of the press detecting switch 555.

Also, two penetration holes 503 with a penetration hole 502 therebetween are formed in the upper surface 501*a* of the enclosure 501. The penetration hole 503 of the enclosure 501 has the size that enables the insertion of the pressing bar 556. Then, one end portion of the pressing bar 556 held by the holder 574 of the base cylinder 570 and biased by the press detecting switch 555 is protruded from the penetration hole 503. Consequently, when the operating unit 511 of the mode switching switch 510 is swingingly operated, the swinging causes the pressing bar 556 to press the press detecting switch 555. Thus, the operating device 500 can detect the pressing operation against the mode switching switch 510.

The method of detecting the rotation position of the mode switching switch 510 and detecting the rotation of the dial switch 520 will be described below. By the way, in the following description, the configuration that can rotate the mode switching switch 510 at the five stages (namely, stepwise five rotation positions) is explained. However, it is not limited thereto. Even if the number of the rotation positions is 4 or less or 6 or more, the similar method can be used to detect the rotation position.

Figure 23:
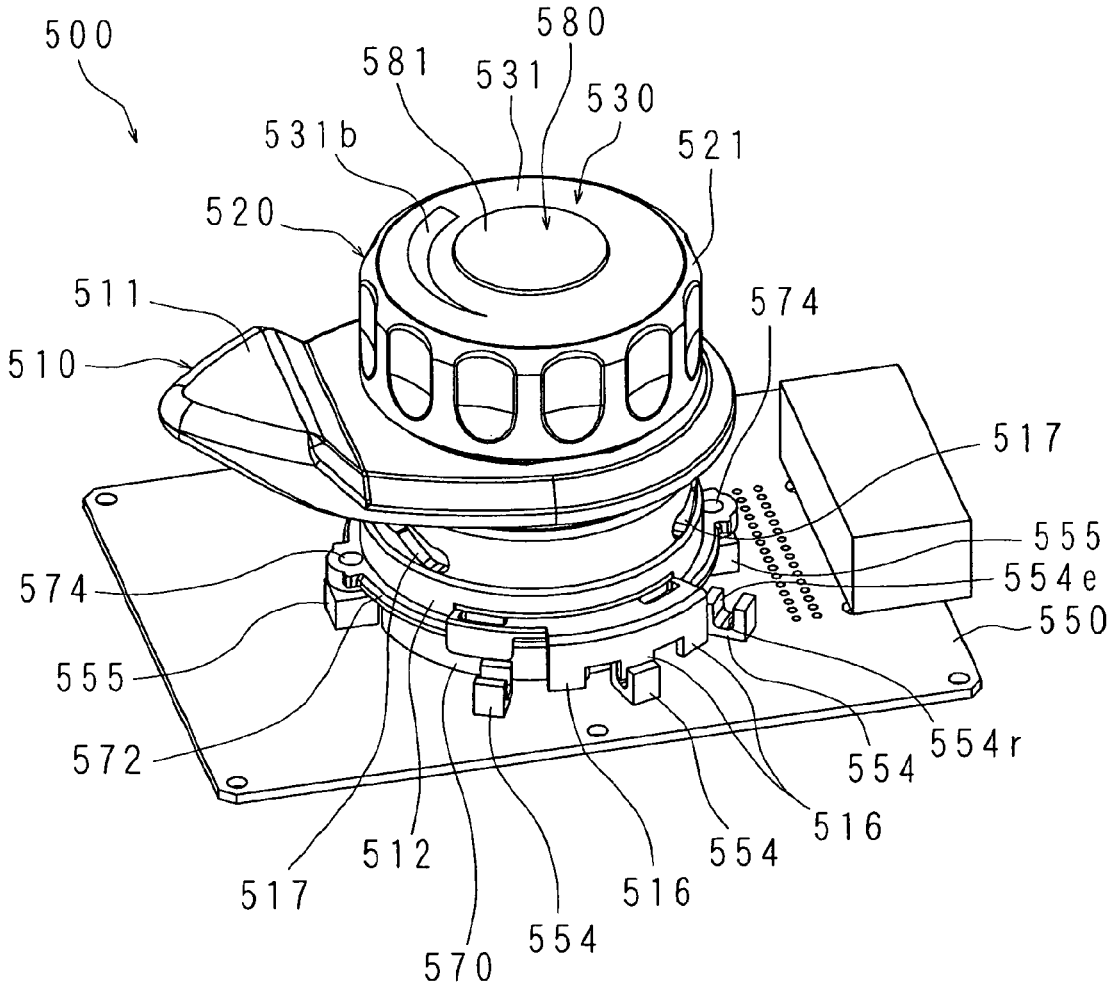
FIG. 23 is a perspective view of an operating device in which an illustration of an enclosure is omitted.
Figure 24A:
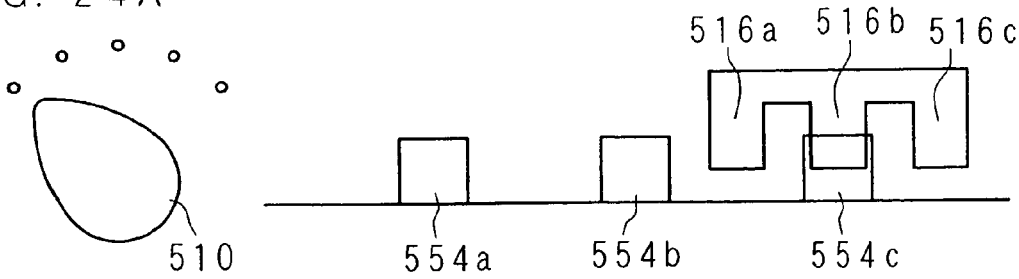
FIGS. 24A to 24E are diagrammatic views describing a method of detecting a rotation position of a mode switching switch.
Figure 24B:
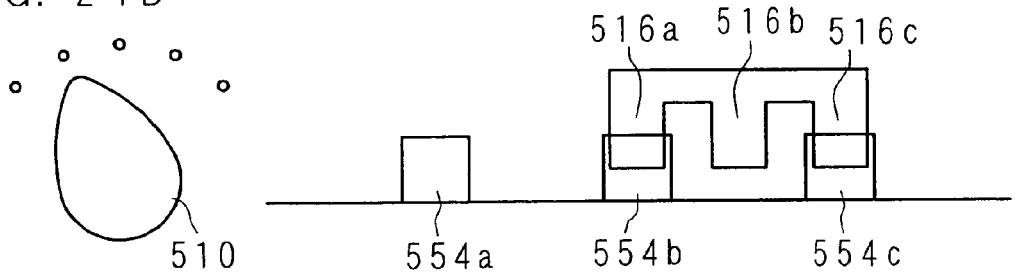
Figure 24C:
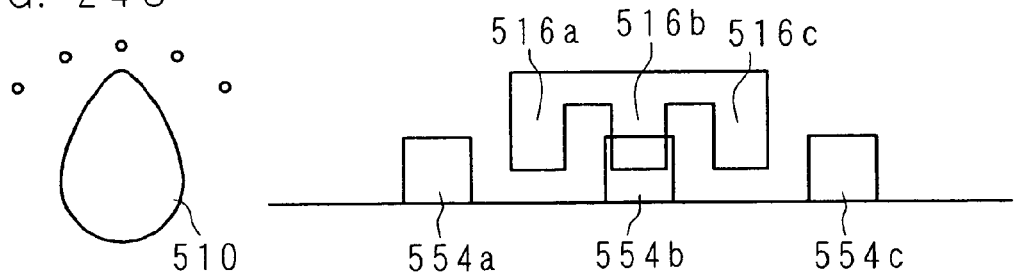
Figure 24D:
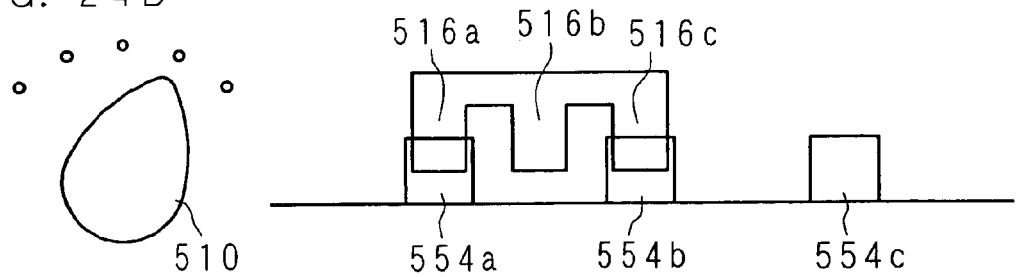
Figure 24E:
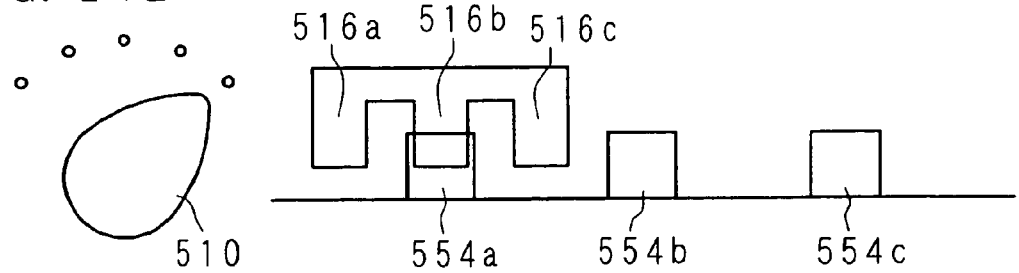

FIG. 23 is the perspective view of the operating device 500 in which the illustration of the enclosure 501 is omitted. The three photo interrupters 554 mounted on the substrate 550 are aligned at an equal interval along the outer circumferential surface of the base cylinder 570 fixed to the substrate 550. The photo interrupter 554 is substantially U-shaped in the manner that the rectangular plate is bent at two positions, and a light emitting unit 554*e* and a light receiving unit 554*r* are provided on the inner two opposite surfaces, respectively. On the basis of whether or not the light emitted by the light emitting unit 554*e* on one surface side can be received by the light receiving unit 554*r* on the other surface side, the photo interrupter 554 can detect light shielding.

The three light shielding units 516 of the mode switching switch 510 are provided at an equal interval along the circumferential direction of the cylinder unit 512, so that they further downwardly extend from the bottom end of the cylinder unit 512. The light shielding unit 516 of the cylinder unit 512 is passed and rotated between the light emitting unit and the light receiving unit of the photo interrupter 554 provided on the substrate 550, in association with the rotation of the mode switching switch 510.

Also, the interval between the light shielding units 516 adjacent to each other in the mode switching switch 510 is narrower than the interval between the photo interrupters 554 adjacent to each other on the substrate 550. In detail, the interval between the two photo interrupters 554 adjacent to each other and the interval between the two light shielding units 516 located at both ends among the three photo interrupters 554 are approximately equal (in other words, the distance between the centers of the light shielding units 516 adjacent to each other is half the distance between the centers of the photo interrupters 554 adjacent to each other).

FIGS. 24A to FIG. 24E and FIG. 25 are the diagrammatic views describing the method of detecting the rotation position of the mode switching switch 510. FIG. 24A to FIG. 24E diagrammatically show the states of the light shielding unit 516 and the photo interrupter 554 at the five rotation positions of the mode switching switch 510. Also, FIG. 25 collectively shows the output values of the respective photo interrupters 554 at the rotation positions in FIG. 24A to FIG. 24E, on the table. By the way, FIG. 24A to FIG. 24E and FIG. 25, the three light shielding units 516 are classified into 516*a* to 516*c*, respectively. Similarly, the three photo interrupters 554 are classified into 554*a* to 554*c*. Also, each photo interrupter 554 is assumed to output a "H (high)" signal when the light from the light emitting unit is shielded, and output a "L (low)" signal when the light from the light emitting unit is received by the light receiving unit.

When the mode switching switch 510 is rotated to the leftmost position on the plan view (refer to FIG. 24A), the central light shielding unit 516*b* optically shields the right photo interrupter 554*c*. Thus, the photo interrupters 554*a* and 554*b* output "L", and only the photo interrupter 554*c* outputs "H".

When the mode switching switch 510 is rotated to the second position from the left side on the plan view (refer to FIG. 24B), the light shielding unit 516*a* optically shields the central photo interrupter 554*b*, and the light shielding unit 516*c* optically shields the photo interrupter 554*c*. Thus, only the photo interrupter 554*a* outputs "L", and the photo interrupters 554*a* and 554*b* output "H".

When the mode switching switch 510 is rotated to the central position on the plan view (refer to FIG. 24C), the central light shielding unit 516*b* optically shields the central photo interrupter 554*b*. Thus, the photo interrupters 554*a* and 554*c* output "L", and only the photo interrupter 554*b* outputs "H".

When the mode switching switch 510 is rotated to the second position from the right side on the plan view (refer to FIG. 24D), the light shielding unit 516*a* optically shields the photo interrupter 554*a*, and the light shielding unit 516*c* optically shields the central photo interrupter 554*b*. Thus, the photo interrupters 554*a* and 554*b* output "H", and only the photo interrupter 554*c* outputs "L".

When the mode switching switch 510 is rotated to the rightmost position on the plan view (refer to FIG. 24E), the central light shielding unit 516*b* optically shields the photo interrupter 554*a*. Thus, only the photo interrupter 554*a* outputs "H", and the photo interrupters 554*b* and 554*c* output "L".

As mentioned above, at the five rotation positions of the mode switching switch 510, the combinations of the signals "H" or "L" outputted by the three photo interrupters 554 are all different. Thus, by examining the combination of the output signals, the rotation position can be detected. The combination of the output signals is judged by using a control circuit installed on the substrate 550 and the like.

By the way, in the operating device 500 according to this embodiment, the distance between the centers of the light shielding units 516*a* to 516*c* adjacent to each other is assumed to be half the distance between the centers of the photo interrupters 554*a* to 554*c* adjacent to each other. However, it is not limited thereto. For example, the interval between the light shielding units 516*a* to 516*c* adjacent to each other and the interval between the photo interrupters 554*a* to 554*c* adjacent to each other may be configured to be equal. In this configuration, when the mode switching switch 510 is rotated to the central position (corresponding to FIG. 24C), the three light shielding units 516*a* to 516*c* are configured to optically shield the three photo interrupters 554*a* to 554*c*, respectively. Also, when the mode switching switch 510 is rotated to the rightmost position (corresponding to FIG. 24E), one light shielding unit 516*a* is configured to optically shield one photo interrupter 554*c*. Consequently, the five rotation positions of the mode switching switch 510 can be detected on the basis of the combination of the output signals of the three photo interrupters 554*a* to 554*c*.

Figure 26:
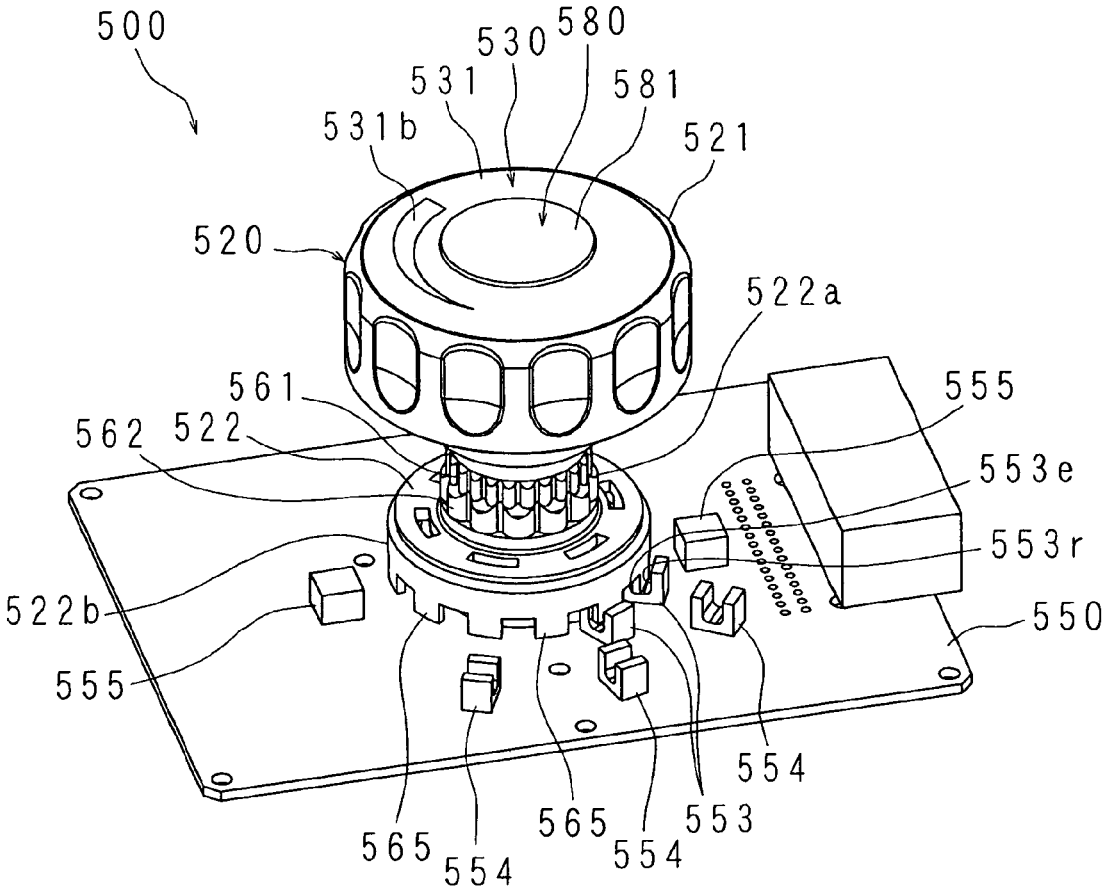
FIG. 26 is a perspective view showing the operating device in which the illustrations of the enclosure, the mode switching switch, a base cylinder and the engaged member and the like are omitted.
Figure 27A:
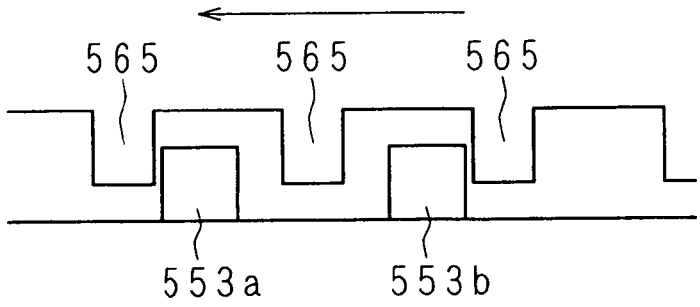
FIGS. 27A to 27E are diagrammatic views describing a method of detecting a rotation of a dial switch.
Figure 27B:
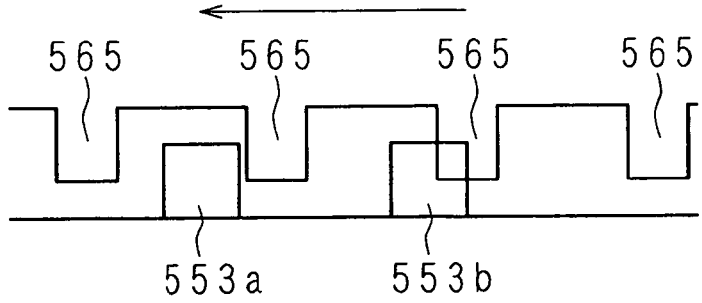
Figure 27C:
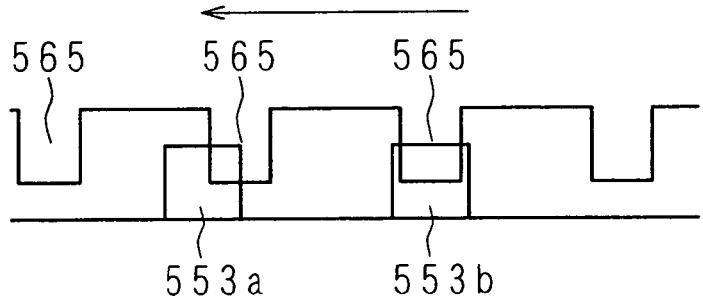
Figure 27D:
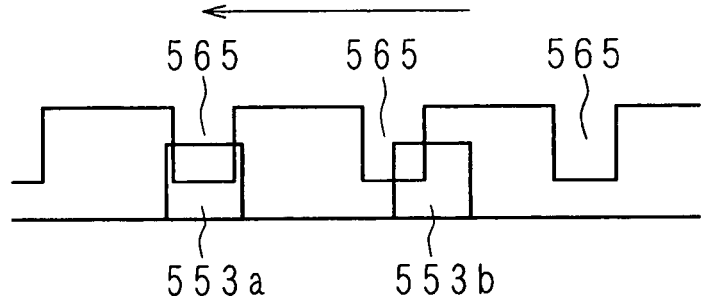
Figure 27E:
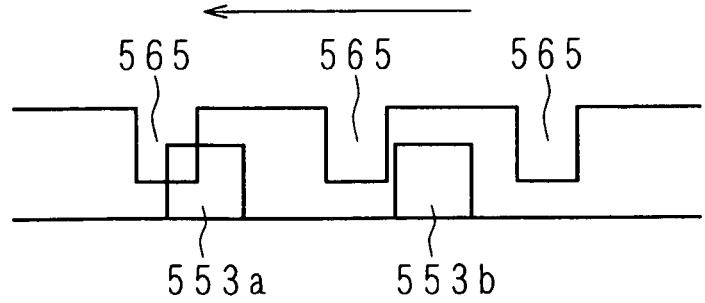
Figure 28A:
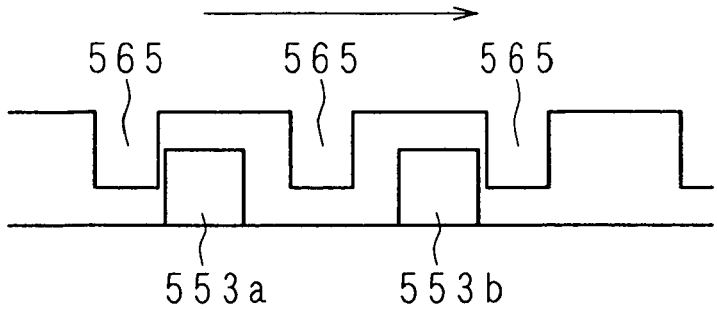
FIGS. 28A to 28E are the diagrammatic views describing the method of detecting the rotation of the dial switch.
Figure 28B:
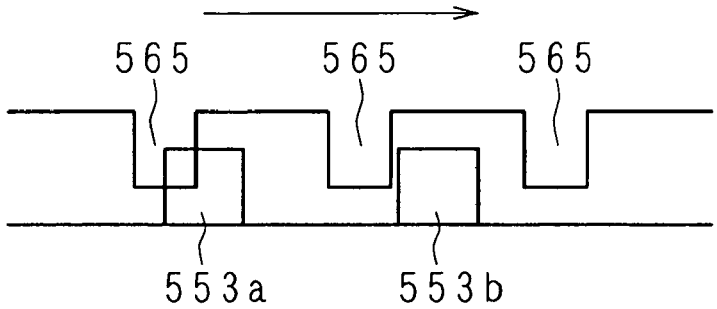
Figure 28C:
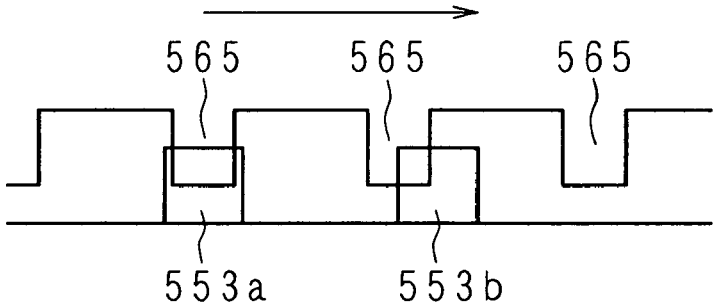
Figure 28D:
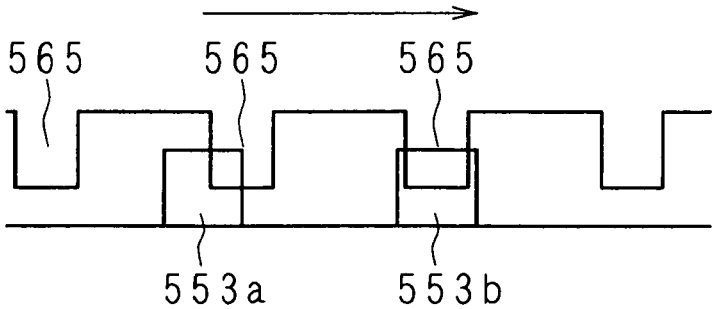
Figure 28E:
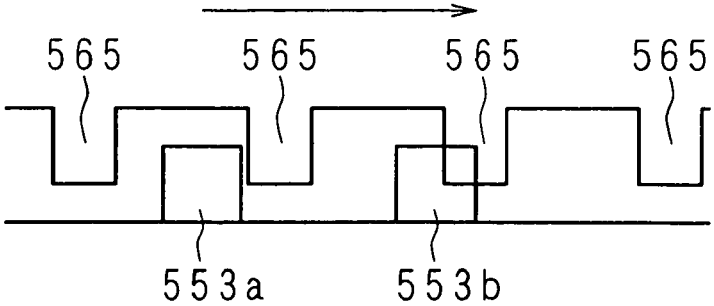

FIG. 26 is the perspective view showing the operating device 500 in which the illustrations of the enclosure 501, the mode switching switch 510, the base cylinder 570, the engaged member 540 and the like are omitted. The two photo interrupters 553 mounted on the substrate 550 are aligned at an equal interval in the circumferential direction, around the lower shaft 533 of the fixed shaft 530 fixed to the substrate 550 and inside the base cylinder 570 fixed to the substrate 550. The photo interrupter 553 is configured similarly to the photo interrupter 554 and the photo interrupter 553 can detect light shielding on the basis of whether or not the light receiving unit 553*r* can receive the light from the light emitting unit 553*e*, and then outputs the "H" signal if the light is shielded, and outputs the "L" signal if the light is not shielded.

The plurality of light shielding units 565 of the dial switch 520 are placed so as to further downwardly extend from the bottom end of the large diameter cylindrical portion 522*b* of the rotation shaft 522, at the equal interval along the circumferential direction of the large diameter cylindrical portion 522*b*. The plurality of light shielding units 565 are passed and rotated between the light emitting unit and the light receiving unit of the photo interrupter 553 placed on the substrate 550, in association with the rotation of the dial switch 520.

Also, the interval between the light shielding units 565 adjacent to each other in the dial switch 520 is narrower than the interval between the two photo interrupters 553 on the substrate 550. For example, the interval between the light shielding units 565 can be set to be about ¾ of the interval between the photo interrupters 553.

Figure 29A:
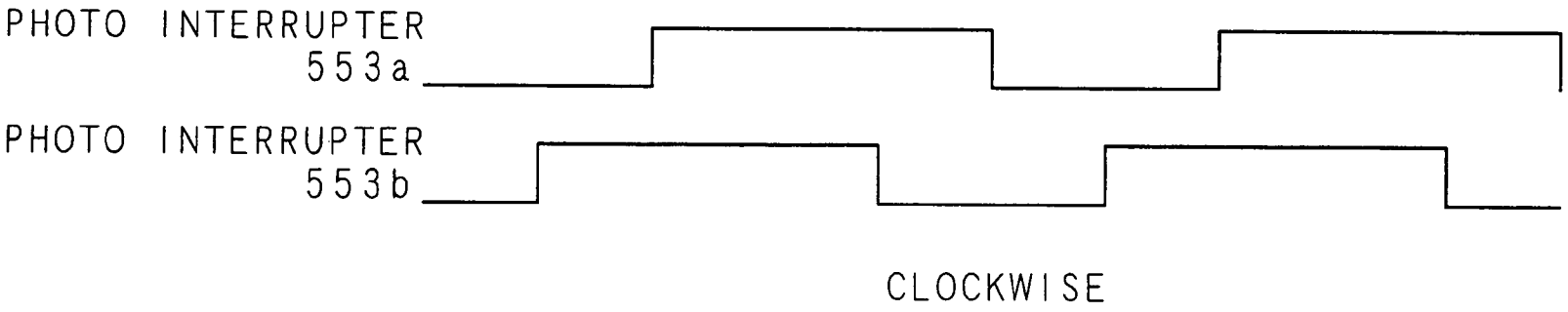
FIGS. 29A and 29B are the diagrammatic views describing the method of detecting the rotation of the dial switch.
Figure 29B:
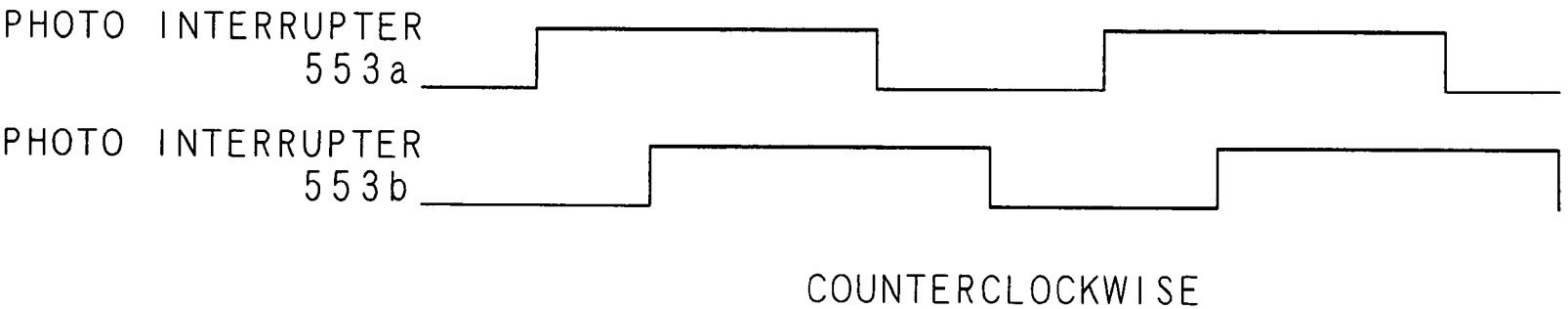

FIGS. 27A to 27E, FIGS. 28A to 28E, and FIGS. 29A and 29B are the diagrammatic views describing the method of detecting the rotation of the dial switch 520. FIGS. 27A to 27E show the states of the light shielding unit 565 and the photo interrupter 553 when the dial switch 520 is clockwise rotated in time series in the order of FIG. 27A to FIG. 27E. FIGS. 28A to 28E show the states of the light shielding unit 565 and the photo interrupter 553 when the dial switch 520 is counterclockwise rotated in time series in the order of FIG. 28A to FIG. 28E. Also, FIGS. 29A and 29B show the output signals of the two photo interrupters 553. FIG. 29A shows the case when the dial switch 520 is clockwise rotated, and FIG. 29B shows the case when the dial switch 520 is counterclockwise rotated. By the way, FIGS. 27A to 27E, FIGS. 28A to 28E, and FIGS. 29A and 29B, the two photo interrupters 553 are classified as 553*a* and 553*b*, respectively.

When the dial switch 520 is clockwise rotated from the state in which both of the two photo interrupters 553*a*, 553*b* are not optically shielded, at first, the photo interrupter 553*b* is optically shielded, and after that, the photo interrupter 553*a* is optically shielded (refer to FIG. 27A to FIG. 27E).

On the contrary, when the dial switch 520 is counterclockwise rotated from the state in which both of the two photo interrupters 553*a*, 553*b* are not optically shielded, at first, the photo interrupter 553*a* is optically shielded, and after that, the photo interrupter 553*b* is optically shielded (refer to FIG. 28A to FIG. 28E).

Thus, in a case of comparing the signals outputted by the two photo interrupters 553*a*, 553*b*, when the dial switch 520 is clockwise rotated (refer to FIG. 29A), at first, the signal outputted by the photo interrupter 553*b* is changed to "H", and after that, the signal outputted by the photo interrupter 553*a* is changed to "H". On the contrary, when the dial switch 520 is counterclockwise rotated (refer to FIG. 29B), at first, the signal outputted by the photo interrupter 553*a* is changed to "H", and after that, the signal outputted by the photo interrupter 553*b* is changed to "H".

From the foregoing descriptions, by examining the timing when the signals outputted by the two photo interrupters 553 are changed from "L" to "H" (or from "H" to "L"), it is possible to detect the rotation direction of the dial switch 520. Also, by examining the interval between the changes in the signals outputted by the photo interrupters 553, it is also possible to detect the rotation speed of the dial switch 520. The timings of the changes, the interval between the changes and the like in the output signals from the two photo interrupters 553 are judged by using the control circuit installed on the substrate 550 and the like.

The operating device 500 according to the fifth embodiment having the foregoing configuration is configured such that the light shielding by the plurality of light shielding units 565, which are placed over the one circumference at the bottom end of the rotation shaft 522 in the dial switch 520, are detected by the two photo interrupters 553, and the rotation direction and rotation amount of the dial switch 520 are detected on the basis of the timings of the light shielding detected by the two photo interrupters 553. Thus, the means for detecting the rotation can be attained in the small size and the low cost, as compared with the case in which the rotation is detected by using the rotary encoder 51 such as the operating device according to the first embodiment. Hence, it is possible to attain the smaller size and the lower cost of the operating device 500, and it is also possible to reserve the space for installing the press detecting switch 552 for the push switch 580 and the LED 551 for the light emission and the like on the substrate 550.

Also, the operating device 500 is configured such that the light shielding by the three light shielding units 516 that are placed at the bottom end of the cylinder unit 512 in the mode switching switch 510 are detected by the three photo interrupters 554, and the rotation position of the mode switching switch 510 is detected on the basis of the combination of the detection results of the light shielding by the three photo interrupters. Thus, even if there are the many rotation positions rotated by the mode switching switch 510, the rotation position can be easily detected without any increase in the size of the operating device 500. Thus, it is possible to easily attain the further increase in the number of the functions of the operating device 500. Also, the photo interrupters 553, 554 can detect without any contact with the moving part. Hence, there is no fear of the occurrence of the trouble caused by abrasion and the like, and it is possible to improve the reliability of the mechanism for detecting.

Also, the operating device 500 is configured such that the push switch 580 for receiving the pressing operation is comprised, and the pressing bar 583 of the push switch 580 is inserted through the fixed shaft 530 (namely, the dial switch 520) and presses the press detecting switch 552 of the substrate 550. Thus, without any increase in the size of the operating device 500, the pressing operation by the user can be received by the operating device 500. Hence, the increase in the number of the functions of the operating device 500 can be attained, thereby improving the operability.

Also, the operating device 500 is configured such that the light emitted by the LED 551 placed on the substrate 550 is guided through the light guide member 585, which is placed inside the fixed shaft 530, into the cover unit 531 of the fixed shaft 530 provided inside the operating unit 521 in the dial switch 520, and the light is emitted from the light-transmitting unit 531*b* provided in the cover unit 531 to the outside. Thus, the visual effect of the light emitted by the operating device 500 can be given, thereby increasing the fine sight of the operating device 500 and also increasing the operability of the operating device 500 at night and the like.

By the way, the fifth embodiment is configured such that the operating device 500 comprises the enclosure 501. However, this is not limited thereto. This may be configured such that the enclosure 501 is not comprised, and for example, the instrument panel of the vehicle is used as the enclosure. Also, this is configured such that the light emitted by the LED 551 is radiated from the light-transmitting unit 531*b*, which is placed in the cover unit 531 of the fixed shaft 530, to the outside. However, this is not limited thereto. This may be configured such that the light is further guided from the cover unit 531 of the fixed shaft 530 to the dial switch 520 or push switch 580 or the like, and the light-transmitting unit is placed thereon, and the light is emitted. Also, this is configured such that the mode switching switch 510 can be swung. However, this is not limited thereto. This may be configured such that the mode switching switch 510 cannot be swung and only the rotational operation is received.

By the way, the first to fifth embodiments are configured such that the click feeling is changed in accordance with the change in the click number in association with the rotational operation. However, they are not limited thereto. The click feeling may be changed, for example, in accordance with the change in the hardness of the click (the force required to make the engaged unit get over one concave and convex by the rotation of the dial switch and move it to the next concave and convex). In this case, the numbers of the concaves and convexes of the respective click surface may be equal, and the shape (height and the like) of the concave and convex of each click surface may be changed. Also, this may be configured such that the click interval is varied in the same mode, and by changing the variation degree of the click interval between the different modes, the click feeling between the modes may be changed. In this case, for example, as for the first click surface, the interval between the concave and the convex is set such that the click interval is gradually wide when the dial switch is rotated in the right direction, and as for the second click surface, the interval between the concave and the convex is set such that the click interval is gradually wide when the dial switch is rotated in the left direction. Consequently, even if the numbers of the concaves and the convexes are equal, by setting the interval between the concave and the convex suitable, the click feeling can be changed in association with the mode change. In this way, the fact that the click feeling can be changed by suitably changing the shapes of the concave and the convex as well as the numbers of the concaves and the convexes for the plurality click surfaces is evident from the disclosure of the present invention.

Sixth Embodiment

Figure 30:
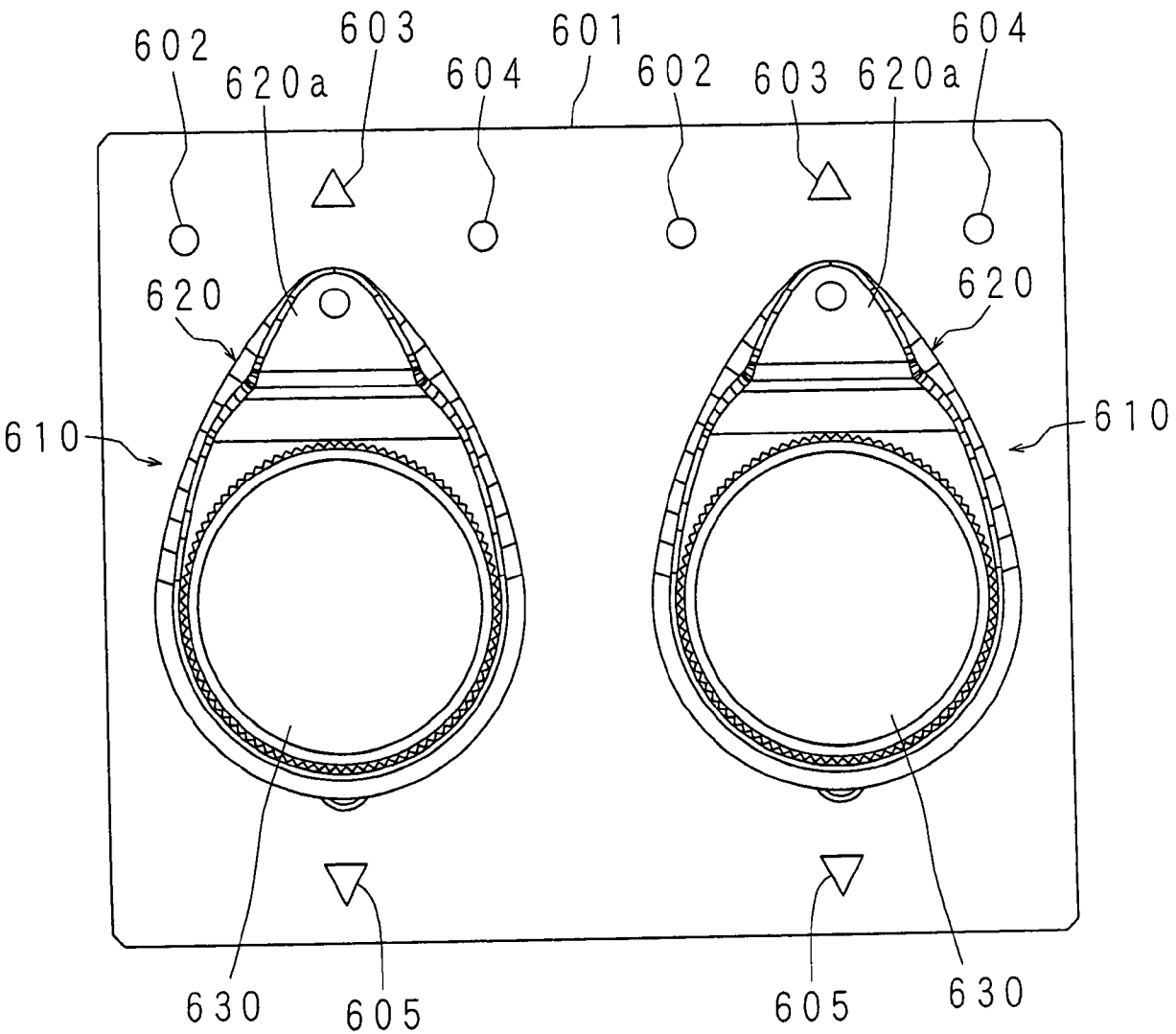
FIG. 30 is a diagrammatic plan view showing a configuration of an operating system according to a sixth embodiment of the present invention.

FIG. 30 is the diagrammatic plan view showing the configuration of the operating system according to the sixth embodiment of the present invention. In FIG. 30, 601 indicates (a part of) an outer portion of the instrument panel of the vehicle. The operating system according to this embodiment comprises plural (two) operating devices 610 that are aligned on the outer portion 601. The operating device 610 has the outer appearance in which a mode switching switch 620 (first rotation operation body) and a dial switch 630 (second rotation operation body) are stacked on the outer portion 601. The mode switching switch 620 has the shape of an approximately oval plate on the plan view, and is placed on the outer portion 601. The mode switching switch 620 is configured so that the user can carry out the rotational operation in a range of about 60°. The dial switch 630 is disc-shaped and placed on the upper side of the mode switching switch 620. The dial switch 630 is configured so that the user can carry out the rotational operation in a range of 360° or more, clockwise or counterclockwise. By the way, the dial switch 630 and the mode switching switch 620 are coaxially placed. That is, the rotation axis of the dial switch 630 and the rotation axis of the mode switching switch 620 coincide with each other.

On the outer portion 601, four operational marks 602 to 605 are drawn around each operating device 610. The operational marks 602 to 604 indicate the respective modes switched by the mode switching switch 620. Then, the switching between the modes can be executed when the mode switching switch 620 is rotationally operated so that a tapered tip portion 620*a* of the mode switching switch 620 indicates one of the three operational marks 602 to 604. The operational mark 602 is drawn at one end position of the rotation range of the mode switching switch 620, the operational mark 604 is drawn on the other end position of the rotation range, and the operational mark 603 is drawn at the position between the operational mark 602 and the operational mark 604.

For example, when the operating device 610 is intended to operate the air conditioner of the vehicle, the character string of "Wind Direction" is assigned as the operational mark 602, and a character string of "Wind Quantity" is assigned as the operational mark 603, and a character string of "Temperature" is assigned as the operational mark 604. When the rotational operation is executed such that the tip portion 620*a* of the mode switching switch 620 indicates "Wind Direction", the operating device 610 enters the mode of adjusting the wind direction of the air conditioner. Then, the user can adjust the wind direction of the air conditioner by rotationally operating the dial switch 630. The other modes are similar.

Also, although the detail will be described later, the mode switching switch 620 of the operating device 610 can be swung between the side of the tip portion 620*a* and the side opposite to the tip portion 620*a*. The operational marks 603 and 605 indicate the swinging position of the mode switching switch 620, and they are drawn on the sides opposite to each other, with the mode switching switch 620 therebetween. The operating device 610 is configured such that, when the tip portion 620*a* of the mode switching switch 620 is located at the position of indicating the operational mark 603, the mode switching switch 620 can be swung to the side of the operational mark 603 or the side of the operational mark 605. For example, it is possible to receive the operation, such as the selection of the menu represented on a display inside the vehicle and the like.

Figure 31:
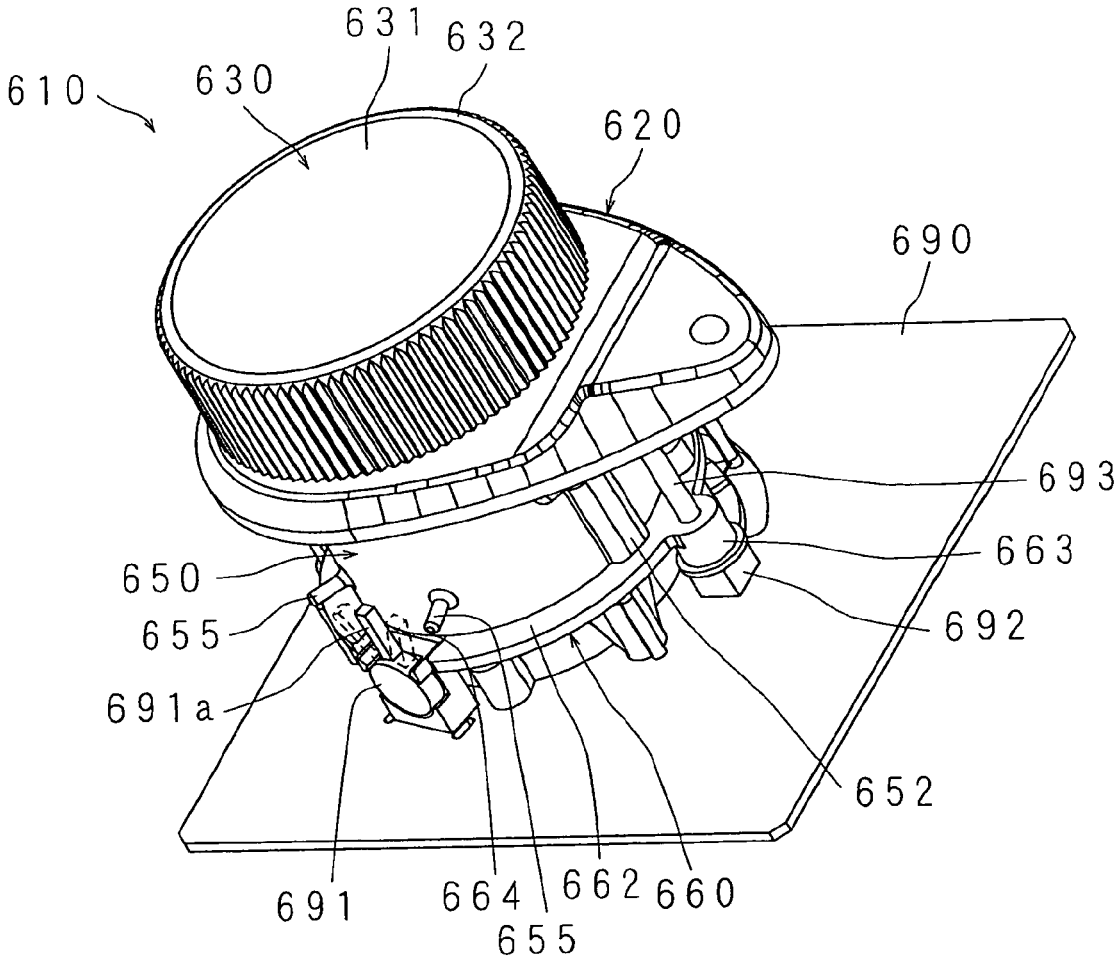
FIG. 31 is a perspective view showing a configuration of an operating device according to the sixth embodiment of the present invention.
Figure 32:
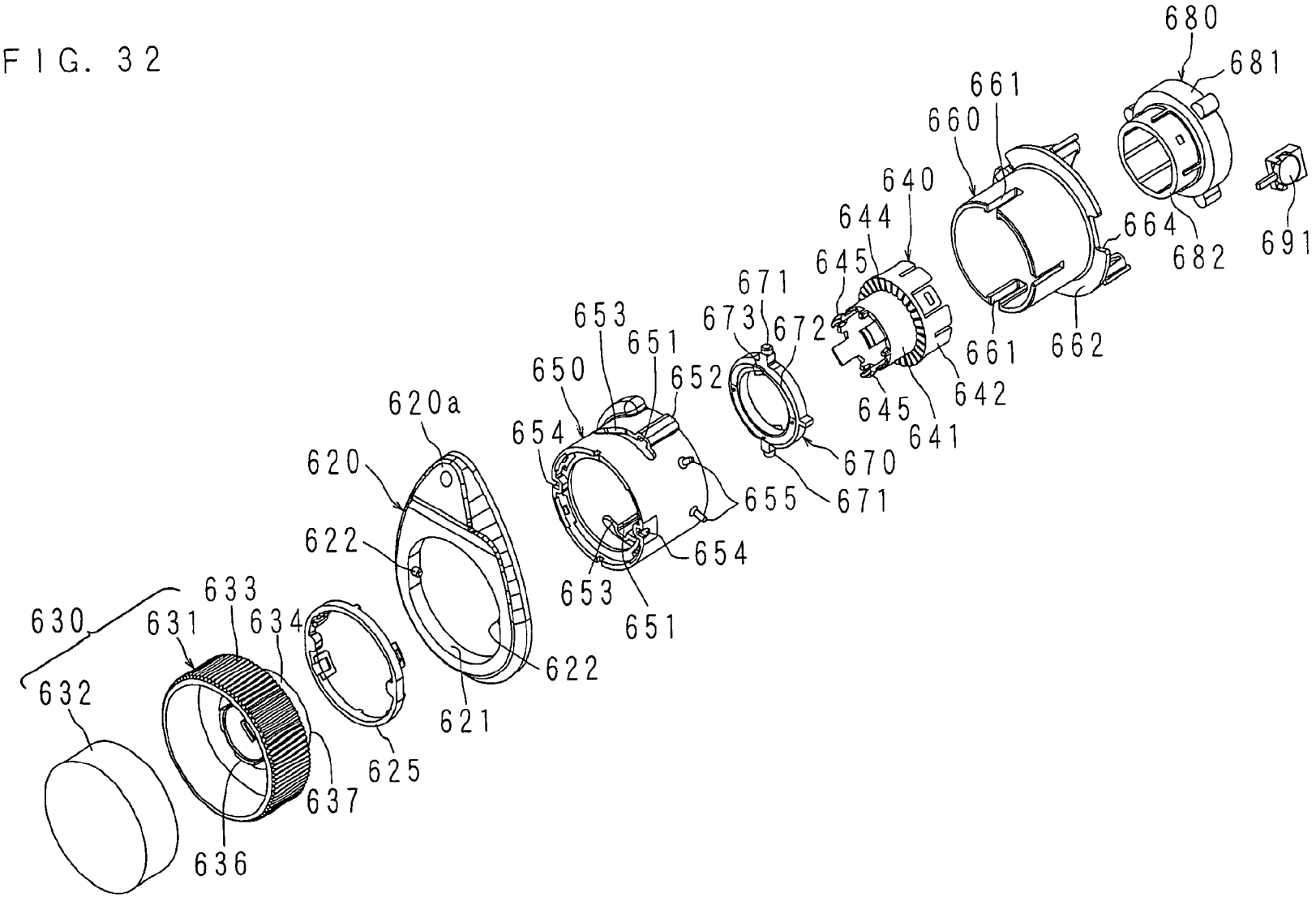
FIG. 32 is an exploded perspective view showing configurations of respective parts of the operating device according to the sixth embodiment of the present invention.
Figure 33:
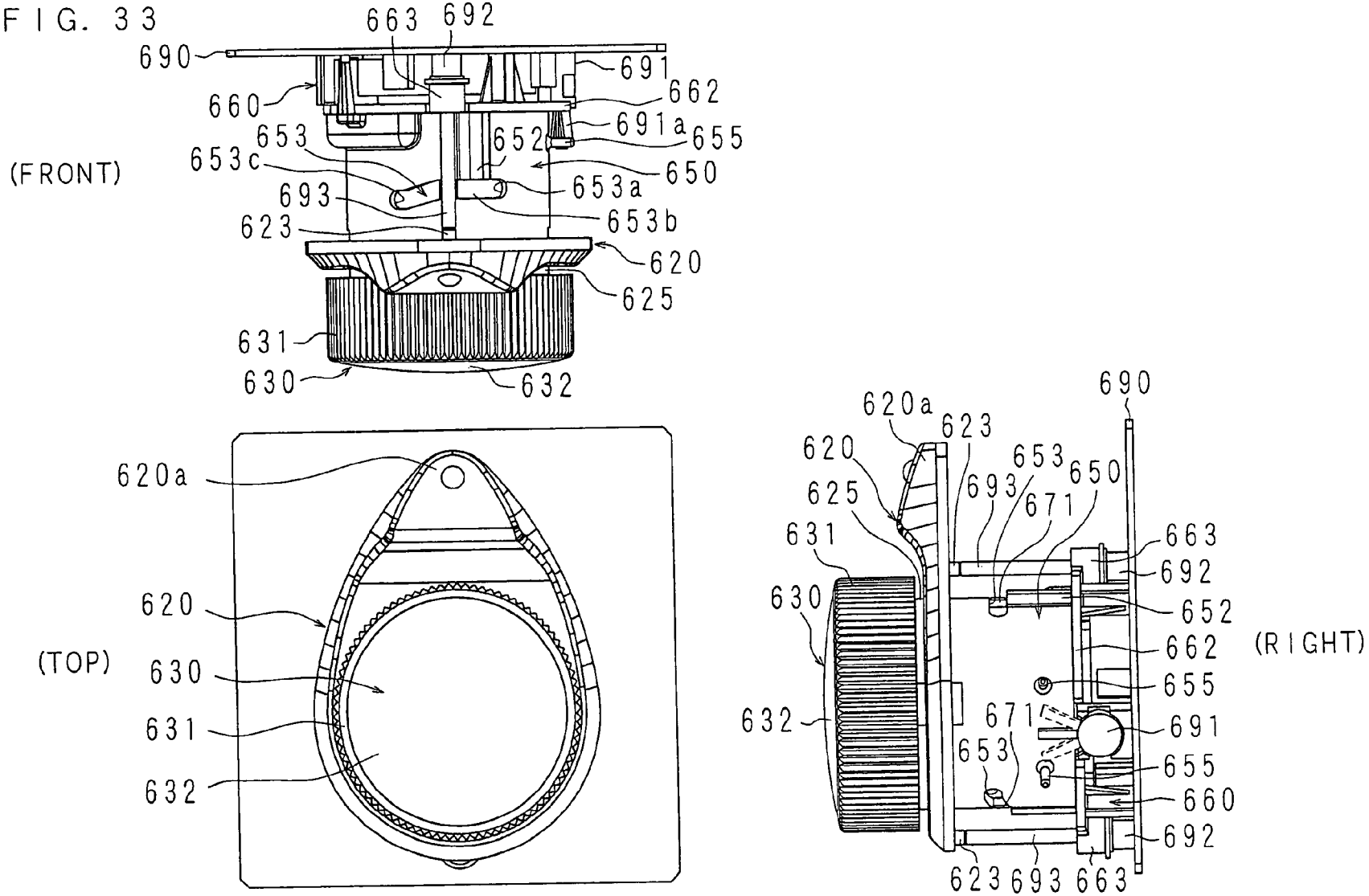
FIG. 33 is a trihedral view showing the configuration of the operating device according to the sixth embodiment of the present invention.
Figure 34:
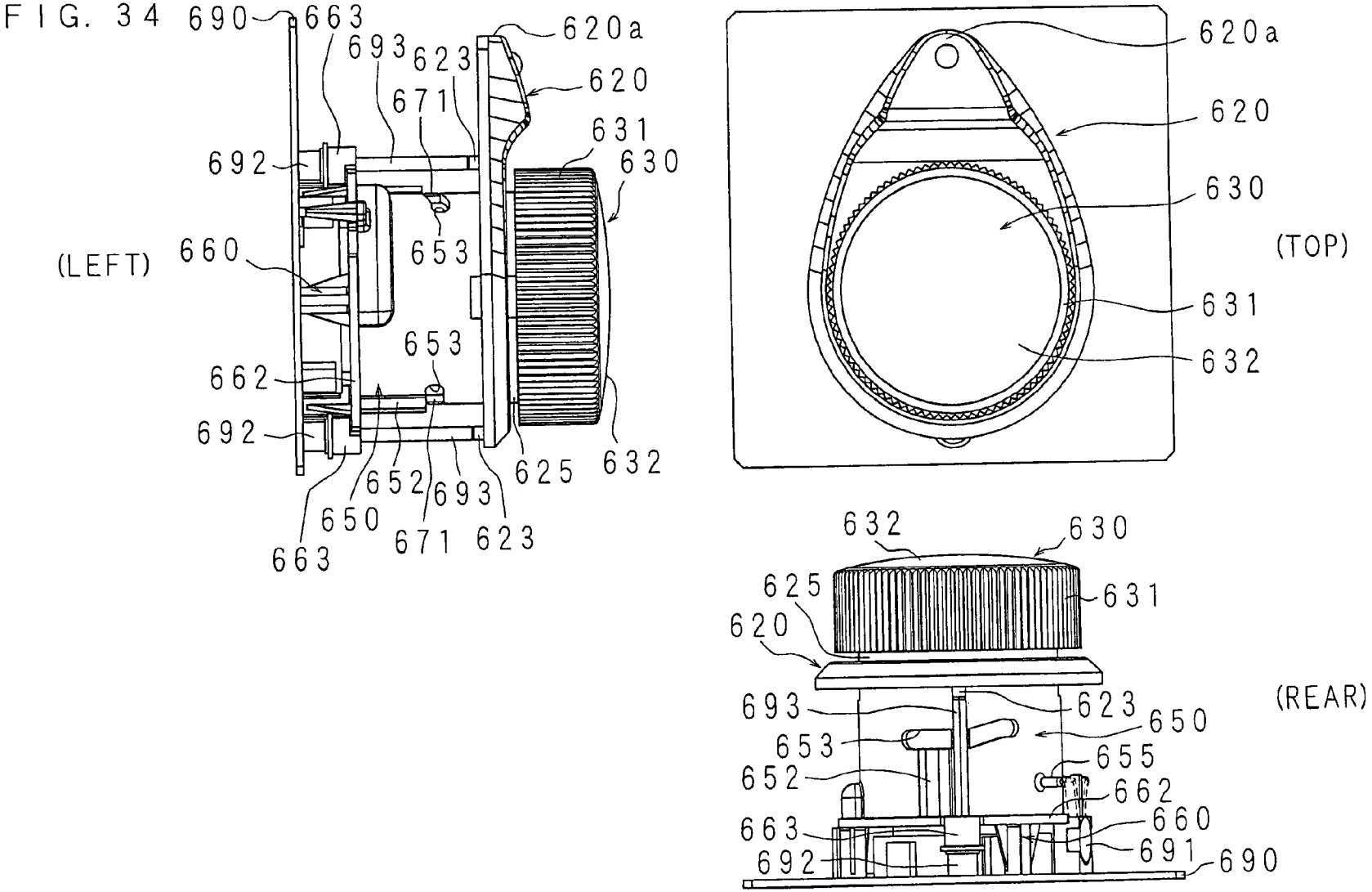
FIG. 34 is a trihedral view showing the configuration of the operating device according to the sixth embodiment of the present invention.
Figure 35:
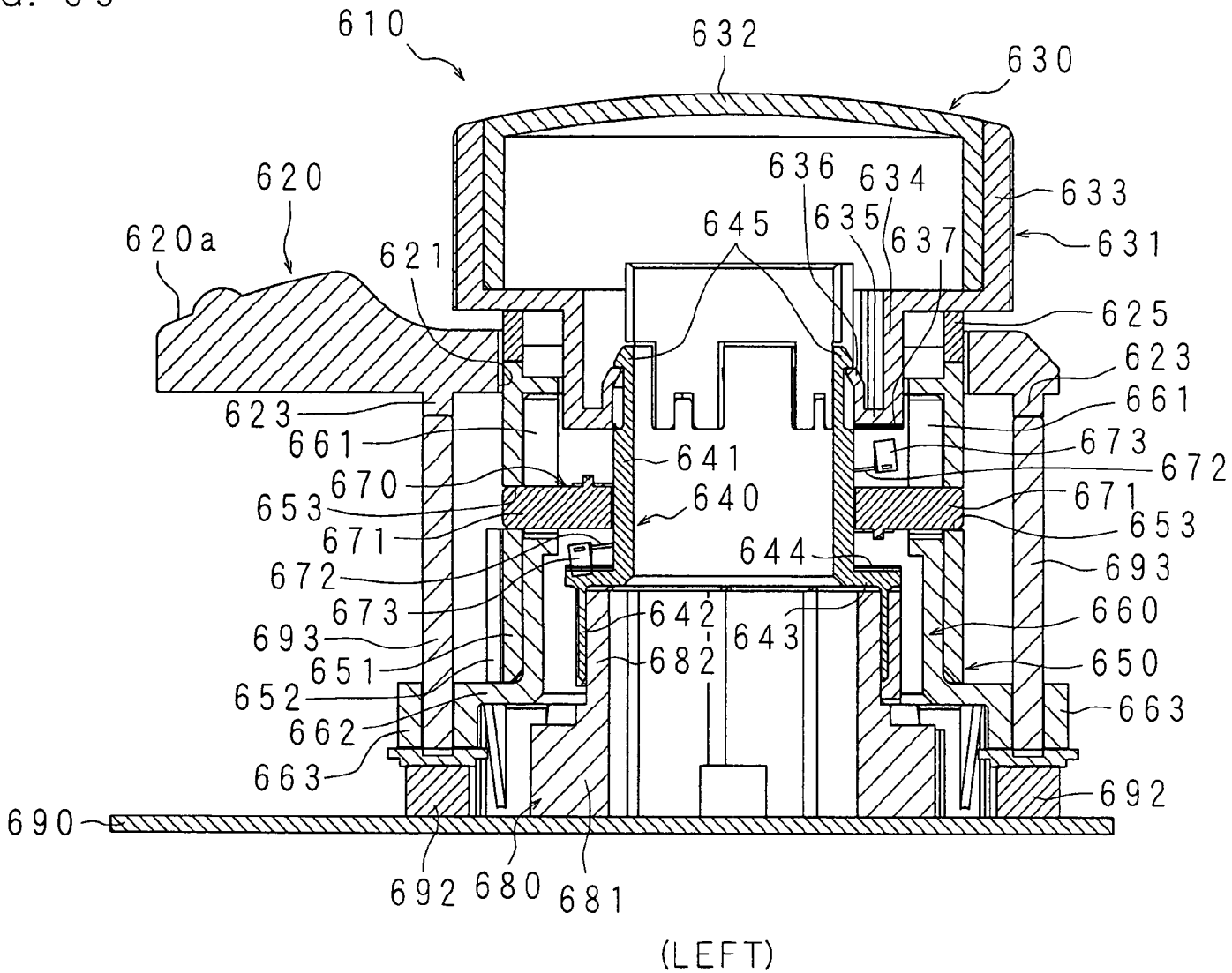
FIG. 35 is a sectional view of the operating device according to the sixth embodiment of the present invention.
Figure 36:
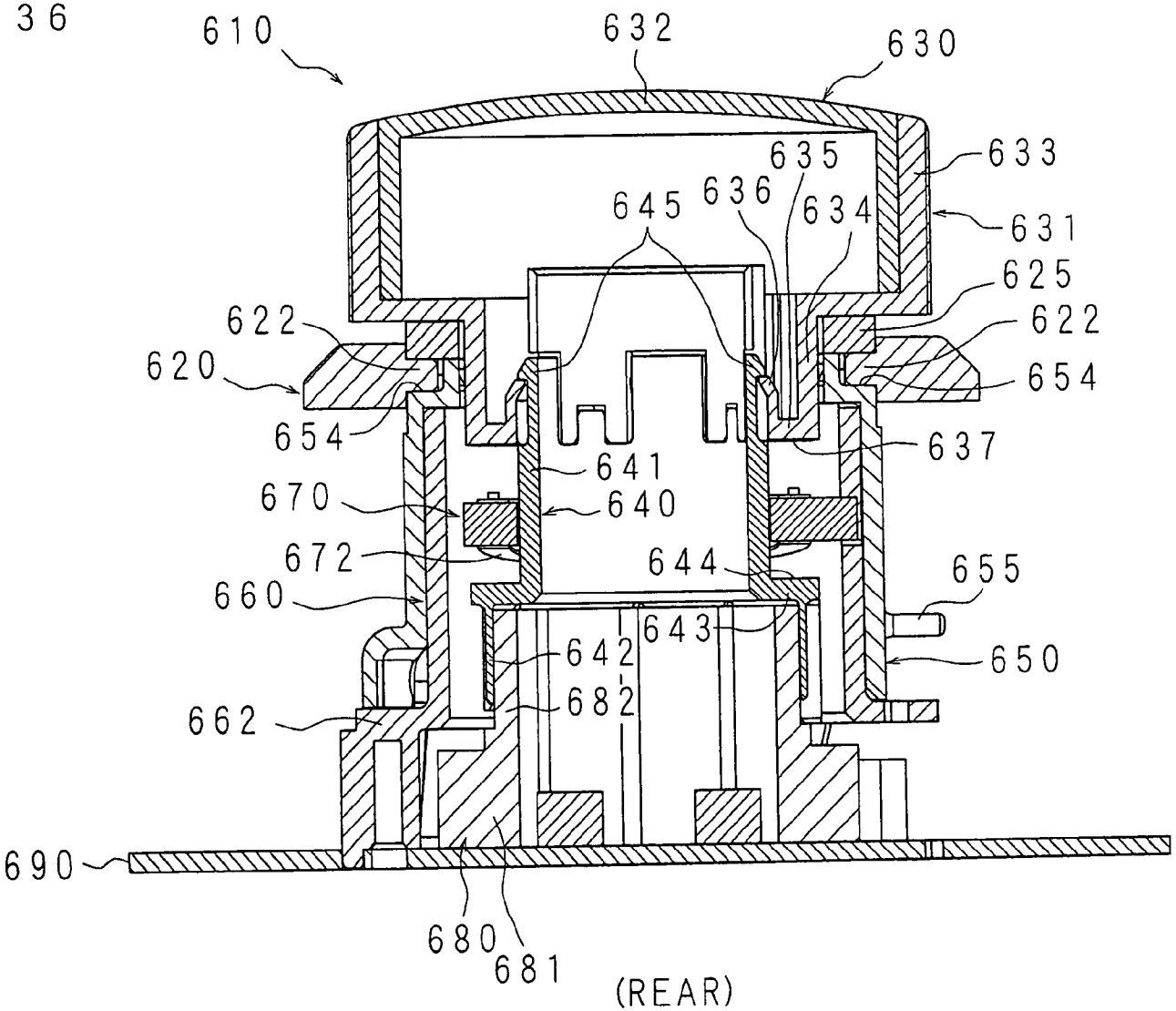
FIG. 36 is a sectional view of the operating device according to the sixth embodiment of the present invention.
Figure 37:
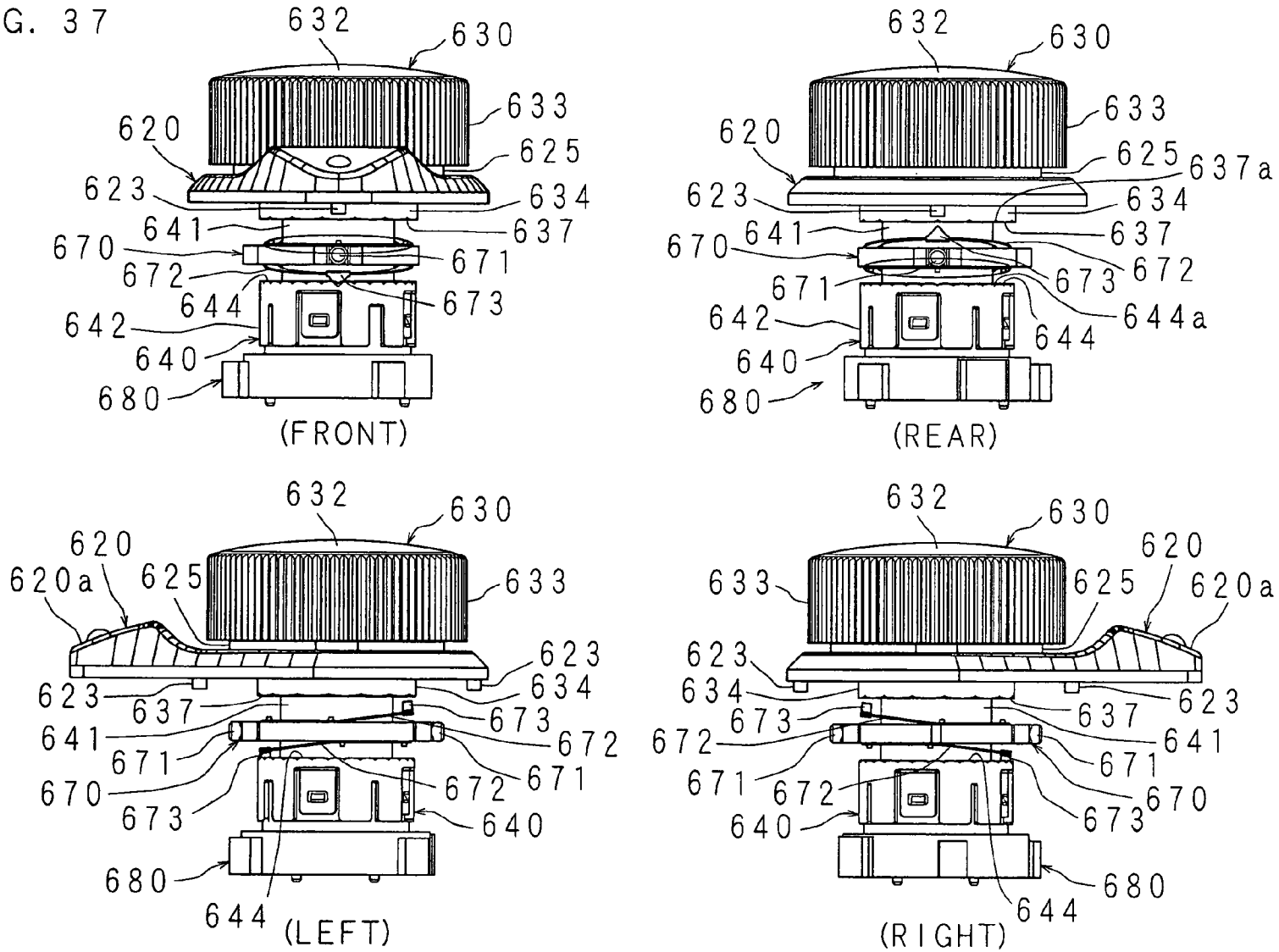
FIG. 37 is an inner configuration view of the operating device according to the sixth embodiment of the present invention.

FIG. 31 is the perspective view showing the configuration of the operating device 610 according to the sixth embodiment of the present invention. FIG. 32 is the exploded perspective view showing the configurations of the respective parts in the operating device 610 according to the sixth embodiment of the present invention. FIG. 33 and FIG. 34 are the trihedral views showing the configuration of the operating device 610 according to the sixth embodiment of the present invention. FIG. 33 shows the front view, top view and right side view of the operating device 610. FIG. 34 shows the left side view, top view and rear view of the operating device 610. FIG. 35 and FIG. 36 are the sectional views of the operating device 610 according to the sixth embodiment of the present invention. FIG. 35 shows the left section of the operating device 610, and FIG. 36 shows the rear section. FIG. 37 is the inner configuration view of the operating device 610 according to the sixth embodiment of the present invention and shows the configurations of the inner parts when the outer parts of the operating device 610 are removed and then shows the front view, rear view, left side view and right side view of the operating device 610. By the way, FIG. 31 to FIG. 37 show the configuration of only one operating device 610 comprised by the operating system. Since the other operating devices 610 are similarly configured, their illustrations are omitted. Also, the illustration of the outer portion 601 of the instrument panel is omitted. Also, in the following descriptions, the upper and lower direction is defined as the rotation axis directions of the mode switching switch 620 and the dial switch 630. Then, the side of the dial switch 630 is defined as the upper side, and the side of the mode switching switch 620 is defined as the lower side. The front and rear direction is defined as the swinging direction of the mode switching switch 620, namely, the direction in which the operational marks 603 and 605 shown in FIG. 30 are aligned. Then, the side of the operational mark 603 is defined as the front side, and the side of the operational mark 605 is defined as the rear side. The right and left direction is defined as the direction orthogonal to the upper and lower direction and the front and rear direction as mentioned above. Then, the side of the operational mark 602 is defined as the left direction, and the side of the operational mark 604 is defined as the right direction.

The many parts such as the dial switch 630, the mode switching switch 620 and the like, which configure the operating device 610 according to the sixth embodiment of the present invention, are assembled and placed on a substrate 690. On the substrate 690, a rotary encoder 680 (rotation detecting means) for detecting the rotation of the dial switch 630, a switching switch 691 for detecting the switching between the modes through the rotation of the mode switching switch 620, and two tact switches 692 (swinging detection means) for detecting the swinging of the mode switching switch 620 are placed together with the other electric parts (not shown). The rotary encoder 680 is placed coaxially with the dial switch 630, and the switching switch 691 is placed on the right side of the operating device 610, and the tact switches 692 are placed on the front and rear sides of the operating device 610. On the substrate 690, the electric circuit is provided with the rotary encoder 680, the switching switch 691, the tact switches 692 and the other electric parts. Then, the operation of the user given to the operating device 610 is converted into an electric signal so that the various processes can be carried out.

The rotary encoder 680 is cylindrical and fixedly connected to the substrate 690 by screwing, soldering and the like, mechanically and electrically. The rotary encoder 680 has: a fixed unit 681 fixed to the substrate 690; and a rotator 682 for detecting the rotation. The rotator 682 whose outer diameter is small is placed on the upper side of the fixed unit 681 whose outer diameter is great. The rotary encoder 680 outputs a pulse signal corresponding to the rotation of the rotator 682.

Also, a cylindrical dial shaft 640 (rotation shaft), which is linked to the dial switch 630, is externally engaged with and fixed to the rotator 682 of the rotary encoder 680. The dial shaft 640 is configured such that a small cylindrical portion 641 whose outer diameter is small and a large cylindrical portion 642 whose outer diameter is large are concentrically linked, and the large cylindrical portion 642 of the dial shaft 640 is externally engaged with the rotator 682 of the rotary encoder 680. Also, a linking portion 643 (one of two parts) for linking the small cylindrical portion 641 and the large cylindrical portion 642 of the dial shaft 640 has an annular flat shape that is substantially vertical to the axial center of the dial shaft 640. A first click surface 644 (engaging unit) in which concaves 644*a* or convexes are formed at a predetermined interval over one circumference is provided on the linking portion 643. A plurality of fixing nails 645 for fixing the dial shaft 640 to the dial switch 630 are extendedly placed at the end of the small cylindrical portion 641 in the dial shaft 640. Then, the dial switch 630 and the dial shaft 640 are integrally rotated by engaging the fixing nails 645 with the dial switch 630 and fixing it.

The dial switch 630 is provided with a cylindrical outer cylinder 631 and a circular cylindrical cap 632 that is accommodated in and fixed to this outer cylinder 631. The outer cylinder 631 of the dial switch 630 is configured such that a large cylindrical portion 633 whose outer diameter is great and a small cylindrical portion 634 whose outer diameter is small are concentrically linked, and the cap 632 is accommodated in and fixed to the large cylindrical portion 633 of the outer cylinder 631. The large cylindrical portion 633 and the cap 632 are the portions exposed to the outside, in order for the user to touch them and carry out the operation. In order to make the execution of the rotational operation easy, the many concaves and convexes are formed on the outer circumferential surface of the large cylindrical portion 633, and the concaves and the convexes are intended to stop the sliding.

An annular flat end surface portion 635 (one of two parts) is provided at the end of the small cylindrical portion 634 of the dial switch 630, and the fixing nail 645 of the dial shaft 640 is inserted into the approximately circular opening formed on the center of the end surface portion 635. Then, the dial switch 630 and the dial shaft 640 are linked and fixed. For this reason, a nail receiver 636 that is engaged with the fixing nail 645 is provided on the inner edge of the opening of the end surface portion 635. With the engagement between the fixing nail 645 and the nail receiver 636, the dial switch 630 and the dial shaft 640 are immovably fixed. Thus, since the dial switch 630, the dial shaft 640 and the rotator 682 of the rotary encoder 680 are connected and fixed, the rotational operation which is performed on the dial switch 630 by the user can be detected through the dial shaft 640 by the rotary encoder 680. That is, the dial shaft 640 functions as the rotation shaft of the dial switch 630.

A second click surface 637 (engaging unit) in which the concaves 637*a* or convexes are formed at a predetermined interval over one circumference is provided on the outer side of the end surface portion 635 provided on the small cylindrical portion 634 in the dial switch 630. When the dial switch 630 and the dial shaft 640 are linked and fixed, the end surface portion 635 of the dial switch 630 and the linking portion 643 of the dial shaft 640 are opposite to each other, and the second click surface 637 of the end surface portion 635 and the first click surface 644 of the linking portion 643 are opposite to each other. On the first click surface 644 and the second click surface 637, the plurality of concaves or convexes are formed at the predetermined interval over the one circumference. However, the number of the concaves or convexes formed on the first click surface 644 and the number of the concaves or convexes formed on the second click surface 637 are different. For example, on the first click surface 644, 60 concaves or convexes are formed over the one circumference, and on the second click surface 637, 30 concaves or convexes are formed over the one circumference.

Also, the operating device 610 comprises a click number change member 670 (moving body) that is an annular plate material and has an approximately circular opening through which the small cylindrical portion 641 of the dial shaft 640 can be inserted. The click number change member 670 is inserted through the small cylindrical portion 641 of the dial shaft 640, before the dial switch 630 and the dial shaft 640 are linked, when the operating device 610 is assembled. The click number change member 670 is sufficiently shorter than the length of the small cylindrical portion 641 of the dial shaft 640 with respect to the axial direction, and the click number change member 670 can be slid and moved in the axial direction between the end surface portion 635 of the dial switch 630 and the linking portion 643 of the dial shaft 640, in the state that it is inserted through the small cylindrical portion 641.

On the outer surface of the click number change member 670, two round-bar-shaped support shafts 671 (inserted unit) are placed on the positions opposite to each other on the outer surface so that they protrude from the outer surface in the radial direction. The click number change member 670 is configured not to be rotated in the circumferential direction although it can be supported by the support shafts 671 and moved in the axial direction.

Also, on the click number change member 670, plate springs 672 are placed on the end surface of one side in the axial direction and the end surface of the other side, respectively. The plate spring 672 is the metallic plate member that is arc-shaped (the arc is about half the end surface of the click number change member 670). Both end portions are fixed to the end surfaces of the click number change member 670, respectively, and a wedge-shaped nail 673 (engaged unit) is fixed to the central portion, and the nail 673 is biased in the direction that is separated from the end surface. The biasing forces of the plate spring 672 on the one side and the plate spring 672 on the other side are substantially equal. However, as shown in FIG. 30, when the operating system has the two operating devices 610, the different biasing forces are applied to the plate springs 672 of the respective operating devices 610, respectively.

Figure 38A:
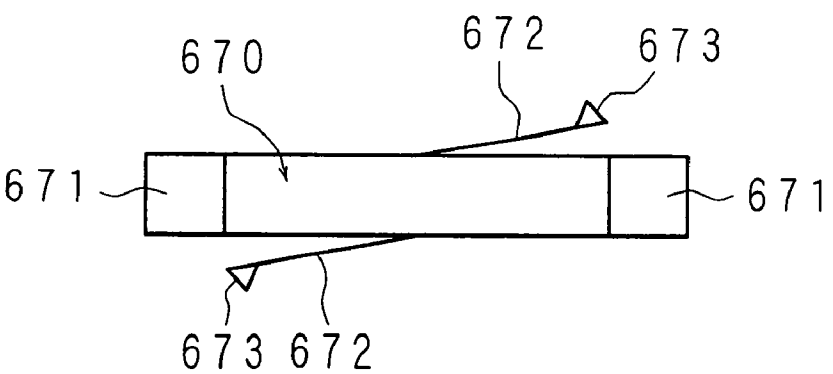
FIGS. 38A and 38B are diagrammatic views describing a biasing force caused by a plate spring of a click number change member in an operating system according to the sixth embodiment of the present invention.
Figure 38B:
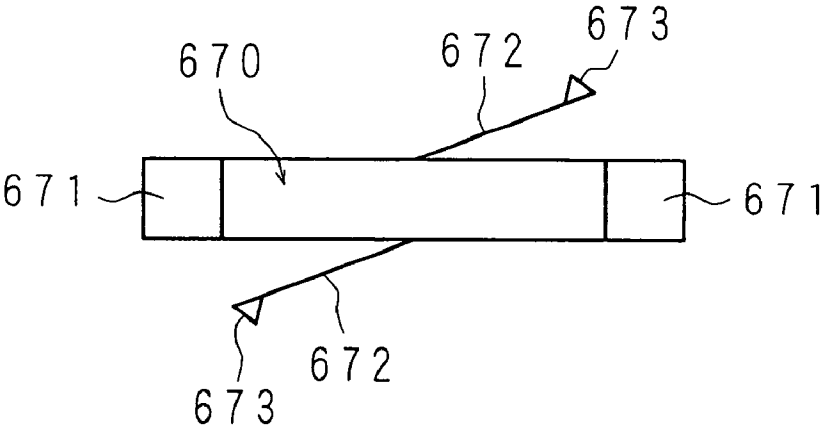

FIGS. 38A and 38B are the diagrammatic views describing the biasing force applied by the plate spring 672 of the click number change member 670 in the operating system according to the sixth embodiment of the present invention. The diagrammatic sides of the two kinds of the click number change members 670 having the different biasing forces are shown in FIG. 38A and FIG. 38B, respectively. Also, in the click number change member 670 shown in FIG. 38A, the biasing force of the nail 673 applied by the plate spring 672 is weak, and in the click number change member 670 shown in FIG. 38B the biasing force of the nail 673 applied by the plate spring 672 is strong. As shown in FIGS. 38A and 38B a difference is set for the separation amounts from the end surfaces of the click number change members 670 of the plate springs 672 in the state that the outer force is not applied. Thus, it is possible to adjust the biashing force by which the nail 673 is biased to the first click surface 644 and the second click surface 637.

When the click number change member 670 moves in the axial direction and comes close to the end surface portion 635 of the dial switch 630, the nail 673 of the plate spring 672 provided on the end surface of one side is engaged with the concaves or convexes formed on the second click surface 637 of the end surface portion 635. When the dial switch 630 is rotationally operated in this state, the nail 673 and the second click surface 637 are engaged with each other in turn so that the click feeling can be generated. Also, when the click number change member 670 moves in the opposite direction and comes close to the linking portion 643 of the dial shaft 640, the nail 673 of the plate spring 672 provided on the end surface of the other side is engaged with the concaves or convexes formed on the first click surface 644 of the linking portion 643. When the dial shaft 630 is rotationally operated in this state, the nail 673 and the first click surface 644 are engaged with each other in turn so that the click feeling can be generated. By the way, the click feeling includes the clicking noise [click-clack] generated in association with the engagement between the nail 673 and the concaves or convexes on the first click surface 644 or second click surface 637, and the vibration generated at this time, and the like. Also, the operating device 610 is configured such that both of the nails 673 on one side and the other side of the click number change member 670 is not engaged with the concaves or convexes of the first click surface 644 and second click surface 637.

The operating device 610 is configured such that the number of the concaves or convexes on the first click surface 644 and the number of the concaves or convexes on the second click surface 637 is different. Thus, by changing the click surface with which the nail 673 of the click number change member 670 is engaged, it is possible to change the generation frequency of the click feeling, namely, the click number when the dial switch 630 is rotationally operated. The click surface with which the nail 673 is engaged can be changed by sliding the click number change member 670 in the axial direction and making it come close to one of the first click surface 644 and the second click surface 637.

The operating device 610 comprises a base cylinder 660 for supporting the click number change member 670 so that the click number change member 670 can be slid in the axial direction and cannot be rotated in the circumferential direction. The base cylinder 660 is cylindrical and has the size and the shape that enable the rotary encoder 680, the dial shaft 640, the small cylindrical portion 634 of the dial switch 630, the click number change member 670 (except the support shaft 671) and the like to be accommodated therein. One end side (bottom end side) of the base cylinder 660 is immovably fixed to the substrate 690 in the state that they are accommodated inside the base cylinder 660.

On the other end side (top end side) of the base cylinder 660, two notches 661 that are long in the axial direction are formed. The two notches 661 are formed on the sides opposite to each other, with the axial center of the base cylinder 660 therebetween. The width of each of the notches 661 is set to be approximately equal to or slightly wider than the diameter of the support shaft 671 in the click number change member 670. Thus, the support shaft 671 can be inserted into the notch 661, and the support shaft 671 can be moved through the notch 661 in the axial direction of the base cylinder 660. Also, the inner diameter of the base cylinder 660 is slightly thicker than the outer diameter of the click number change member 670, and the outer diameter of the base cylinder 660 is sufficiently smaller than the distance between the axial center of the click number change member 670 and the protrusion end of the support shaft 671.

Thus, since the two support shafts 671 of the click number change member 670 inserted through the small cylindrical portion 641 of the dial shaft 640 are inserted into the two notches 661 of the base cylinder 660, respectively, the click number change member 670 is supported by the base cylinder 660 so that it can be slid in the axial direction along the notch 661 and cannot be rotated in the circumferential direction. In this state, the two support shafts 671 of the click number change member 670 are in the states that they are inserted through the notches 661 and protruded to outside the base cylinder 660.

On the outer circumferential surface of the base cylinder 660, a flange 662 is circumferentially placed at the position between the notch 661 and the bottom end. On the flange 662, cylindrical holders 663 are placed at the positions opposite to each other (the two locations of the front and rear portions) with the axial center of the base cylinder 660 therebetween, respectively. The holders 663 hold an operating bar 693 for operating the tact switch 692 mounted on the substrate 690. Each of the holders 663 is placed on the flange 662 so that its axial center is approximately parallel to the axial center of the base cylinder, and when the base cylinder 660 is fixed to the substrate 690, each of the holders 663 covers the top surface of the tact switch 692. The inner diameter of the holder 663 is approximately equal to the outer diameter of the operating bar 693. Then, since the operating bar 693 is slid in the axial direction (the upper and lower direction) inside the holder 663, the operating bar 693 can push down the tact switch 692.

On the flange 662 of the base cylinder 660, a notch 664 is formed on a part (right side) thereof. The switching switch 691 fixed to the substrate 690 is placed so as to be accommodated in the notch 664 of the flange 662 in the base cylinder 660 fixed to the substrate 690. The switching switch 691 has a bar-shaped detecting shaft 691*a* that is swingably supported by the main body having the shape of a rectangular parallelepiped. The switching switch 691 detects the switching, by detecting the position of the detecting shaft 691*a*, from the three positions of the standard position where the detecting shaft 691*a* is biased by the member such as the spring built in the main body or the like; and the endmost positions on both sides when the detecting shaft 691*a* is swung with this standard position as a center.

Also, the operating device 610 comprises a rotating cylinder 650 (cylinder) that supports the mode switching switch 620 rotatably and swingably and also moves the click number change member 670 in the axial direction in association with the rotation of the mode switching switch 620. The rotating cylinder 650 is cylindrical and externally engaged with the base cylinder 660, and the mode switching switch 620 is swingably supported on the one end side (top end side). Also, the rotating cylinder 650 is supported on the flange 662 of the base cylinder 660 and can be rotated around the base cylinder 660, because the other end side (bottom end side) thereof is externally engaged from the side (upper side) on which the notch 661 of the base cylinder 660 is provided. As mentioned above, the tip portion of the support shaft 671 of the click number change member 670 protrudes from the notch 661 of the base cylinder 660. Thus, when the rotating cylinder 650 is externally engaged with the base cylinder 660, a groove 651 through which the tip portion of the support shaft 671 is passed is formed thereon. The groove 651 is formed from the other end (bottom end) of the rotating cylinder 650 to the position of the substantial center in the axial direction. On the rotating cylinder 650, an arch-shaped reinforcement 652 is provided towards the outer circumferential side so that the groove 651 is covered.

A guide groove 653, which is continuously connected to the above-mentioned groove 651 and long in the circumferential direction of the rotating cylinder 650 and has the shape of a long hole, is formed on the substantial center in the axial direction of the rotating cylinder 650. The guide groove 653 having the shape of the long hole is formed such that, although the portion between one end 653*a* and a center 653*b* is formed along the circumferential direction of the rotating cylinder 650, the guide groove 653 is slightly bent at the center 653*b*, and the portion between the center 653*b* and the other end 653*c* is gradually displaced towards the upper side in the axial direction. The groove 651 and the guide groove 653 are formed on both of the sides (the front side and the rear side) with the axial center of the rotating cylinder 650 therebetween, respectively, and the two guide grooves 653 are substantially equal in shape. The widths of the groove 651 and the guide groove 653 are substantially equal or slightly greater than the diameter of the support shaft 671 of the click number change member 670. When the rotating cylinder 650 is externally engaged with the base cylinder 660, the support shaft 671 of the click number change member 670, which protrudes from the notch 661 of the base cylinder 660, is guided to the guide groove 653 along the groove 651 formed on the rotating cylinder 650.

The mode switching switch 620 has the shape of the substantially oval plate on the plan view. The various concaves and convexes are formed on the surface of one side (top side) and the circumferential surface, in order for the user to easily execute the operation. On the mode switching switch 620, a penetration hole 621 having the size which enables the insertion of the rotating cylinder 650 is formed on the opposite side to the tip portion 620*a*. The penetration hole 621 has the shape of a substantial circle whose center coincides with the rotation axis of the mode switching switch 620. Round-bar-shaped swinging shafts 622, which protrude towards the center of the penetration hole 621, are formed on the two positions opposite to each other, respectively, on the right and left sides of the inner circumferential surfaces.

On the right and left sides of the one end (top end) of the rotating cylinder 650, bearing units 654 for receiving the swinging shafts 622 of the mode switching switch 620 are formed at the positions opposite to each other. Each of the bearing unit 654 is the notch having the shape of an ellipse that is formed in the axial direction from the one end of the rotating cylinder 650, in which the axial length is approximately equal to or slightly greater than the diameter of the swinging shaft 622, and the width is approximately equal to the diameter of the swinging shaft 622. Since the swinging shaft 622 is supported by the bearing unit 654 of the rotating cylinder 650 inserted through the penetration hole 621 of the mode switching switch 620, the mode switching switch 620 can be swung with the swinging shaft 622 as a center.

Also, the operating device 610 comprises a cylindrical fixing member 625 that is equal in diameter to the rotating cylinder 650. By the fixing member 625, the mode switching switch 620 is fixed to the rotating cylinder 650 in the situation that it cannot be detached. The fixing member 625 is immovably fixed to the one end (top end) of the rotating cylinder 650 by means of screwing, adhering, engaging and the like. Thus, the bearing unit 654 of the rotating cylinder 650 is closed, and the mode switching switch 620 is fixed to the rotating cylinder 650 with the swinging shaft 622 as a center, in the situation that it cannot be detached although it can be swung. In this state, when the user rotationally operates the mode switching switch 620, the mode switching switch 620 and the rotating cylinder 650 are integrally rotated.

The rotation of the mode switching switch 620 is detected by the switching switch 691 as mentioned above. The rotating cylinder 650 in the operating device 610 has two switching bars 655 that are placed so as to protrude in the radial direction from the outer circumferential surface near the location where the switching switch 691 is placed. The protrusion amount of the switching bar 655 is similar to the protrusion amount with regard to the radial direction of the flange 662 provided on the base cylinder 660, and the positions in the axial directions of the two switching bars 655 are approximately equal, and the two switching bars 655 are separated by the distance similar to the width of the notch 664 of the flange 662 in the circumferential direction. When the rotating cylinder 650 is externally engaged with the base cylinder 660, the detecting shaft 691*a* of the switching switch 691, which is placed on the substrate 690 so as to be accommodated in the notch 664 of the base cylinder 660, is placed between the two switching bars 655 of the rotating cylinder 650. When the rotating cylinder 650 is rotated in association with the rotation of the mode switching switch 620, the switching bar 655 of the rotating cylinder 650 is brought into contact with the detecting shaft 691*a* of the switching switch 691 and swung. Consequently, the switching switch 691 can detect the rotation of the mode switching switch 620.

Also, two protrusions 623 that cylindrically protrude are provided on the bottom surface of the mode switching switch 620. The protrusions 623 are provided opposite to each other, forwardly and backwardly, with the center of the penetration hole 621 of the mode switching switch 620 therebetween. The diameter of the protrusion 623 is approximately equal to the diameter of the operating bar 693 to operate the tact switch 692. The protrusion amount of the protrusion 623 from the bottom surface of the mode switching switch 620 is approximately equal to the distance between the outer portion 601 of the instrument panel and the mode switching switch 620. Thus, the protrusion 623 never disturbs the rotation of the mode switching switch 620.

The end (top end) of the operating bar 693 held by the holder 663 of the base cylinder 660 is inserted into the penetration hole (not shown) formed in the outer portion 601 of the instrument panel, and only the end surface is exposed to the outer portion 601. The end surface of the protrusion 623 is brought into contact with the end surface of the operating bar 693 inserted into the penetration hole of the outer portion 601, when the tip portion 620*a* of the mode switching switch 620 is located at the rotation position indicative of the operational mark 603, after the operating device 610 is assembled, and when the mode switching switch 620 is swung, any one of the two operating bars 693 is pushed down to operate the tact switch 692.

When the operating device 610 is assembled, at first, the rotary encoder 681, the switching switch 691 and the tact switch 692 are mounted on the substrate 690, and the large cylindrical portion 642 of the dial switch 640 is externally engaged with and fixed to the rotator 682 of the rotary encoder 681. Next, the base cylinder 660 is fixed to the substrate 690 by the screwing, the adhering and the like. Then, the click number change member 670 is attached to the dial shaft 640. At this time, the dial shaft 640 is inserted through the opening of the click number change member 670, and the two support shafts 671 of the click number change member 670 are inserted into the two notches 661 of the base cylinder 660.

Next, the rotating cylinder 650 is externally engaged with and attached to the base cylinder 660. At this time, the support shaft 671 of the click number change member 670, which protrudes from the notch 661 of the base cylinder 660, is inserted through the groove 651 of the rotating cylinder 650 and guided to the guide groove 653. Then, the rotating cylinder 650 is externally engaged with the base cylinder 660. Next, after the operating bars 693 are held by the two holders 663 of the base cylinder 660, respectively, the swinging shaft 622 of the mode switching switch 620 is accommodated in the bearing unit 654 of the rotating cylinder 650, and the fixing member 625 is fixed to the rotating cylinder 650. Consequently, the mode switching switch 620 is attached. After that, the nail receiver 636 of the dial switch 630 in which the cap 632 is mounted on the outer cylinder 631 and the fixing nail 645 provided on the top end of the dial shaft 640 are engaged with each other. Consequently, the dial switch 630 is fixed to the dial shaft 640, and the assembling of the operating device 610 is completed.

In the operating device 610 assembled as mentioned above, when the mode switching switch 620 is moved to the central position of the rotation, namely, the position where the tip portion 620*a* indicates the operational mark 603, the support shaft 671 of the click number change member 670 is located at the center 653*b* of the guide groove 653 in the rotating cylinder 650, and the support shaft 671 is located at the bottom end of the notch 661 of the base cylinder 660. In this state, the nail 673 provided on the lower side of the click number change member 670 is biased by the plate spring 672 and engaged with the first click surface 644 of the dial shaft 640. On the first click surface 644, for example, 60 concaves or convexes are formed at the equal interval over the one circumference. Thus, when the user rotationally operates the dial switch 630, 60 click feelings per circumference are generated.

Also, in the situation that the tip portion 620*a* of the mode switching switch 620 indicates the operational mark 603, the mode switching switch 620 can be swung in the direction (the front and rear direction) of the operational mark 603 or operational mark 605. For example, when a menu is displayed on a display installed inside the vehicle, the user can select the menu by swinging the mode switching switch 620.

When the mode switching switch 620 is counterclockwise rotationally operated to the position of the operational mark 602, in association with the rotation of the mode switching switch 620, the rotating cylinder 650 is counterclockwise rotated. At this time, the insertion position of the support shaft 671 of the click number change member 670 is changed from the center 653*b* of the guide groove 653 in the rotating cylinder 650 to the one end 653*a*. The center 653*b* and one end 653*a* of the guide groove 653 are formed at the equal position with respect to the axial direction of the rotating cylinder 650. Thus, the click number change member 670 is not moved to the axial direction. Hence, the nail 673 provided on the bottom side of the click number change member 670 is biased by the plate spring 672 and engaged with the first click surface 644 of the dial shaft 640. Then, when the user rotationally operates the dial switch 630, 60 click feelings per circumference is generated.

When the mode switching switch 620 is clockwise rotationally operated to the position of the operational mark 604, in association with the rotation of the mode switching switch 620, the rotating cylinder 650 is clockwise rotated. The guide groove 653 is shaped so as to be bent at the center 653*b* and gradually displaced in the axial direction so that the other end 653*c* is located on the upper side. The other end 653*c* of the guide groove 653 is located on the upper side than the one end 653*a* and the center 653*b*. Then, in association with the rotation of the rotating cylinder 650, the insertion position of the support shaft 671 of the click number change member 670 is changed from the one end 653*a* to the other end 653*c* of the guide groove 653 in the rotating cylinder 650. Thus, the click number change member 670 is moved to the upper side in the axial direction along the notch 661 of the base cylinder 660. The nail 673 provided on the top side of the click number change member 670 is biased by the plate spring 672 and engaged with the first click surface 637 of the dial switch 630. On the second click surface 637, for example, 30 concaves or convexes are formed at the equal interval over the one circumference. Hence, when the user rotationally operates the dial switch 630, 30 click feelings per circumference is generated.

The operating device 610 having the foregoing configuration is configured such that the mode switching switch 620 and the dial switch 630 are coaxially stacked. Thus, since the operating device 610 can be miniaturized, the operating device 610 can be easily placed in the limited space such as the instrument panel in the vehicle and the like. Also, the operating device 610 is configured such that the mode switching switch 620 is used to switch the mode, and the setting or adjustment or the like at each mode is carried out by the dial switch 630. Hence, the plurality of functions can be operated by the one operating device 610. Also, since the operating device 610 is configured such that the mode switching switch 620 can receive the swinging operation as well as the rotational operation, the number of the functions of the operating device 610 can be further increased.

Also, the nails 673 placed on both of the sides in the axial direction of the click number change member 670 and the first click surface 644 of the dial shaft 640 or the second click surface 637 of the dial switch 630 are engaged with each other to generate the click feeling, and in association with the rotation of the mode switching switch 620, the click number change member 670 are moved upwardly and downwardly in the axial direction, and the click surface with which the nail 673 is engaged is changed. Thus, by the mode switching switch 620, the click feeling which is different for each mode can be generated easily and surely in association with the rotational operation of the dial switch 630. Also, the rotary encoder 680 for detecting the rotation of the dial switch 630 is configured to be placed on the substrate 690 coaxially with the dial switch 630. Hence, the operating device 610 can be further miniaturized.

Also, in the operating system comprising the two operating devices 610, the respective biasing forces of the nails 673 applied by the plate springs 672 in the respective operating devices 610 are made different, thereby applying the different operation loads to the dial switches 630 in the respective operating devices 610. Thus, the user can recognize one of the two operating devices 610 that is rotationally operated, on the basis of the operational load, without any visual check of the operating system.

By the way, this embodiment is configured such that the operating device 610 can be changed to the three modes by the mode switching switch 620. However, this is not limited thereto. This may be configured to be changed to the two mode or four or more modes. Also, at the two modes among the three modes, the 60 click feelings are generated for each rotation of the dial switch 630, and at the one mode, the 30 click feelings are generated for each rotation of the dial switch 630. However, this is not limited thereto. The generation number (crick number) of the click feelings for each rotation of the dial switch 630 may be arbitrary. Then, only by changing the shapes (the number of the concaves or convexes) of the first click surface 644 of the dial shaft 640 and the second click surface 637 of the dial switch 630, it is possible to easily set the click number. Also, one of the nails 673 provided on both of the sides of the click number change member 670, respectively, is configured to be engaged with one of the first click surface 644 and the second click surface 637. However, this is not limited thereto. The operating device 610 may be configured to change the click number at the three stages, including the state in which the nail 673 of the click number change member 670 is not engaged with any of the click surfaces, namely, the state in which the click feeling is not generated even if the dial switch 630 is rotationally operated.

Also, the operating device 610 is configured such that the mode switching switch 620 can be swung in the front and rear direction. However, this is not limited thereto. This may be configured such that the mode switching switch 620 cannot be swung and only the rotational operation is received. Also, the operating system is configured to comprise the two operating devices 610. However, this is not limited thereto. This may be configured to comprise only one operating device 610 or comprise the three or more operating devices 610. Also, the operating system is configured such that, when the operating system comprises the plurality of operating devices 610, the pushing forces of the nails 673 applied by the plate springs 672 of the click number change members 670 in the respective operating devices 610 are made different, thereby setting the difference between the operational loads. However, this is not limited thereto. The operating system may be configured such that the operational loads of all of the operating devices 610 are equal.

Variation Example 1

Figure 39:
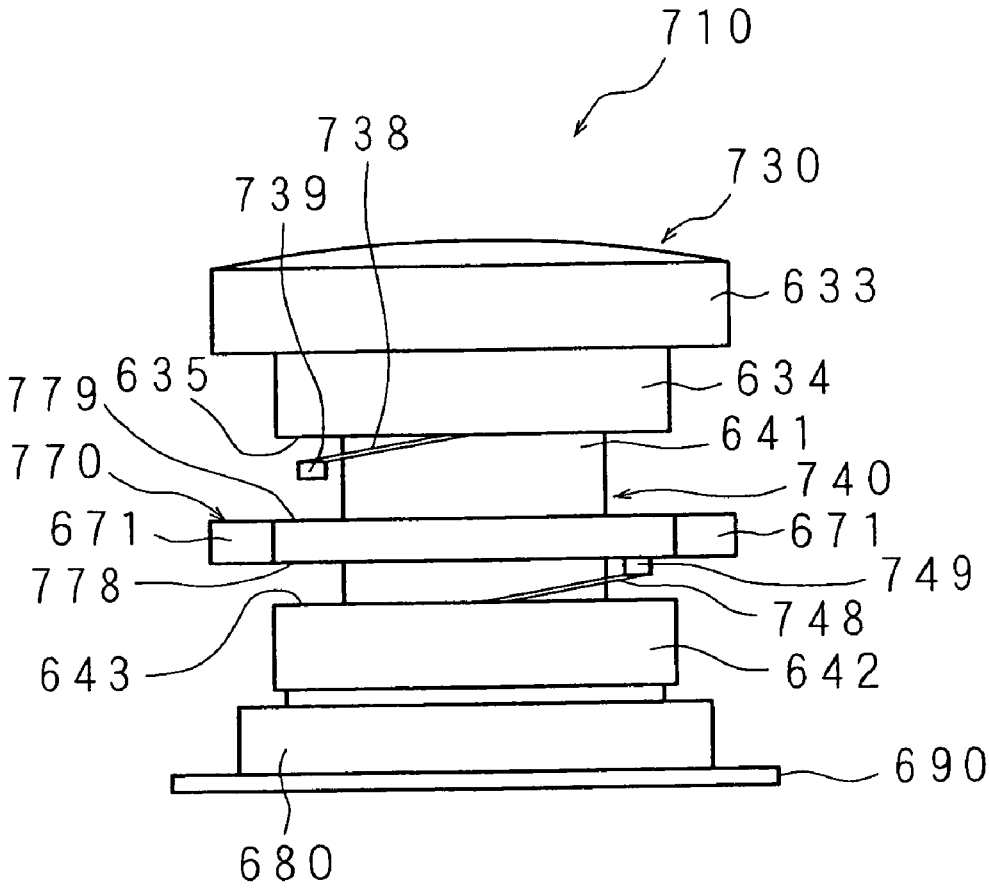
FIG. 39 is a diagrammatic side view showing a configuration of a operating device according to a variation example 1 of the sixth embodiment of the present invention.

The above-mentioned operating device 610 is configured such that the nails 673 and the plate springs 672 are placed in the click number change member 670, and the click surfaces are placed on the dial shaft 640 and the dial switch 630. However, this is not limited thereto. The placement position relation between the nail 673 and the plate spring 672 and the click surface may be opposite. FIG. 39 is the diagrammatic side view showing the configuration of an operating device 710 according to the variation example 1 in the sixth embodiment of the present invention. FIG. 39 only shows a dial switch 730 (second rotation operation body), a dial shaft 740 (shaft), a click number change member 770 (moving body), the rotary switch 680 and the substrate 690. The illustrations of the mode switching switch 620, the rotating cylinder 650, the base cylinder 660 and the like are omitted.

In the operating device 710 according to the variation example 1, a first click surface 778 (engaging unit) having 60 concaves or convexes is formed on one surface (bottom surface) in the axial direction of the click number change member 770, and a second click surface 779 (engaging unit) having 30 concaves or convexes are formed on the opposite surface (top surface). A plate spring 738 is provided on the lower end surface portion of the dial switch 730, and a nail 739 (engaged unit) is biased downwardly by the plate spring 738. Similarly, a plate spring 748 is placed on the linking portion of the dial shaft 740 opposite to the end surface portion of the dial switch 730. Then, a nail 749 (engaged unit) is upwardly biased by the plate spring 748.

When the click number change member 770 is downwardly moved in association with the rotation of the mode switching switch 620, the nail 749 placed on the dial shaft 740 is biased to the first click surface 778 provided on the bottom surface of the click number change member 770 by the plate spring 748, and with the engagement between the nail 749 and the first click surface 778, the click feeling can be generated by the rotational operation of the dial switch 730. Also, when the click number change member 770 is upwardly moved, the nail 739 placed on the dial switch 730 is biased to the second click surface 779 provided on the top surface of the click number change member 770 by the plate spring 738, and with the engagement between the nail 739 and the second click surface 779, the click feeling can be generated.

The operating device 710 according to the variation example 1 having the foregoing configuration can obtain the effect similar to the operating device 610 shown in FIG. 30 to FIGS. 38A and 38B.

Variation Example 2

Figure 40A:
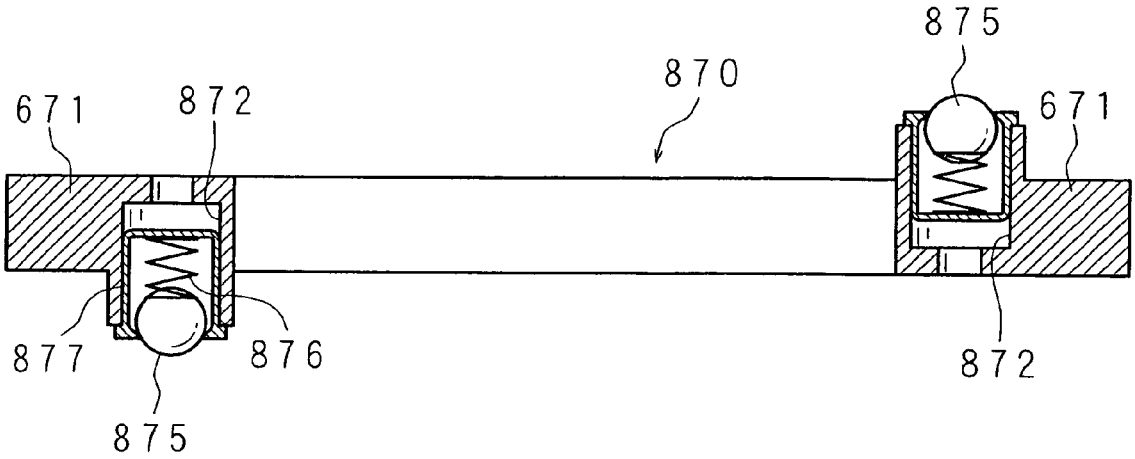
FIGS. 40A and 40B are diagrammatic side views showing a configuration of a click number change member in an operating device according to a variation example 2 of the sixth embodiment of the present invention.
Figure 40B:
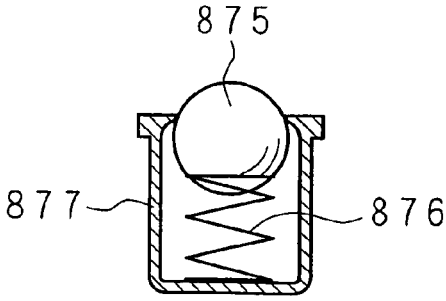

The above-mentioned operating device 610 is configured such that by the plate spring 672 placed on the click number change member 670, the nail 673 is biased to and engaged with the click surface, and the click feeling is generated. However, this is not limited thereto. The biasing to and engaging with the click surface may be attained under the different configuration. FIGS. 40A and 40B are the diagrammatic sectional views showing the configuration of a click number change member 870 (moving body) of the operating device according to the variation example 2 in the sixth embodiment of the present invention.

In the click number change member 870 in the variation example 2, accommodation holes 872 each having the shape that can accommodate a cylindrical member are formed at the positions opposite to each other, on both surfaces of a top surface and a bottom surface and with the axial center therebetween. The click number change member 870 has: a cylindrical housing 877 having a bottom that is accommodated in the accommodation hole 872; a ball member 875 (engaged unit) that is accommodated in this housing 877; and a coil spring 876 that is accommodated in the housing 877 and biases the ball member 875 towards the opening of the housing 877.

Although the inner diameter of the housing 877 is slightly thicker than the diameter of the ball member 875, the opening of the housing 877 is smaller than the diameter of the ball member 875. Thus, although the ball member 875 is biased towards the opening by the coil spring 876, it cannot be moved outside the opening. Then, a part of the ball member 875 is only exposed from the opening. By the way, the housing 877 is made of synthesis resin and has a slight flexibility. Hence, at the step of assembling the click number change member 870, the application of a certain pressing force enables the ball member 875 to be pushed from the opening of the housing 877 to the inside.

Also, the housing 877 in which the ball member 875 and the coil spring 876 are accommodated is fixed to the accommodation hole 872 of the click number change member 870 by press-fitting, adhering and the like. The click number change member 870 in which the ball member 875, the coil spring 876 and the housing 877 are mounted on both surfaces of the top surface and the bottom surface, respectively, is moved in the axial direction in the situation that the click number change member 870 is inserted through the dial shaft 640. Then, a part of the ball member 875 that is exposed from the opening of the housing 877 is engaged with the concaves or convexes of the first click surface 644 or second click surface 637. When the dial switch 630 is rotationally operated in this state, the ball member 875 of the click number change member 870 is engaged with the concaves or convexes on the click surface in turn, while the moving in and out the opening of the housing 877 is repeated, and the click feeling can be generated.

By the way, the variation example 2 is configured such that the ball member 875, the coil spring 876 and the housing 877 are provided in the click number change member 870. However, this is not limited thereto. When the first click surface and the second click surface are provided on the click number change member as indicated in the variation example 1, the ball member 875, the coil spring 876 and the housing 877 may be configured to be provided in the dial switch 630 and the dial shaft 640 and the like.

Variation Example 3

Figure 41:
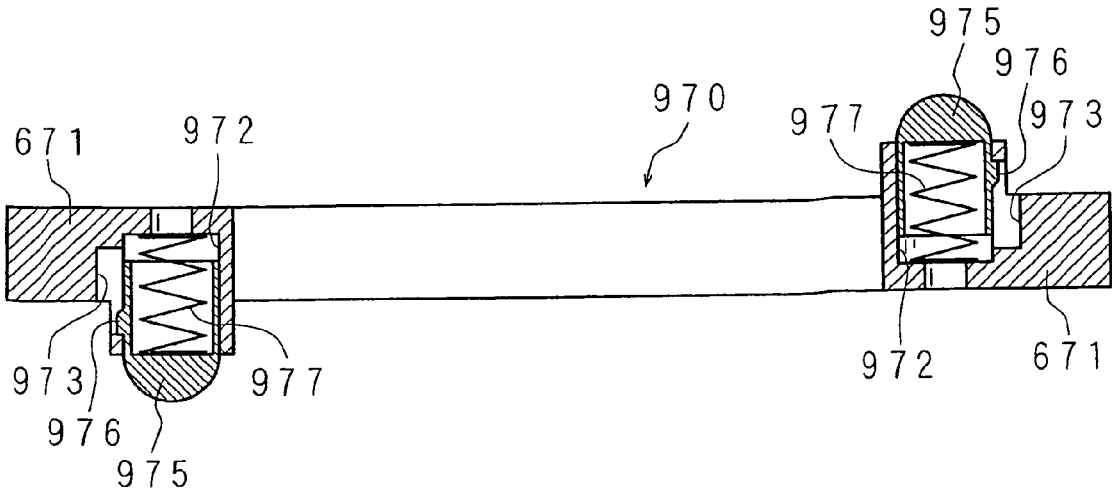
FIG. 41 is a diagrammatic side view showing a configuration of a click number change member in an operating device according to a variation example 3 of the sixth embodiment of the present invention.

FIG. 41 is the diagrammatic sectional view showing the configuration of a click number change member 970 (moving body) of the operating device according to the variation example 3 in the sixth embodiment of the present invention. In the click number change member 970 in the variation example 3, accommodation holes 972 each having the shape which can accommodate a cylindrical member are formed at the positions opposite to each other with the axial center therebetween, on both surfaces of a top surface and a bottom surface, respectively.

The accommodation hole 972 accommodates: a cylindrical engaged member 975 (engaged unit) having a bottom in which the outer surface of a bottom portion is hemi-sphere; and a coil spring 977. Also, the engaged member 975 is accommodated in an accommodation hole 972 so that the bottom portion is externally exposed, and is biased to be externally protruded by the coil spring 977 accommodated in the accommodation hole 972.

Also, a concave 973 is formed on a part of the inner circumferential surface of the accommodation hole 972. An engaging nail 976 that protrudes in the radial direction is formed on a part of the outer circumferential surface of the engaged member 975. When the engaged member 975 is accommodated in the accommodation hole 972, the engaging nail 976 of the engaged member 975 is accommodated inside the concave 973 of the accommodation hole 972 so that the engaged member 975 biased by the coil spring 977 is prevented from being jumped out of the accommodation hole 972. By the way, the engaged member 975 is made of synthesis resin and has a slight flexibility. Thus, at the step of assembling the click number change member 970, since the outer circumferential surface of the click number change member 970 is interiorly bent, the engaged member 975 can be pushed into the accommodation hole 972.

The click number change member 970 in which the engaged members 975 are mounted on both surfaces of the top surface and the bottom surface, respectively, is moved in the axial center direction in the state that the click number change member 970 is inserted through the dial shaft 640, and a part of the engaged member 975 that protrudes from the accommodation hole 972 is engaged with the concaves or convexes of the first click surface 644 or second click surface 637. When the dial switch 630 is rotationally operated in this state, the engaged member 975 of the click number change member 970 is engaged with the concaves or convexes on the click surface in turn, while the moving in and out the accommodation hole 972 is repeated, and the click feeling can be generated.

By the way, the variation example 3 is configured such that the engaged member 975 is placed on the click number change member 970. However, this is not limited thereto. As described in the variation example 1, when the first click surface and the second click surface are provided on the click number change member, the engaged member 975 may be configured to be provided on the dial switch 630 and the dial shaft 640 and the like.

What is claimed is:

1. An operating device comprising:

a first rotation operation body that is rotated;

a second rotation operation body that is rotated and provided coaxially with the first rotation operation body;

a shaft that is coaxially connected with the second rotation operation body;

a moving body that is provided opposite to the shaft, and is moved in an axial direction in response to rotation of said first rotation operation body;

a plurality of engaging units that are provided on one of said shaft and said moving body and are aligned in said axial direction, and have a plurality of concaves or convexes which are aligned at a predetermined interval in a rotation direction of said shaft respectively, the numbers of the aligned concaves or convexes differing from each other in the plurality of engaging units; and an engaged unit that is provided on the other of said shaft and said moving body, elastically biased towards one of said engaging units, and engaged with said concaves or convexes, wherein in response to the movement of said moving body, the engaging unit by which said engaged unit is elastically biased is changed.

2. The operating device according to claim 1, wherein said moving body is cylindrical and said shaft is inserted through the moving body;

said plurality of engaging units are aligned on an inner circumferential surface of said moving body, in the axial direction of said moving body; and said engaged unit is provided on an outer circumferential surface of said shaft.

3. The operating device according to claim 1, further comprising:

a cylinder that is coaxially connected with said first rotation operation body;

a guide groove that is provided on the cylinder, has a long shape in a circumferential direction of said cylinder, and is gradually displaced in an axial direction of said cylinder; and a bar-shaped inserted unit that is protrusively provided on said moving body, and is inserted into said guide groove, wherein in accordance with the rotation of said cylinder, an insertion position into said guide groove of said inserted unit is changed, and said moving body is moved in the axial direction.

4. The operating device according to claim 1, further comprising protrusions which are provided on boundaries between said plurality of engaging units, respectively.

5. The operating device according to claim 1, wherein said shaft is cylindrical and said operating device further comprising:

a pressing detection unit for detecting pressing;

a press operation body that is moved in said axial direction in accordance with a pressing operation; and a pressing member that is linked to the press operation body, and presses said pressing detection unit through said shaft in association with said pressing operation.

6. The operating device according to claim 1, wherein said second rotation operation body and said shaft are cylindrical and said operating device further comprising:

a light emitting body;

a light guide member that is provided so as to be inserted through said shaft, and guides light emitted by said light emitting body into said second rotation operation body; and a light-transmitting unit for transmitting light guided by the light guide member to outside.

7. The operating device according to claim 1, wherein said first rotation operation body is swingably supported, and said operating device further comprising a swinging detection unit for detecting swinging of said first rotation operation body.

8. The operating device according to claim 1, wherein said second rotation operation body or said shaft is hollow, the operating device further comprising:

a fixed shaft which is interiorly provided coaxially with hollow said second rotation operation body or said shaft, and fixed in a manner that the fixed shaft cannot be rotated; and a wave-shaped annular body which is sandwiched between said second rotation operation body or said shaft and said fixed shaft, wherein an operational load is applied to said second rotation operation body by said annular body.

9. The operating device according to claim 1, wherein said plurality of engaging units are aligned on an outer circumferential surface of said shaft, in an axial direction of said shaft; and said engaged unit is provided on said moving body.

10. The operating device according to claim 9, wherein said moving body is cylindrical and said shaft is inserted through the moving body; and said engaged unit is provided on an inner circumferential surface of said moving body.

11. The operating device according to claim 1, further comprising a rotation detecting unit that is provided coaxially with said shaft, and detects rotation of said second rotation operation body.

12. The operating device according to claim 11, further comprising:

a plurality of first light shielding detection units which are aligned in said rotation direction at a predetermined interval, have a light emitting unit and a light receiving unit respectively, and detect light shielding in accordance with the presence or absence of the light, which is emitted by the light emitting unit and received by said light receiving unit; and a plurality of first light shielding units which are provided on said shaft at an interval different from said predetermined interval, and optically shield light emitted by said light emitting units in turn in association with the rotation of said shaft, wherein said rotation detecting unit detects rotation of said second rotation operation body, in response to a timing of light shielding detected by said plurality of first light shielding detection units.

13. An operating system comprising a plurality of the operating devices according to claim 1, wherein different operation loads are given to said second rotation operation bodies in the respective operating devices.

14. The operating system according to claim 13, wherein said second rotation operation body or said shaft is hollow, each of said operating devices has:

a fixed shaft, which is interiorly provided coaxially with hollow said second rotation operation body or said shaft, and is fixed in a manner that the fixed shaft cannot be rotated; and a wave-shaped annular body which is sandwiched between said second rotation operation body or said shaft and said fixed shaft, and gives said operation load, and said annular bodies in the respective operating devices have wave shapes whose heights differ from each other.

15. The operating device according to claim 1, further comprising:

a cylinder that is coaxially connected with said first rotation operation body; and a position detecting unit for detecting a position of said cylinder.

16. The operating device according to claim 15, further comprising a switching detection element that has an operated unit which is swingingly operated on said cylinder in association with rotation of said cylinder, and detects switching between contacts which is caused by swinging of the operated unit, wherein said position detecting unit detects a position of said first rotation operation body in accordance with the detection result of said switching detection element.

17. The operating device according to claim 15, further comprising:

a plurality of second light shielding detection unit-units which are aligned in said rotation direction at a predetermined interval, have a light emitting unit and a light receiving unit respectively, and detect light shielding in accordance with the presence or absence of light, which is emitted by the light emitting unit and received by said light receiving unit; and a plurality of second light shielding units which are provided on said cylinder, and optically shield light emitted by said light emitting unit, wherein said position detecting unit detects a position of said first rotation operation body, in response to a combination of light shielding detected by said plurality of second light shielding detection units.

18. An operating device comprising:

a first rotation operation body that is rotated;

a second rotation operation body that is rotated and provided coaxially with the first rotation operation body;

two parts that are provided in said second rotation operation body, so as to be opposite in an axial direction of a rotation shaft of the second rotation operation body;

an annular moving body, which has an opening through which the rotation shaft of said second rotation operation body is inserted, and is moved in the axial direction of said rotation shaft between said two parts so that the moving body comes close to one of said two parts and moves away from the other in response to rotation of said first rotation operation body;

engaging units, which are provided on said two parts, respectively, and have a plurality of concaves or convexes aligned at a predetermined interval in a rotation direction of said second rotation operation body; and engaged units, which are provided on one side and the other side in said axial direction of said moving body, respectively, and when said moving body approaches one of said two parts, said engaged units being elastically biased towards the approached engaging unit in said one of the two parts and being engaged with said concaves or convexes, wherein in the engaging units provided in said two parts, respectively, the numbers of aligned said concaves or convexes differ from each other.

19. The operating device according to claim 18, further comprising a rotation detecting unit that is provided coaxially with the rotation shaft of said second rotation operation body, and detects rotation of said second rotation operation body.

20. An operating system comprising a plurality of the operating devices according to claim 18, wherein the engaged units in the respective operating devices are biased by biasing forces which differ from each other.

21. An operating system comprising a plurality of the operating devices according to claim 18, wherein different operation loads are given to said second rotation operation bodies in the respective operating devices.

22. The operating system according to claim 21, wherein said second rotation operation body or said shaft is hollow, each of said operating devices has:

a fixed shaft, which is interiorly provided coaxially with hollow said second rotation operation body or said shaft, and is fixed in a manner that the fixed shaft cannot be rotated; and a wave-shaped annular body which is sandwiched between said second rotation operation body or said shaft and said fixed shaft, and gives said operation load, and said annular bodies in the respective operating devices have wave shapes whose heights differ from each other.

23. The operating device according to claim 18, further comprising:

a cylinder that is coaxially connected with said first rotation operation body;

a guide groove that is provided on the cylinder, has a long shape in a circumferential direction of said cylinder, and is gradually displaced in an axial direction of said cylinder; and an inserted unit that is provided in said moving body, and is inserted into said guide groove, wherein in response to rotation of said cylinder, an insertion position into said guide groove of said inserted unit is changed, and said moving body is moved in the axial direction.

24. The operating device according to claim 23, wherein said first rotation operation body is swingably supported by said cylinder, and further comprising a swinging detection unit for detecting swinging of said first rotation operation body.

25. An operating system comprising a plurality of the operating devices according to claim 23, wherein the engaged units in the respective operating devices are biased by biasing forces which differ from each other.

26. An operating system comprising a plurality of the operating devices according to claim 23, wherein different operation loads are given to said second rotation operation bodies in the respective operating devices.

27. The operating system according to claim 26, wherein said second rotation operation body or said shaft is hollow, each of said operating devices has:

a fixed shaft, which is interiorly provided coaxially with hollow said second rotation operation body or said shaft, and is fixed in a manner that the fixed shaft cannot be rotated; and a wave-shaped annular body which is sandwiched between said second rotation operation body or said shaft and said fixed shaft, and gives said operation load, and said annular bodies in the respective operating devices have wave shapes whose heights differ from each other.

28. An operating device comprising:

a first rotation operation body that is rotated;

a second rotation operation body that is rotated and provided coaxially with the first rotation operation body;

two parts that are provided in said second rotation operation body, so as to be opposite in an axial direction of a rotation shaft of the second rotation operation body;

an annular moving body that has an opening through which the rotation shaft of said second rotation operation body is inserted, and is moved in the axial direction of said rotation shaft between said two parts so that the moving body comes close to one of said two parts and moves away from the other in response to rotation of said first rotation operation body;

engaging units that are provided on one side and the other side in said axial direction of said moving body, respectively, and have a plurality of concaves or convexes aligned at a predetermined interval in a rotation direction of said second rotation operation body; and engaged units, which are provided on said two parts, respectively, and when said moving body approaches one of said two parts, said engaged units being elastically biased towards the approached engaging unit in said moving body and being engaged with said concaves or convexes, wherein in the engaging units provided on one side and the other side of said moving body, respectively, the numbers of aligned said concaves or convexes differ from each other.

29. The operating device according to claim 28, further comprising a rotation detecting unit that is provided coaxially with the rotation shaft of said second rotation operation body, and detects rotation of said second rotation operation body.

30. The operating device according to claim 28, further comprising:

a cylinder that is coaxially connected with said first rotation operation body;

a guide groove that is provided on the cylinder, has a long shape in a circumferential direction of said cylinder, and is gradually displaced in an axial direction of said cylinder; and an inserted unit that is provided in said moving body, and is inserted into said guide groove, wherein in response to rotation of said cylinder, an insertion position into said guide groove of said inserted unit is changed, and said moving body is moved in the axial direction.

31. The operating device according to claim 30, wherein said first rotation operation body is swingably supported by said cylinder, and further comprising a swinging detection unit for detecting swinging of said first rotation operation body.

* * * * *